US007784147B2

(12) United States Patent
Burkholder et al.

(10) Patent No.: US 7,784,147 B2
(45) Date of Patent: Aug. 31, 2010

(54) BOWLING LANE CONDITIONING MACHINE

(75) Inventors: Roy A. Burkholder, Montague, MI (US); Troy A. Recknagel, Muskegon, MI (US); Patrick J. Mitchell, Muskegon, MI (US); Jason D. Bernard, Grand Rapids, MI (US); Robert J. Prinz, Muskegon, MI (US); William C. Sias, Muskegon, MI (US); Matthew E. Mead, Whitehall, MI (US); Damir Ibrahimovic, Grandville, MI (US)

(73) Assignee: Brunswick Bowling & Billiards Corporation, Lake Forest, IL (US)

( * ) Notice: Subject to any disclaimer, the term of this patent is extended or adjusted under 35 U.S.C. 154(b) by 54 days.

(21) Appl. No.: 11/389,563

(22) Filed: Mar. 23, 2006

(65) Prior Publication Data

US 2006/0278161 A1 Dec. 14, 2006

Related U.S. Application Data

(63) Continuation-in-part of application No. 11/328,370, filed on Jan. 9, 2006, now Pat. No. 7,611,583, which is a continuation of application No. 10/934,005, filed on Sep. 2, 2004, now Pat. No. 7,014,714.

(60) Provisional application No. 60/500,222, filed on Sep. 5, 2003.

(51) Int. Cl.
*A63D 5/10* (2006.01)

(52) U.S. Cl. ..... 15/320; 15/319; 118/207

(58) Field of Classification Search ..... 15/320, 15/401, 383, 302, 319; 118/207
See application file for complete search history.

(56) References Cited

U.S. PATENT DOCUMENTS

| | | | |
|---|---|---|---|
| 899,726 | A | 9/1908 | Goodier |
| 1,130,064 | A | 3/1915 | Buchanan |
| 1,995,685 | A | 3/1935 | Perkins |
| 2,394,585 | A | 2/1946 | Bailey |
| 2,622,254 | A | 12/1952 | Mendelson |
| 2,712,297 | A | 7/1955 | McGrew |
| 2,763,019 | A | 9/1956 | Huber |
| 2,893,047 | A | 7/1959 | Swihart |
| 3,083,390 | A | 4/1963 | Wroten |
| 3,099,851 | A | 8/1963 | Unterbrink |
| 3,150,396 | A | 9/1964 | Unterbrink |

(Continued)

FOREIGN PATENT DOCUMENTS

| | | |
|---|---|---|
| JP | H03-51068 | 5/1991 |

(Continued)

OTHER PUBLICATIONS

"Engine Controllers-PCM555", http://motoron.com/pcm555.htm, 3 pages (2002).

(Continued)

*Primary Examiner*—Mark Spisich
(74) *Attorney, Agent, or Firm*—Brinks Hofer Gilson & Lione

(57) ABSTRACT

The invention relates generally to the conditioning of bowling lanes, and, more particularly to an apparatus and method for automatically applying a predetermined pattern of dressing fluid along the transverse and longitudinal dimensions of a bowling lane.

20 Claims, 56 Drawing Sheets

U.S. PATENT DOCUMENTS 3,150,407 A 9/1964 Mitchell
3,216,036 A 11/1965 Rockwood et al.
3,216,037 A 11/1965 Stevens et al.
3,217,347 A 11/1965 Domecki
3,321,331 A 5/1967 McNeely
3,377,640 A 4/1968 Rudolph
3,418,672 A 12/1968 Regan
3,428,986 A 2/1969 Rudolph
3,604,037 A 9/1971 Varne
3,729,769 A 5/1973 Sharpless
3,753,777 A 8/1973 Thomsen et al.
3,787,916 A 1/1974 Akagi et al.
3,868,738 A 3/1975 Horst et al.
3,942,215 A 3/1976 Olds
3,998,387 A 12/1976 Maasberg
4,069,540 A 1/1978 Zamboni
4,114,711 A 9/1978 Wilkins
4,167,798 A 9/1979 Klugl et al.
4,209,557 A 6/1980 Edwards
4,246,674 A 1/1981 Ingermann et al.
4,293,971 A * 10/1981 Block ..... 15/320
4,351,081 A 9/1982 Tarkinson
4,353,145 A 10/1982 Woodford
4,363,152 A 12/1982 Karpanty
4,369,544 A 1/1983 Parisi
4,463,469 A 8/1984 Green
4,487,788 A 12/1984 Scheie et al.
4,510,642 A 4/1985 Ingermann et al.
D281,362 S 11/1985 Ingermann et al.
4,562,610 A 1/1986 Davis et al.
4,586,213 A 5/1986 Bricher et al.
4,595,420 A 6/1986 Williams, III et al.
4,700,427 A 10/1987 Knepper
4,708,603 A 11/1987 Kubo
4,727,615 A 3/1988 Kubo
4,738,000 A 4/1988 Kubo
4,756,044 A * 7/1988 Clark ..... 15/207.2
4,766,016 A 8/1988 Kubo
4,845,794 A 7/1989 Korski et al.
4,856,138 A 8/1989 Ingermann et al.
4,910,824 A 3/1990 Nagayama et al.
4,920,604 A 5/1990 Ingermann et al.
4,937,911 A 7/1990 Picchietti, Sr. et al.
4,956,891 A 9/1990 Wulff
4,959,884 A 10/1990 Ingermann et al.
4,962,565 A 10/1990 Ingermann et al.
4,980,815 A 12/1990 Davis
4,990,162 A 2/1991 LeBlanc et al.
5,063,633 A 11/1991 Ingermann et al.
5,092,699 A 3/1992 Silvenis
5,109,791 A 5/1992 Matsumoto et al.
5,133,280 A 7/1992 Kubo
5,161,277 A 11/1992 Ingermann et al.
5,181,290 A 1/1993 Davis et al.
5,185,901 A 2/1993 Davis et al.
5,243,728 A 9/1993 Smith et al.
5,274,871 A 1/1994 Smith et al.
D344,163 S 2/1994 Joines
5,287,581 A 2/1994 Lo
5,327,609 A 7/1994 Bierma et al.
5,455,977 A 10/1995 Caffrey et al.
5,510,149 A 4/1996 Schucker et al.
5,517,709 A 5/1996 Caffrey et al.
5,629,049 A 5/1997 Caffrey et al.
5,641,538 A 6/1997 Caffrey et al.
5,650,012 A 7/1997 Davis
5,679,162 A 10/1997 Caffrey et al.
5,729,855 A 3/1998 Davis
5,753,043 A 5/1998 Davis
5,761,762 A 6/1998 Kubo
5,935,333 A 8/1999 Davis
6,090,203 A 7/2000 Gebhardt et al.
6,223,378 B1 5/2001 Watellier
6,261,463 B1 7/2001 Jacob et al.
6,383,290 B1 5/2002 Davis et al.
6,443,526 B1 9/2002 Scarlett
6,450,892 B1 9/2002 Burkholder et al.
6,615,434 B1 9/2003 Davis et al.
6,685,778 B2 2/2004 Davis et al.
6,736,900 B2 5/2004 Isogai et al.
6,766,817 B2 7/2004 da Silva
6,790,282 B2 9/2004 Davis et al.
6,923,863 B1 8/2005 Baker et al.
6,939,404 B1 * 9/2005 Davis et al. ..... 118/207
7,014,714 B2 3/2006 Buckley et al.
2002/0170130 A1 11/2002 Shinler
2003/0160844 A1 8/2003 Silva
2003/0206304 A1 11/2003 Davis et al.
2004/0010873 A1 1/2004 Davis et al.
2004/0237529 A1 12/2004 da Silva
2005/0246845 A1 * 11/2005 Duncan et al. ..... 15/320
2005/0255248 A1 11/2005 Baker et al.
2006/0107894 A1 * 5/2006 Buckley et al. ..... 118/207
2007/0289086 A1 12/2007 Davis et al.

FOREIGN PATENT DOCUMENTS

JP 6315448 11/1994
JP S48-073081 2/2001
NL 1001919 6/1997

OTHER PUBLICATIONS

"To connect KOSI to lane machine", 1 page (undated).
"Synerject-Fuel Injectors", http://www.synerject.com/fuelinjectors.html, 1 page (2004).
"Synerject-Fuel Injectors-DEKA IV", http://www.synerject.com/fuelinjectors-deka4.html, 1 page (2004).
"L107 High-Flow Fuel Injector", http://www.mototron.com/prod_minifuel_long.htm, 2 pages, printed on Jan. 11, 2005.
"Service Manual—Brunswick '90' Lane Conditioner", 56 pages, 1962.
"LaneRobot-Newshuttle", Brunswick, 35 pages (undated).
Brochure, "Kegel/DBA Phoenix-S—The Name you know. The Technology you need!," 1 page (double sided) (undated).
Brochure, "You've Got Control. Now Get Connected", 1 page (double sided) (2001).
Brochure, "Kustodian-The World's Best Selling Lane Machine", 1 page (double sided) (2003).
Brochure, "Advanced Performance Supplies", 4 pages (2001/2002).
Brochure, "Kegel/DBA-A Great Machine Just Got Better!", 1 page (double sided) (undated).
Brochure, "Every Center Needs a Great . . . Mechanik", 1 page (double sided) (2003).
Photograph, "The Phoenix S", 1 page (photo taken Dec. 22, 2003).
Manual, "Century Chairman", 14 pages (undated).
Photographs, "Century Chairman", 4 pages (photos taken Jul. 23, 2004).
Brochure, "Century-The Chairman™ Performance System", 11 pages (undated).
Brochure, "LEVAB International-No Buffers No Rollers No Wicks!", 13 pages (undated).
"Operating Instructions—LEVAB International X-Treme", 52 pages, (1997).
"Operating Instructions—LEVAB International-Lane Liner Advanced Lane Conditioning System", 18 pages (1997/1998).
Brochure, "Kustodian Plus", 2 pages (undated).
"Frameworx Scorer (Touchworx) User's Guide", Part No. 57-900547-000, 39 pages (Feb. 2000).
"Guide—Vector Scorer," Brunswick Customer Service, 12 pages (Apr. 2004).
International Search Report for PCT/US04/28631, 1 page (Dec. 28, 2004).
Written Opinion for PCT/US04/28631, 5 pages (Dec. 28, 2004).

* cited by examiner

Fig. 5
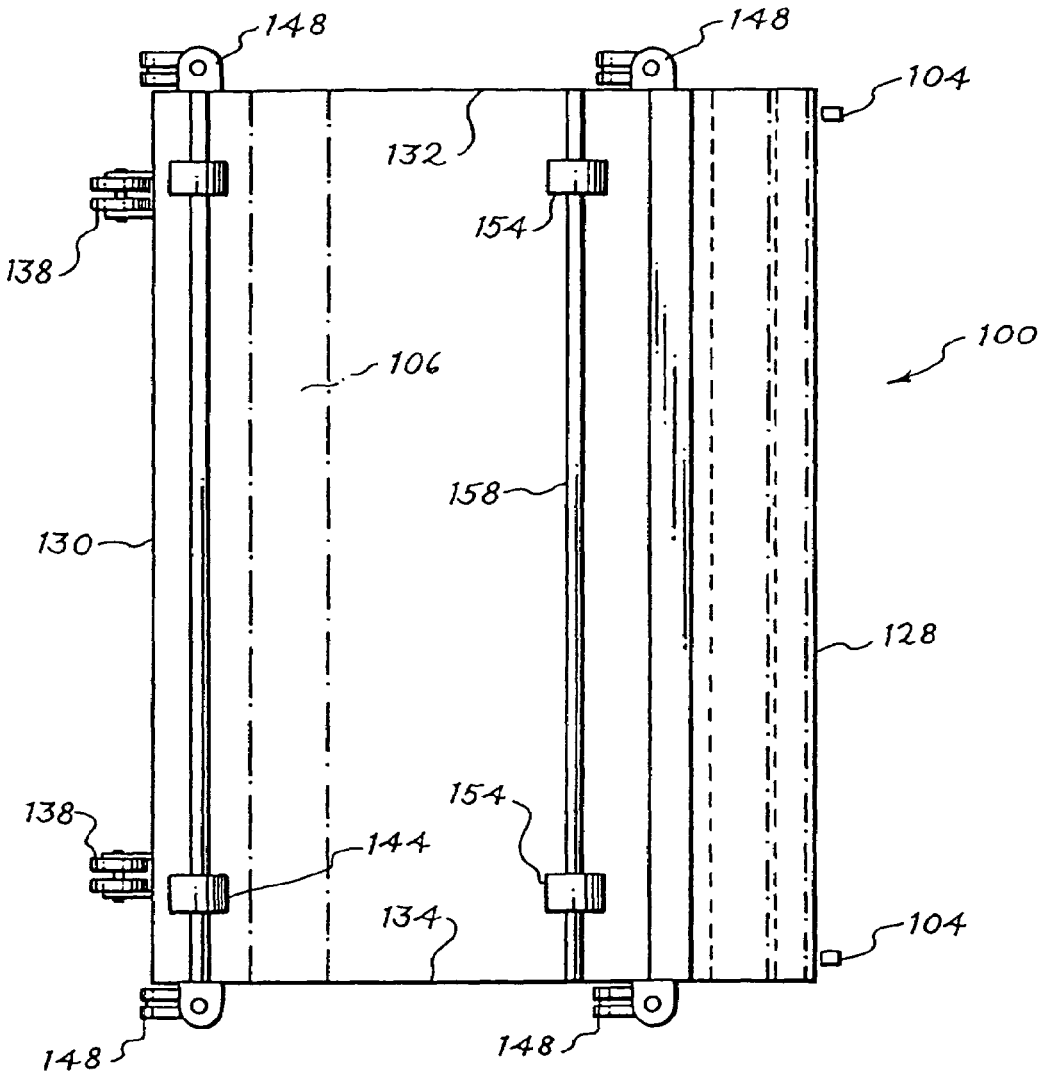
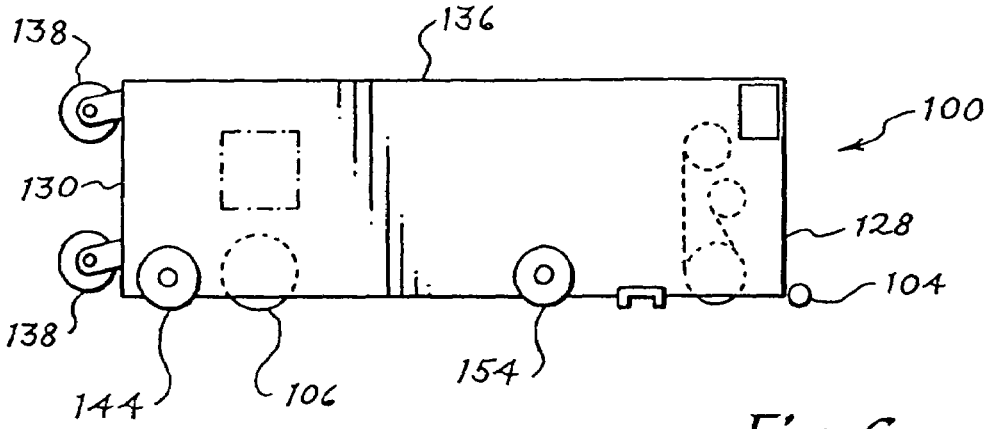
Fig. 6

Fig. 8
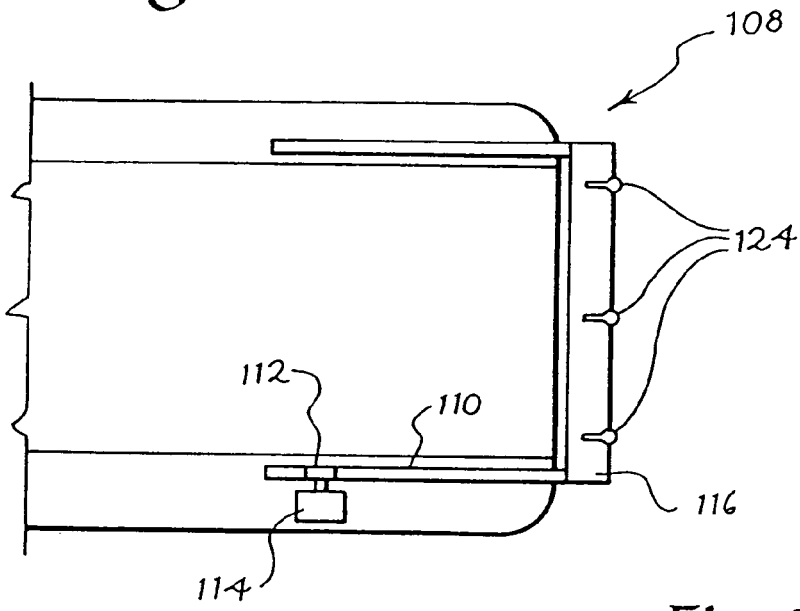
Fig. 9
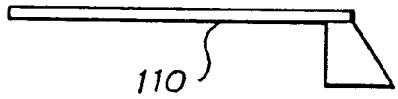
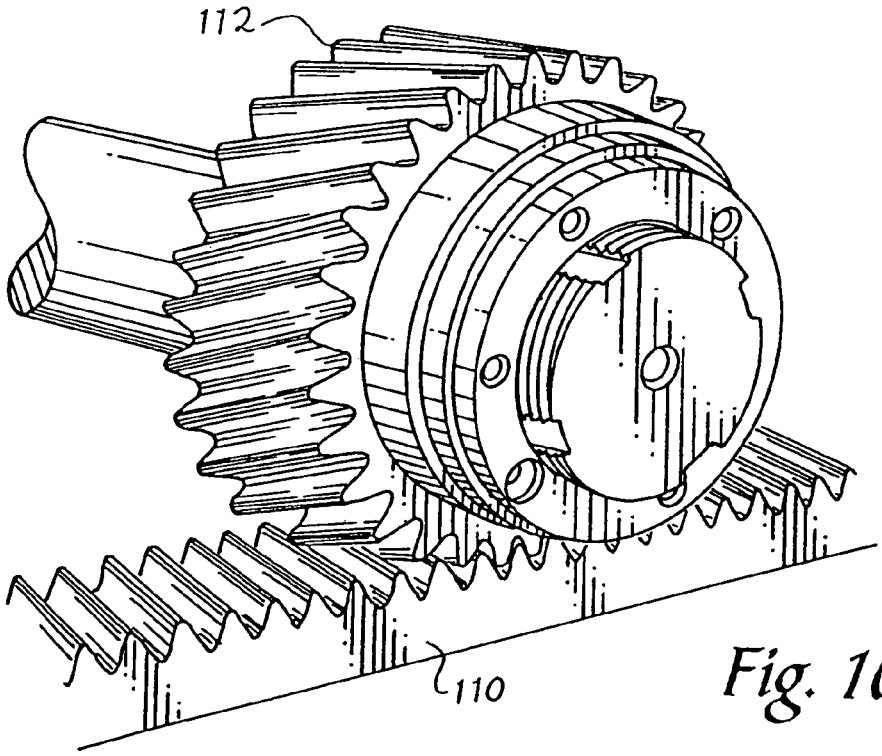
Fig. 10

- RPM = Lane distance
- Engine load = Units of Oil
- Injector calibration for oil vs. gasoline

| | Start | Stop | Loads | Speed | Crossed | Start | End | Feet | T Oil |
|---|---|---|---|---|---|---|---|---|---|
| 1 | 2L | 2R | 4 | 14 | 148 | 0 | 5 | 5 | 5920 |
| 2 | 9L | 9R | 1 | 22 | 23 | 5 | 9 | 4 | 920 |
| 3 | 10L | 10R | 2 | 22 | 42 | 9 | 15 | 6 | 1680 |
| 4 | 11L | 11R | 2 | 22 | 38 | 15 | 21 | 6 | 1520 |
| 5 | 13L | 13R | 1 | 22 | 15 | 21 | 24 | 3 | 600 |
| 6 | 2L | 2R | 0 | 26 | 0 | 24 | 40 | 16 | 0 |
| 7 | | | | | | | | | |
| 8 | | | | | | | | | |
| 9 | | | | | | | | | |
| 10 | | | | | | | | | |
| 11 | | | | | | | | | |
| 12 | | | | | | | | | |
| 13 | | | | | | | | | |
| 14 | | | | | | | | | |
| 15 | | | | | | | | | |

| | Start | Stop | Loads | Speed | Crossed | Start | End | Feet | T Oil |
|---|---|---|---|---|---|---|---|---|---|
| 1 | 2L | 2R | 0 | 30 | 0 | 40 | 30 | -10 | 0 |
| 2 | 13L | 13R | 1 | 22 | 15 | 30 | 26 | -4 | 600 |
| 3 | 12L | 12R | 1 | 22 | 17 | 26 | 23 | -3 | 680 |
| 4 | 11L | 11R | 2 | 22 | 38 | 23 | 17 | -6 | 1520 |
| 5 | 10L | 10R | 2 | 22 | 42 | 17 | 11 | -6 | 1680 |
| 6 | 8L | 8R | 2 | 18 | 50 | 11 | 6 | -5 | 2000 |
| 7 | 2L | 2R | 0 | 14 | 0 | 6 | 0 | -6 | 0 |
| 8 | | | | | | | | | |
| 9 | | | | | | | | | |
| 10 | | | | | | | | | |
| 11 | | | | | | | | | |
| 12 | | | | | | | | | |
| 13 | | | | | | | | | |
| 14 | | | | | | | | | |
| 15 | | | | | | | | | |

BOWLING LANE CONDITIONING MACHINE

CROSS-REFERENCE TO RELATED APPLICATIONS

This application is a continuation-in-part of U.S. patent application Ser. No. 11/328,370, filed Jan. 9, 2006 now U.S. Pat. No. 7,611,853, which is a continuation of U.S. patent application Ser. No. 10/934,005, filed Sep. 2, 2004 (now U.S. Pat. No. 7,014,714), which claims the benefit of U.S. Provisional Application No. 60/500,222, filed Sep. 5, 2003. Each of the above-referenced documents is hereby incorporated by reference.

BACKGROUND OF INVENTION a. Field of Invention

The invention relates generally to the conditioning of bowling lanes, and, more particularly to an apparatus and method for automatically applying a predetermined pattern of dressing fluid along the transverse and longitudinal dimensions of a bowling lane.

b. Description of Related Art

It is well known in the bowling industry to clean and condition a bowling lane to protect the lane and to help create a predetermined lane dressing pattern for a desired ball reaction. Cleaning a bowling lane generally involves the application of a water-based or other cleaner, and the subsequent removal of the cleaner by means of an agitating material and/or vacuuming. While subtle variations may exist in the cleaning methods utilized by the various lane cleaning machines available on the market, the general technique of using an agitating cloth and thereafter vacuuming the applied cleaning fluid off the lane remains central. Methods of conditioning bowling lanes have however evolved over the years from the advent of the wick technology of the 1970's, 80's and early 90's to the metering pump technology of the 1990's and early 2000's.

With regard to wick technology, as illustrated in FIG. 3 of U.S. Pat. No. 4,959,884, the disclosure of which is incorporated herein by reference, wick technology generally involved the use of a wick 162 disposed in reservoir 138 including dressing (i.e. conditioning) fluid 140. During travel of the conditioning machine down the bowling lane, dressing fluid 140 could be transferred from reservoir 138 onto transfer roller 164 via wick 162 and then onto buffer roller 136 for application onto the lane. The wick technology of the 1970's, 80's and early 90's however had exemplary limitations in that once the wick was disengaged from the transfer roller, a residual amount of fluid remaining on the transfer and buffer rollers would be applied onto the bowling lane, thus rendering it difficult to precisely control the amount of dressing fluid application along the length of the bowling lane. Due to the inherent features of a wick which transfers fluid from a reservoir by means of the capillary action, wick technology made it difficult to control the precise amount of fluid transferred onto the lane and therefore the precise thickness and/or layout of the fluid along the transverse and longitudinal dimensions of the lane. Additionally, changes in lane and bowling ball surfaces over the years created the need for higher conditioner volumes, higher viscosity conditioners and more accurate methods of applying conditioner to the lane surface, thus rendering wick technology virtually obsolete for today's lane conditioning needs.

With regard to the metering pump technology of the 1990's and early 2000's, such technology generally involved the use of a transfer roller, buffer and reciprocating and/or fixed nozzle operatively connected to a metering pump for supplying a metered amount of lane dressing fluid to the nozzle. As illustrated in FIGS. 4 and 5 of U.S. Pat. No. 5,729,855, the disclosure of which is incorporated herein by reference, the metering pump technology disclosed therein generally involved the use of a nozzle 170 transversely reciprocable relative to a transfer roller 156. As with wick technology, metering pump technology generally transferred dressing fluid from transfer roller 156 to a buffer 138 and then onto the bowling lane. Alternatively, as illustrated in FIGS. 2 and 4 of U.S. Pat. No. 4,980,815, the disclosure of which is incorporated herein by reference, metering pump technology also involved the use of metering pumps P1-P4 supplying a specified amount of dressing fluid to discharge "pencils" 90, with pencils 90 being transversely reciprocable relative to a reception roller 124 and a transfer roller 130. As with wick technology, metering valve technology had exemplary limitations in that even after flow of fluid had been stopped from being applied to the transfer roller, a residual amount of fluid remaining on the transfer roller, smoothing assembly 20 (as illustrated in U.S. Pat. No. 6,383,290, the disclosure of which is incorporated herein by reference), and the buffer would be applied onto the bowling lane, thus making it difficult to precisely control the amount of dressing fluid along the length of the bowling lane. For a machine employing a laterally traversing nozzle, the finished surface included an inherent zigzag pattern. The aforementioned smoothing assembly 20 for U.S. Pat. No. 6,383,290 has only been partially effective in reducing the measurable variations in fluid thickness caused by the laterally traversing nozzle. Both the wick and metering pump technologies apply excess lane dressing near the front of the bowling lane and depend on the storage capability of the transfer roller and buffer to gradually decrease the amount of oil as the apparatus travels towards the end of the lane. A desired change in the amount of dressing fluid near the end of the lane can only be achieved by guessing the required changes in the forward travel speed or the amount of oil applied to the front of the bowling lane. Because these technologies have less control in how the residual dressing fluid is transferred along the length of the lane, they often apply a second pass of dressing as the apparatus returns toward the front of the lane to achieve the desired conditioning pattern.

In yet another variation of technology, as illustrated in U.S. Pat. No. 6,090,203, the disclosure of which is incorporated herein by reference, metering valve technology provided the option for applying lane dressing fluid directly onto the bowling lane, without the associated transfer and buffer roller assemblies. As with metering pump technology, metering valve technology employs a laterally traversing nozzle that can leave an inherent zigzag pattern of uneven dressing fluid thickness on the finished surface.

In an attempt to overcome some of the aforementioned drawbacks of the wick and metering pump technologies, U.S. Pat. No. 5,679,162, the disclosure of which is incorporated herein by reference, provided a plurality of pulse valves 70 for injecting dressing fluid through outlet slits 77 onto an applicator roller 48 and then onto the bowling lane. Compared to wick and metering pump technology, the apparatus of U.S. Pat. No. 5,679,162 had several additional unexpected drawbacks which required unreasonably high levels of maintenance of outlet slits 77, which tended to become clogged, for example, and adjustment of other associated components for adequate operation.

Accordingly, even with the advancement from wick technology to the metering pump technology in use at most bowling centers today, consumers continue to demand a higher degree of control for the thickness and layout of dressing fluid along the transverse and longitudinal dimensions of a bowling lane. In fact, as guided by the influx of other related user-friendly and custom technology on the market today, there remains a need for a bowling lane conditioning system which provides a consumer with the ability to automatically and more precisely control in real-time the thickness and layout of dressing fluid along the transverse and longitudinal dimensions of a bowling lane. There also remains the need for a bowling lane conditioning system which is robust in design, efficient and predictable in operation, simple to assemble, disassemble and service, and which is economically feasible to manufacture.

SUMMARY INVENTION

The present invention is defined by the following claims, and nothing in this section should be taken as a limitation on those claims.

By way of introduction, the preferred embodiments described below provide a bowling lane conditioning machine. In one preferred embodiment, a bowling lane conditioning machine is presented comprising a cleaning fluid delivery and removal system with a duster cloth supply mechanism. In another preferred embodiment, a bowling lane conditioning machine is presented comprising a cleaning fluid delivery and removal system with a v-shaped squeegee. In yet another preferred embodiment, a bowling lane conditioning machine is presented comprising a drive system with a fixed rear axle. In still another preferred embodiment, a bowling lane conditioning machine is presented comprising a lane dressing fluid application system with an injector rail having a lane dressing fluid heater. In another preferred embodiment, a bowling lane conditioning machine is presented comprising a modular electrical enclosure. Other preferred embodiments are provided, and each of the preferred embodiments described herein can be used alone or in combination with one another.

The preferred embodiments will now be described with reference to the attached drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 5 is another top plan view of the lane conditioning system of FIG. 1 shown with the covers and various components removed for illustrating the layout of various internal components;

FIG. 6 is a partial, side elevation view of the lane conditioning system of FIG. 1 shown with various components removed for illustrating the layout of various internal components;

FIG. 8 is a partial schematic of a top view of the lane conditioning system of FIG. 1, illustrating the layout of a mechanism for telescoping the cleaning fluid delivery nozzles;

FIG. 9 is a partial schematic of a side view of the mechanism of FIG. 8 for telescoping the cleaning fluid delivery nozzles;

FIG. 10 is an exemplary schematic of a rack and pinion actuation system for telescoping the cleaning fluid delivery nozzles;

DETAILED DESCRIPTION OF THE PREFERRED EMBODIMENTS

Figure 1:
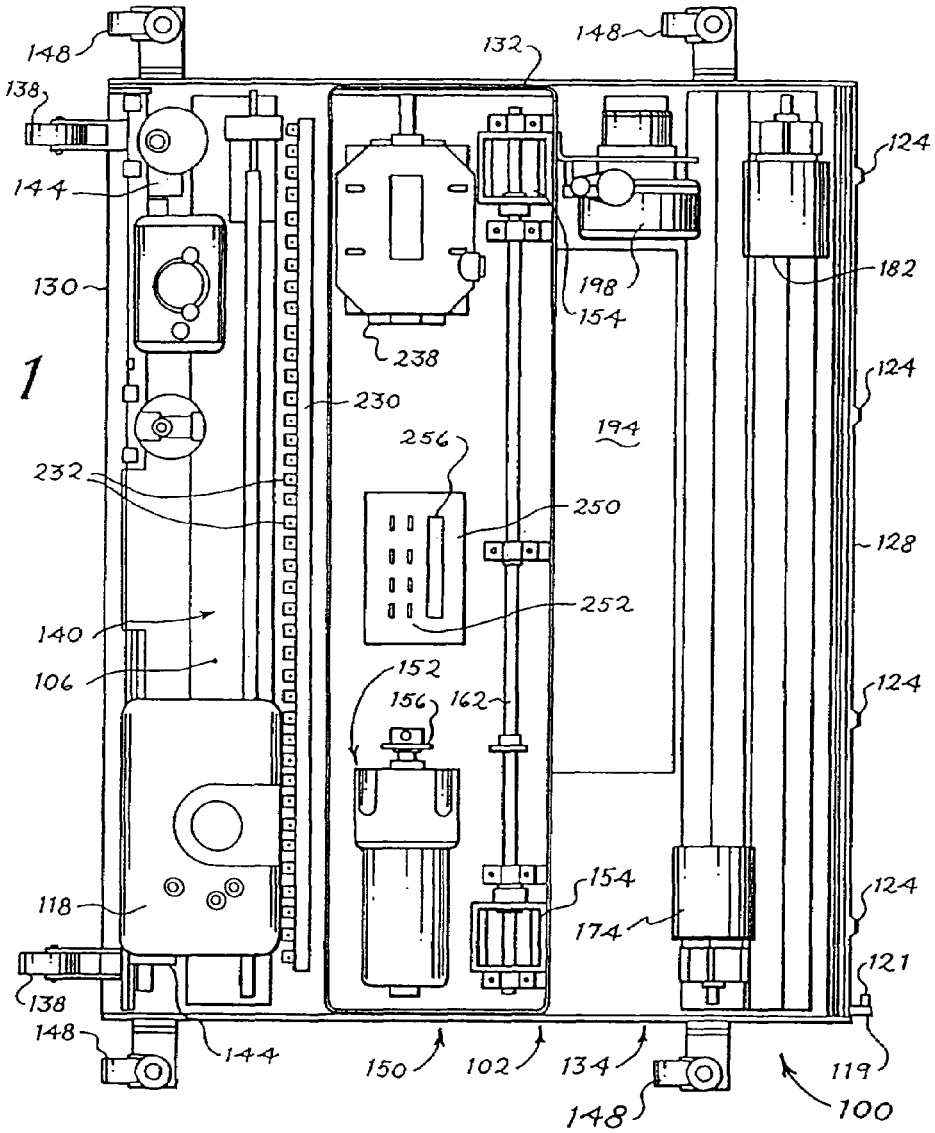
FIG. 1 is a top plan cutout view of a first embodiment of a lane conditioning system according to the present invention.
Figure 2:
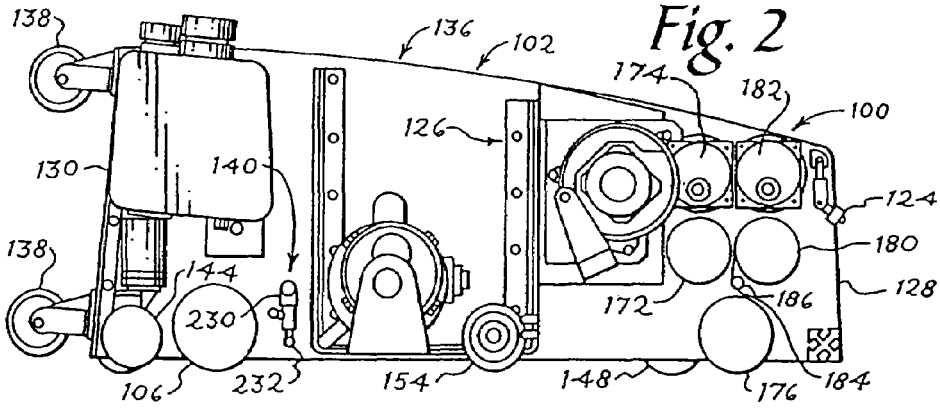
FIG. 2 is a side elevation cutout view of the lane conditioning system of FIG. 1.
Figure 3:
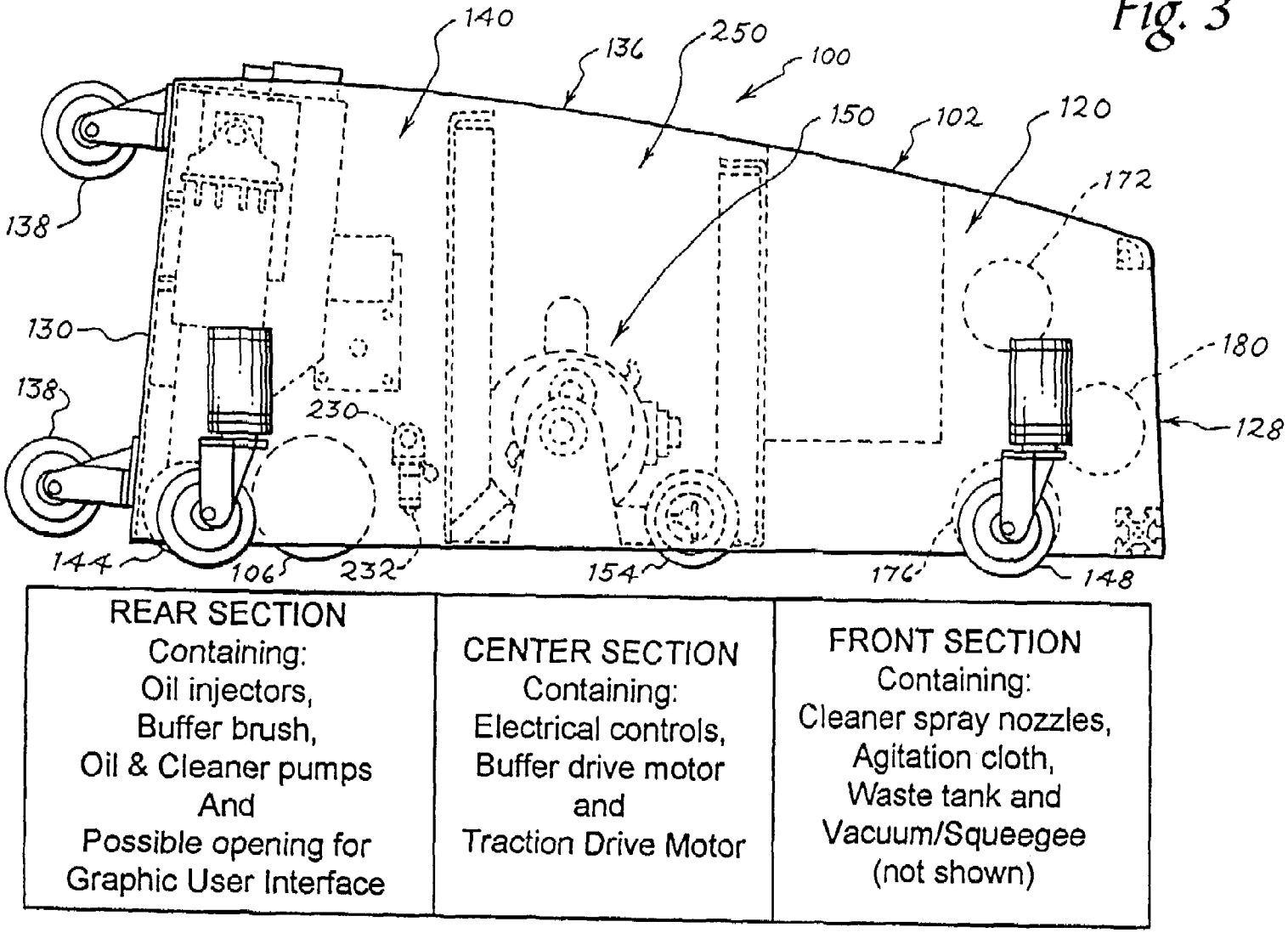
FIG. 3 is a another side elevation cutout view of the lane conditioning system of FIG. 1 shown with various components removed for illustrating the layout of various internal components.
Figure 4:
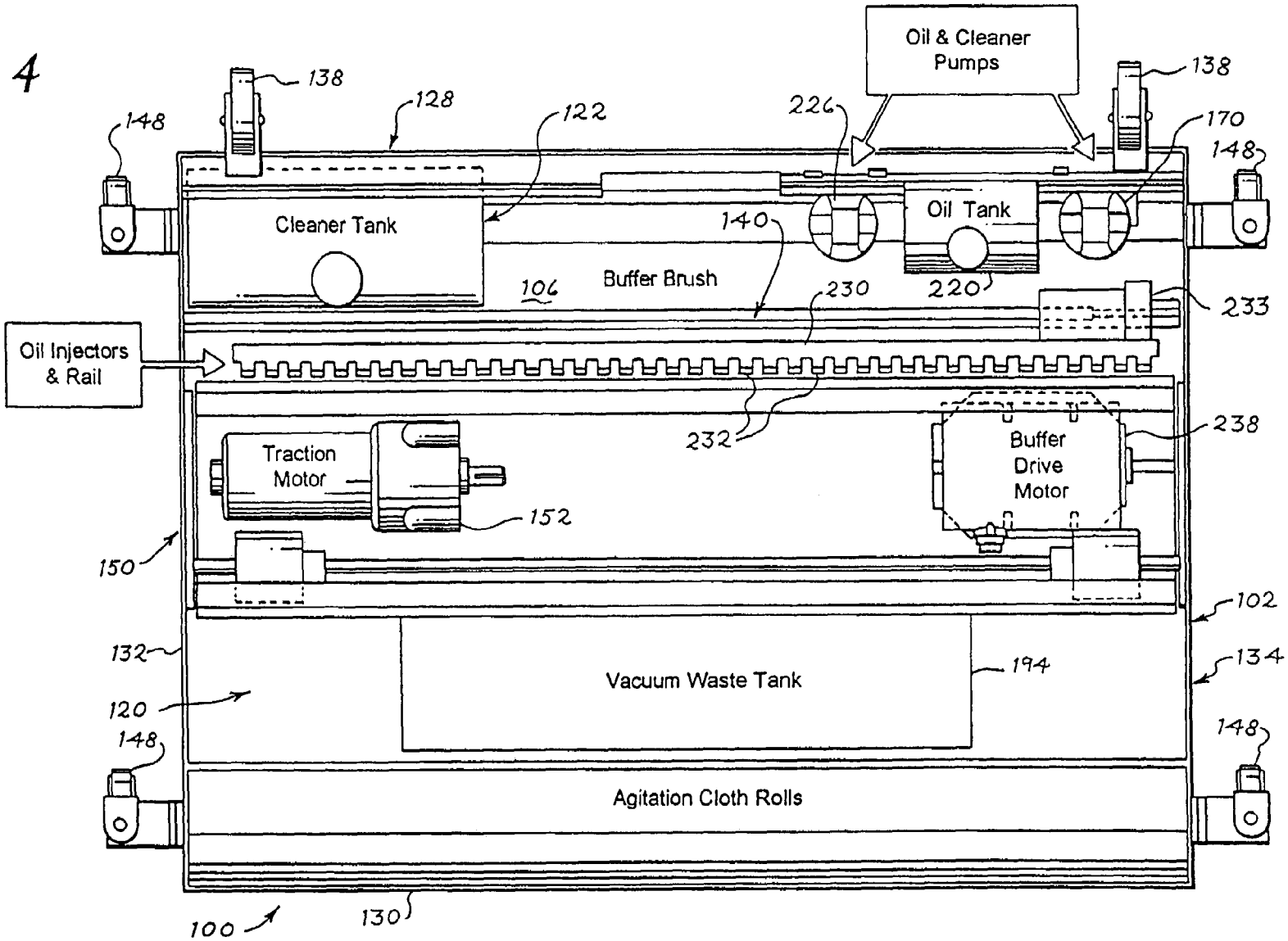
FIG. 4 is a rotated top plan view of the lane conditioning system of FIG. 1 shown with the covers and various components removed for illustrating the layout of various internal components.
Figure 7:
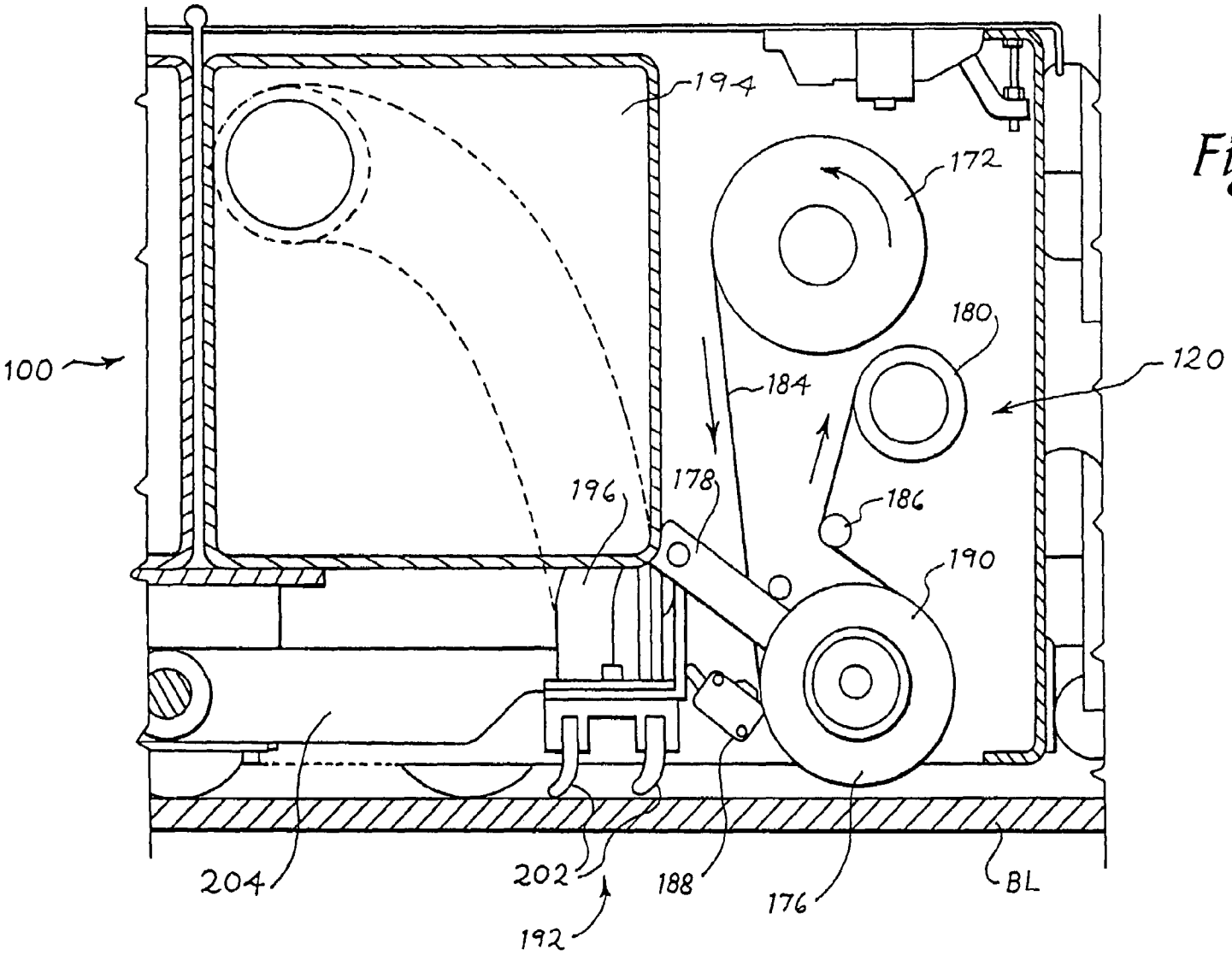
FIG. 7 is a partial, enlarged side elevation view of the lane cleaning system of FIG. 1 shown with various components removed for illustrating the layout of various internal components.
Figure 12:
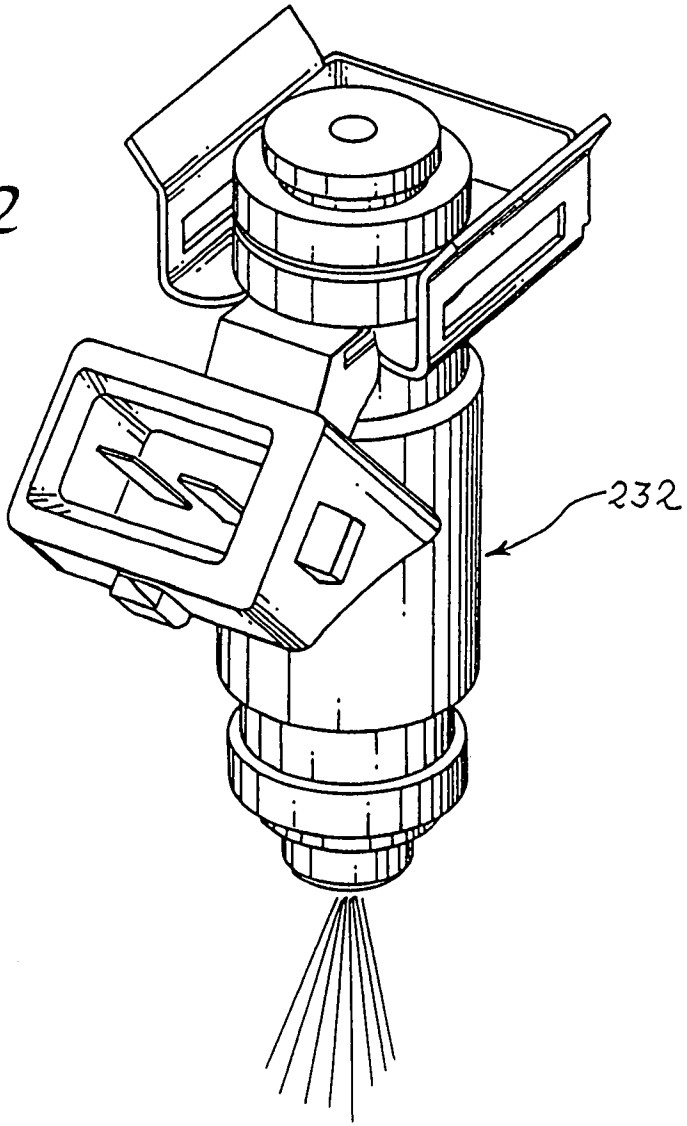
FIG. 12 is another isometric view of the precision delivery injector of FIG. 11 for injecting high viscosity dressing fluid.
Figure 11:
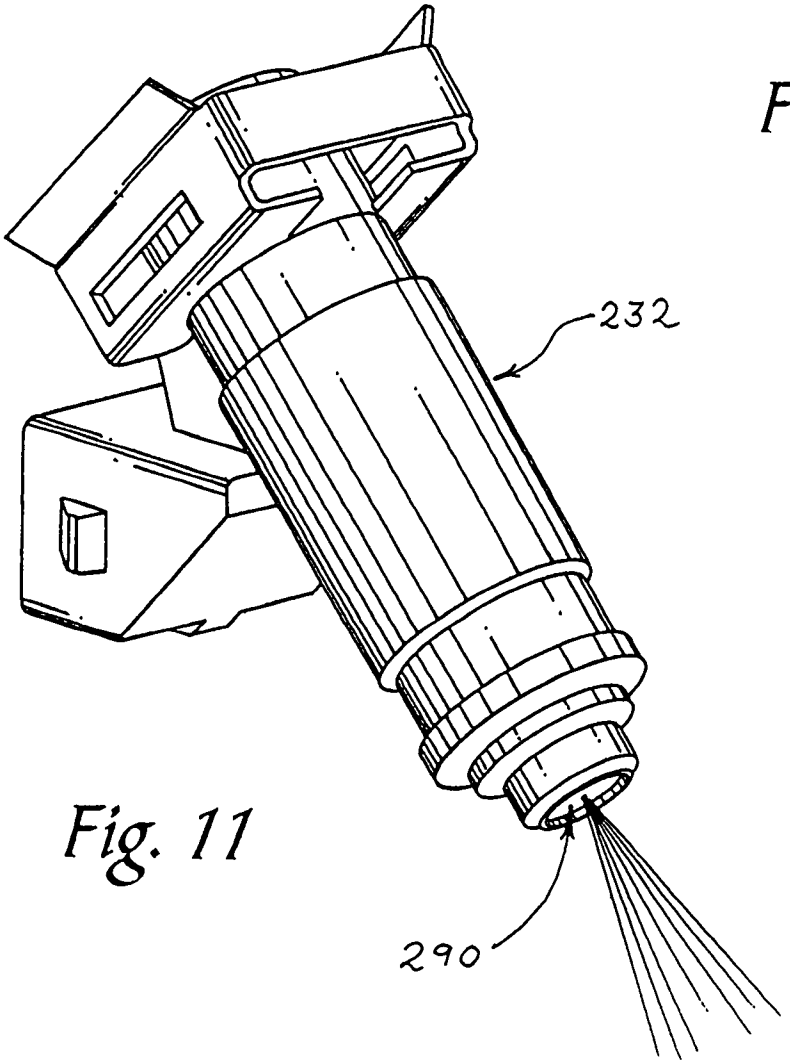
FIG. 11 is an isometric view of a precision delivery injector according to the present invention for injecting high viscosity dressing fluid.
Figure 13:
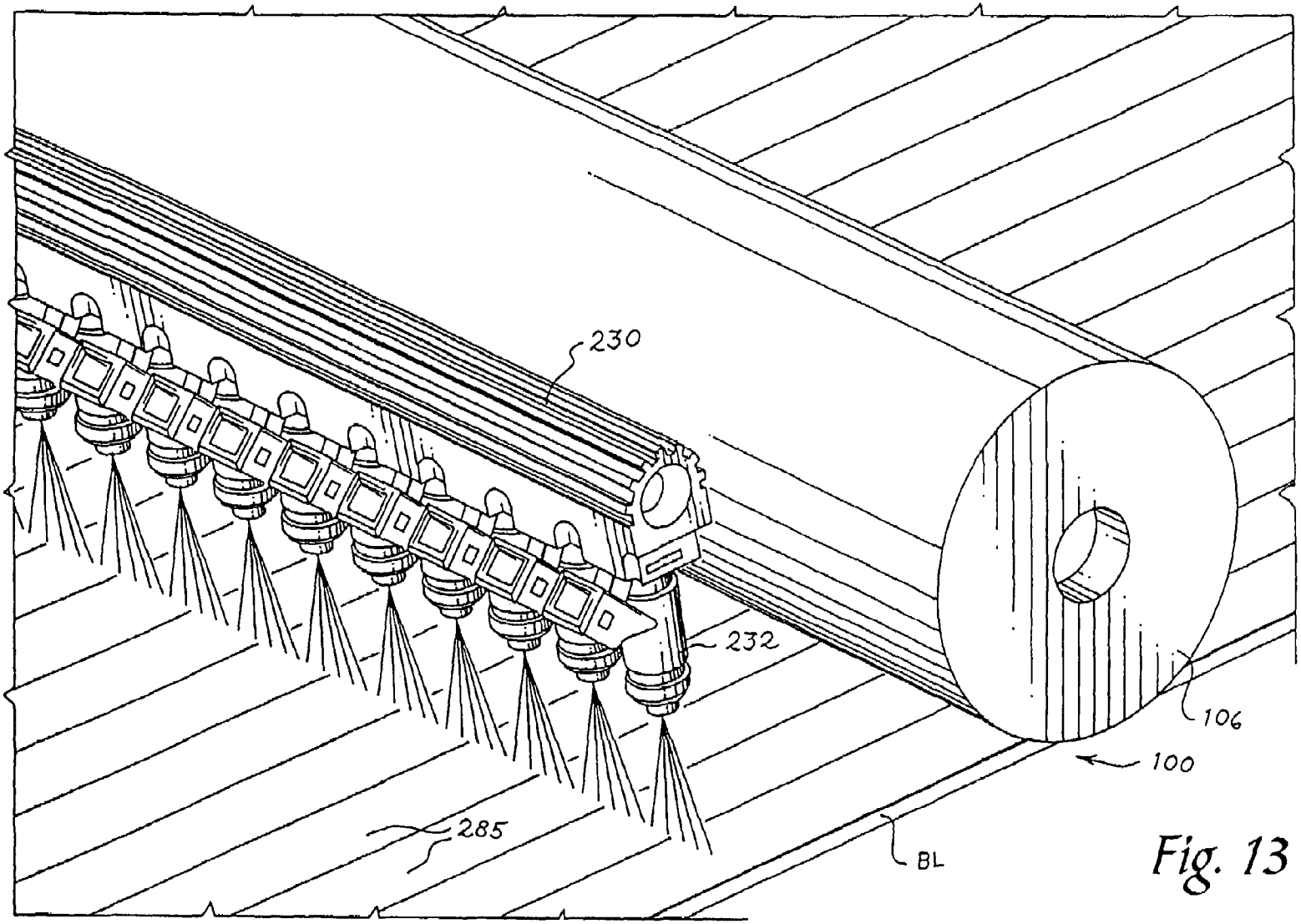
FIG. 13 is an enlarged isometric view illustrative of a plurality of precision delivery injectors operatively connected to an injector rail and a buffer for smoothing dressing fluid applied onto a bowling lane.
Figure 14:
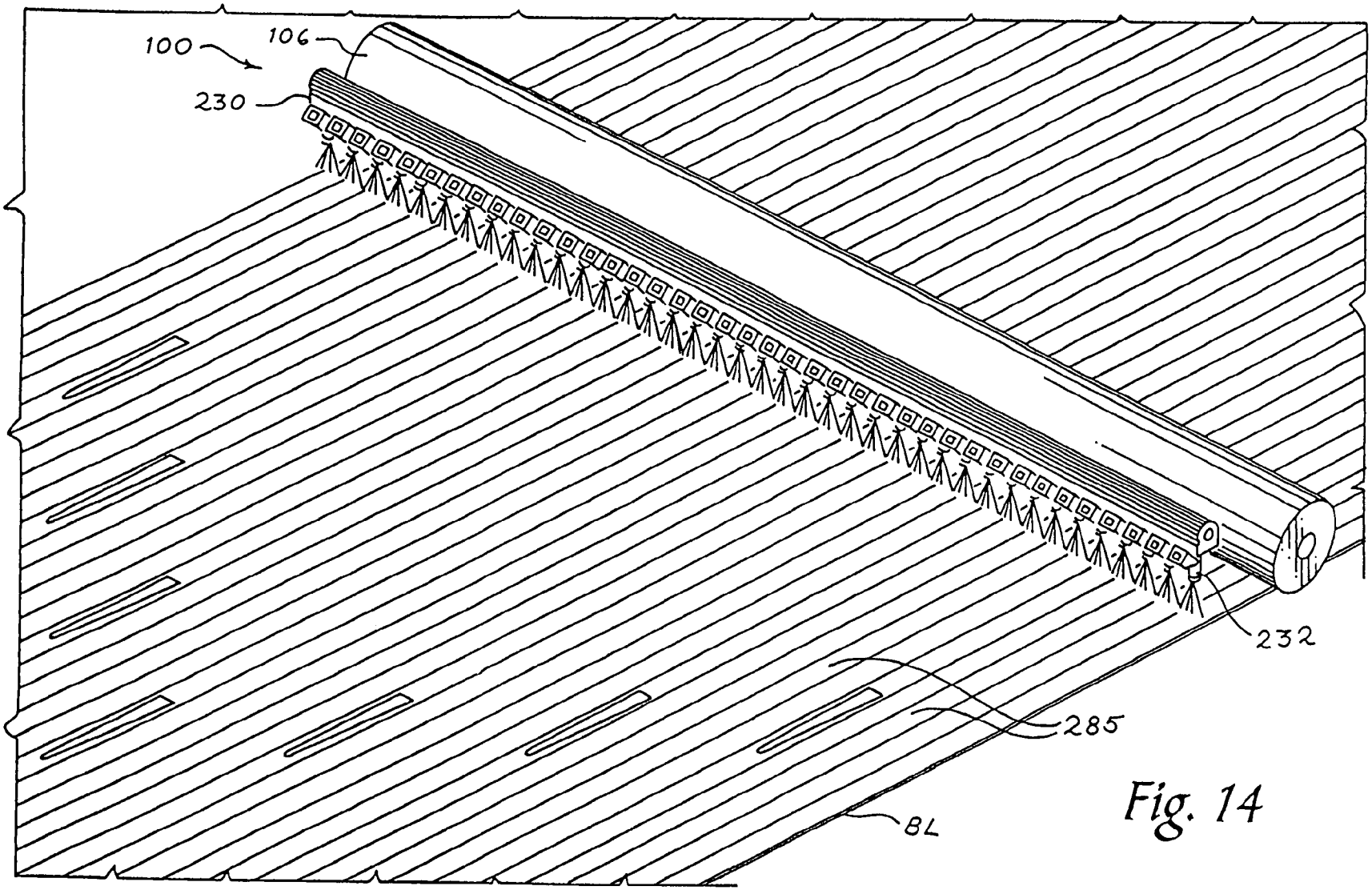
FIG. 14 is an isometric view illustrative of a plurality of precision delivery injectors operatively connected to an injector rail and the buffer for smoothing dressing fluid applied onto a bowling lane.
Figure 15:
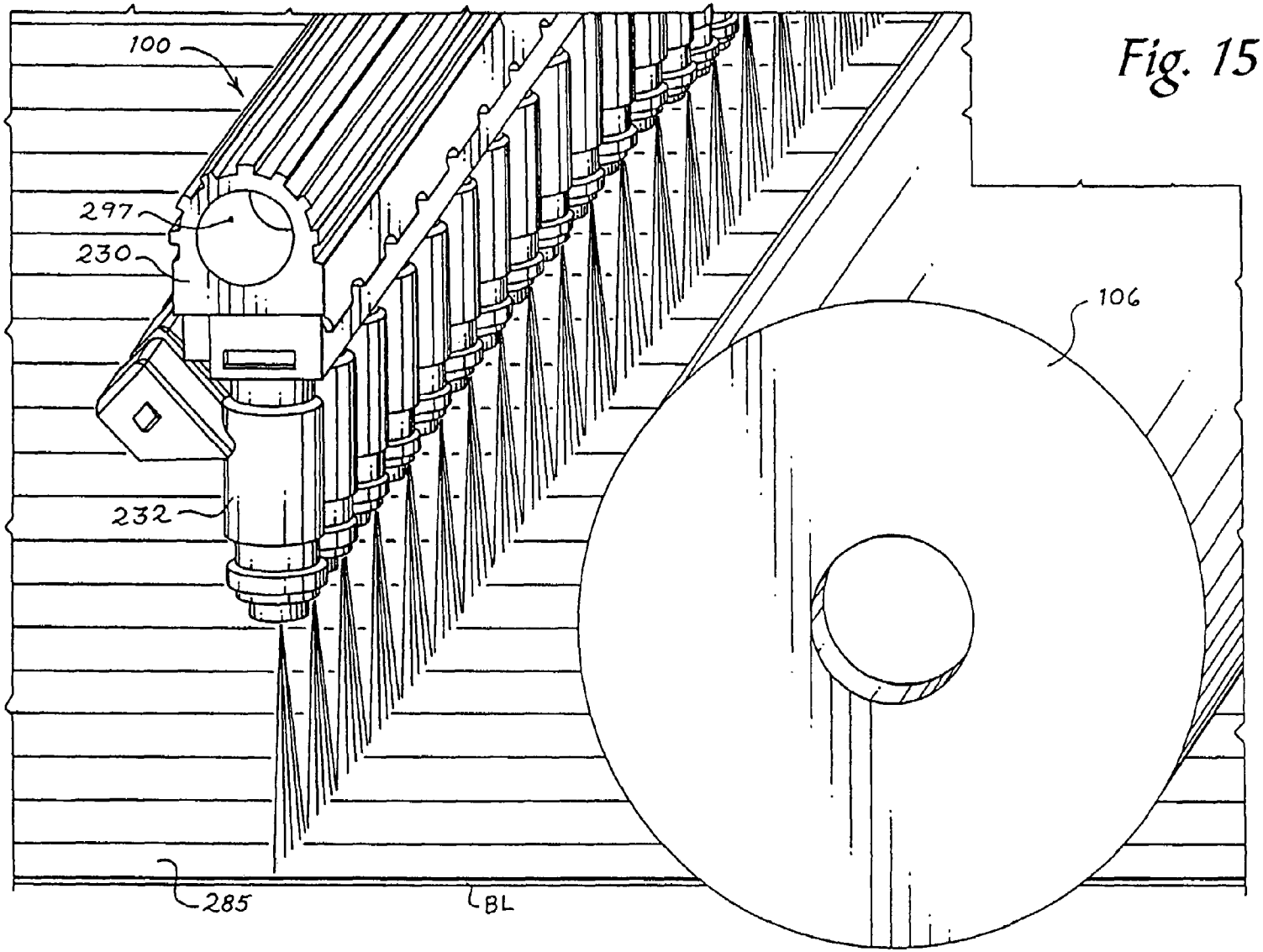
FIG. 15 is another isometric view illustrative of a plurality of precision delivery injectors operatively connected to an injector rail and the buffer for smoothing dressing fluid applied onto a bowling lane.
Figure 16:
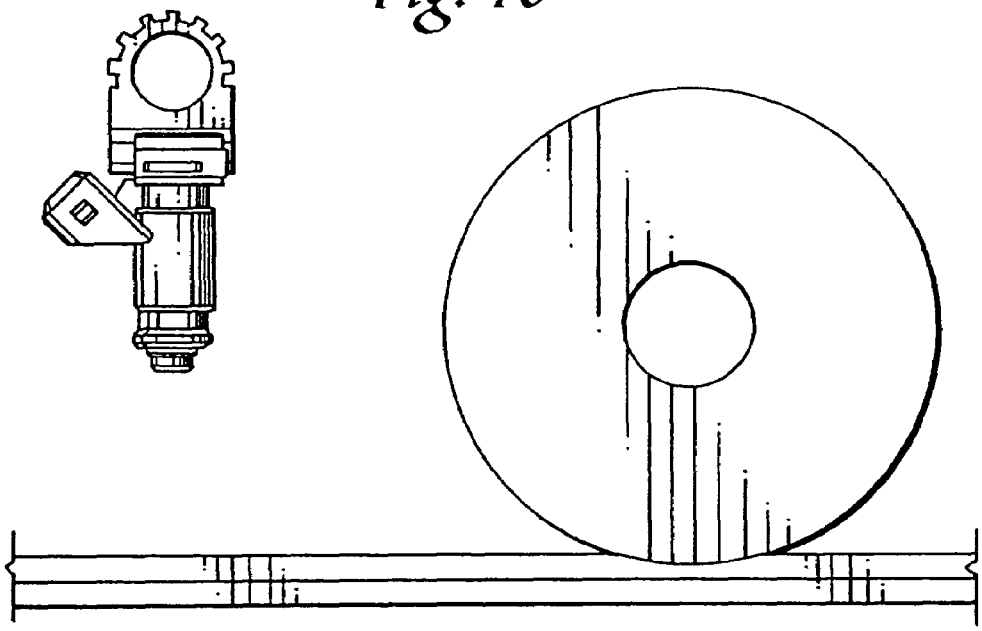
FIG. 16 is a view illustrative of a precision delivery injector operatively connected to an injector rail and the buffer for smoothing dressing fluid applied onto a bowling lane.
Figure 17:
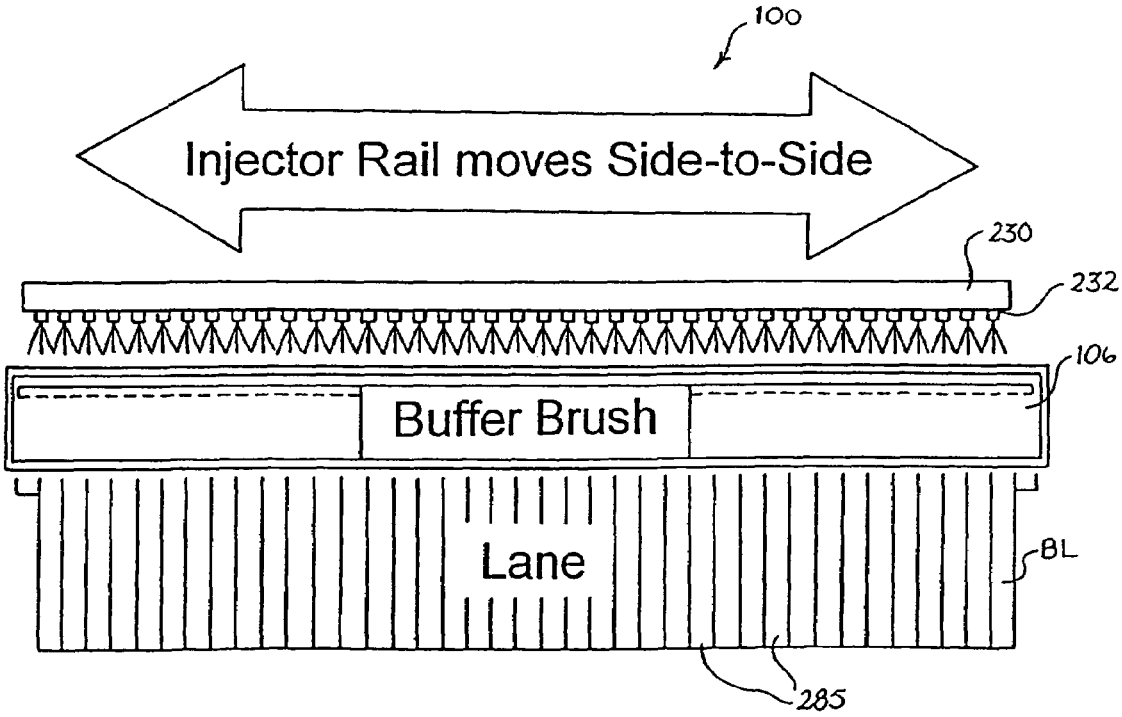
FIG. 17 is a schematic illustrative of a plurality of precision delivery injectors operatively connected to a reciprocating injector rail and the buffer for smoothing dressing fluid applied onto a bowling lane.
Figure 18:
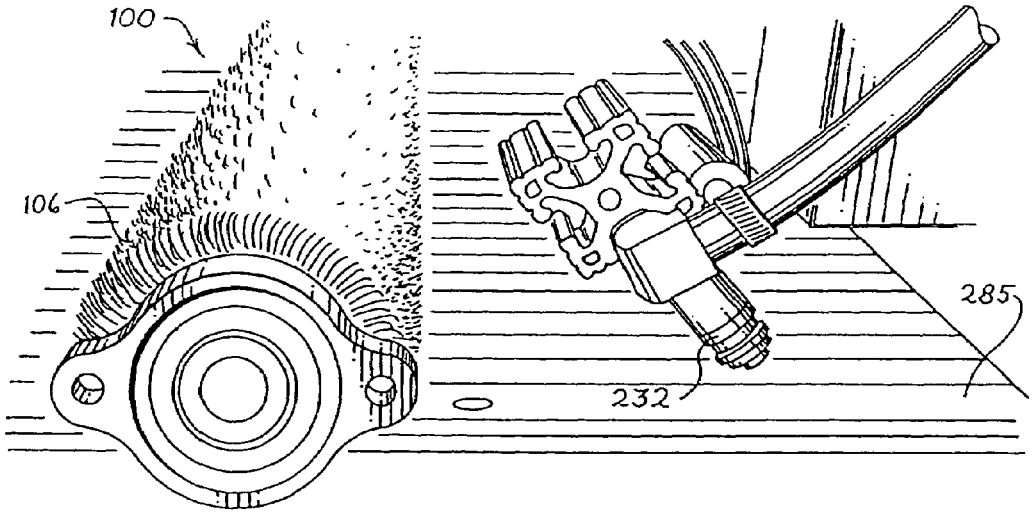
FIG. 18 is a photograph of a plurality of precision delivery injectors operatively connected to an injector rail and the buffer for smoothing dressing fluid applied onto a bowling lane.
Figure 19:
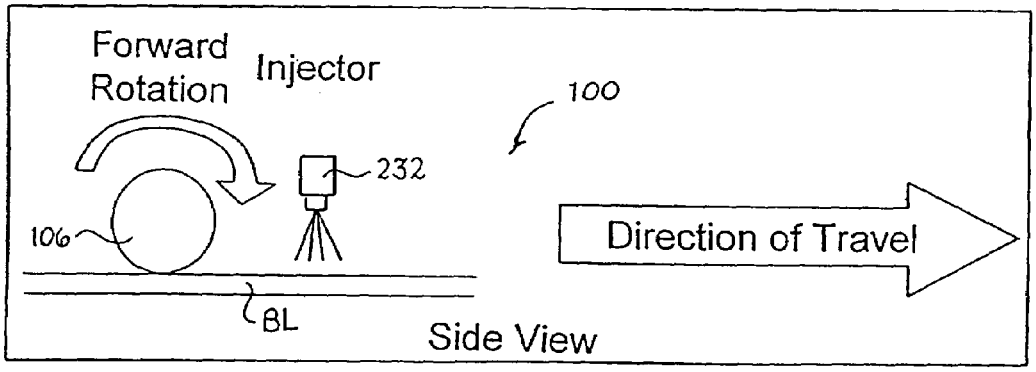
FIG. 19 is a schematic illustrative of a precision delivery injector applying dressing fluid onto a bowling lane and a buffer rotating in direction of travel of the lane conditioning system of FIG. 1 for smoothing dressing fluid applied onto a bowling lane.

Referring now to the drawings wherein like reference numerals designate corresponding parts throughout the several views, FIGS. 1-45 and 64-72 illustrate components of a bowling lane conditioning system, hereinafter designated "lane conditioning system 100", according to the present invention.

Before proceeding further with the detailed description of lane conditioning system 100, a brief history of bowling lane conditioning requirements will be discussed for setting forth the necessary parameters for lane conditioning system 100 according to the present invention.

In the United States, conditions including the amount and type of dressing fluid (i.e. mineral oil, conditioning fluid and the like) and location thereof on a bowling lane are set by the American Bowling Congress (ABC) and Women's International Bowling Congress (WIBC). In Europe and other countries, conditions including the amount and type of dressing fluid and location thereof on a bowling lane are set by similar governing bodies. The amount of dressing fluid on the bowling lane is defined by ABC and WIBC in "units" (0.0167 ml of dressing fluid evenly spread over a 1 sq. ft. surface=1 unit), which equates to a film of dressing fluid about 7 millionths of an inch thick. ABC and WIBC require that a minimum of 3 units of dressing fluid be applied across the entire width of the bowling lane to whatever distance the proprietor decides to condition the lane. The rationale is that ABC and WIBC do not want the edge of the lane to be dry, since a dry edge could steer the ball from entering the gutter and increase scores. While ABC and WIBC maintain the minimum 3-unit rule, they do not however regulate the maximum amount of dressing fluid on a bowling lane. Thus, a lane conditioning machine must be designed to accurately control a dressing fluid pattern from the minimum 3-unit ABC/WIBC requirement to the thickness desired by a proprietor for providing optimal ball reaction.

The first embodiment of lane conditioning system 100, which meets the aforementioned ABC and WIBC conditioning requirements, as well as conditioning requirements set forth in Europe and other countries, will now be described in detail.

Referring to FIGS. 1-45 and 64-72 generally, and specifically to FIGS. 1-7, the first embodiment of lane conditioning system 100 broadly includes housing 102 including a cleaning fluid delivery and removal system 120, hereinafter designated "cleaning system 120", dressing fluid delivery and application system 140, hereinafter designated "dressing application system 140", drive system 150 and control system 250. Cleaning system 120 may broadly include cleaning fluid reservoir 122, telescoping cleaning fluid delivery nozzles 124 and vacuum system 126 for removal of cleaning fluid applied onto a bowling lane BL. Dressing application system 140 may broadly include precision delivery injectors 232 for injecting high viscosity lane dressing fluid directly onto bowling lane BL or on a transfer mechanism, and buffer 106 for smoothing and/or applying the dressing fluid on bowling lane BL. Drive system 150 may broadly include a variable speed drive motor 152 for propelling lane conditioning system 100 in forward and reverse directions on bowling lane BL. Lastly, control system 250 may broadly include user interface 252 for facilitating selection of a cleaning and/or conditioning routine from a host of predetermined options or for otherwise programming control system 250 for a custom cleaning and/or conditioning application.

Each of the aforementioned cleaning, dressing, drive and control systems will now be described in detail.

Referring to FIGS. 1-7, housing 102 may respectively include front and rear walls 128, 130, left and right side walls 132, 134 and top cover 136 for enclosing cleaning system 120 and dressing application system 140. Top cover 136 may be hingedly connected to housing 102 for permitting access to the internal components of lane conditioning system 100. Rear wall 130 may include support casters 138 mounted adjacent the corners thereof for supporting lane conditioning system 100 in the storage position. Transfer wheels 104 may be provided on front wall 128 to prevent the front wall from contacting the front of the bowling lane when lane conditioning system 100 is pulled onto the approach by a handle (not shown), pivoted onto transition wheels 148. Rear wall 130 may include support wheels 144 for supporting lane conditioning system 100 during operation on bowling lane BL. Left and right side walls 132, 134 may include guide wheels (not shown) operatively engageable with the inner walls of bowling lane gutters for facilitating the centering of lane conditioning system 100 during travel thereof along bowling lane BL. Left and right side walls 132, 134 may each include spaced transition wheels 148 for elevating lane conditioning system 100 on the approach and facilitating movement thereof between lanes while in the operating position. Transition wheels 148 may be provided on lane conditioning system 100 such that during travel of lane conditioning system 100 along bowling lane BL, transition wheels 148 freely hang in the gutters of the bowling lane.

As shown in FIGS. 1-7, cleaning system 120 may include cleaning fluid reservoir 122. In the exemplary embodiment of FIGS. 1-7, cleaning fluid reservoir 122 may have a storage capacity of 2.0 gallons of cleaning fluid, thus allowing for continuous cleaning of over forty (40) bowling lanes using 5 fluid oz. of cleaning fluid per lane. Cleaning system 120 may further include telescoping cleaning fluid delivery nozzles 124. In the exemplary embodiment of FIGS. 1-7, nozzles 124 may be configured to telescope forward up to 12" or backward from front wall 128 for applying cleaning fluid in front of lane conditioning system 100, as required by an operator. Nozzles 124 may be configured to telescope for allowing an increased resonance time for cleaning fluid on bowling lane BL, thus further facilitating the cleaning action prior to conditioning of the lane. In the exemplary embodiment of FIGS. 1-7, nozzles 124 may be telescoped by means of a linear actuation system 108, as shown in FIGS. 8-10 and including a rack 110 and pinion 112 operatively connected to telescoping motor 114 for physically moving a generally U-shaped nozzle rail 116 including nozzles 124 affixed therein ahead of lane conditioning system 100. Additionally, in the exemplary embodiment of FIGS. 1-7, four (4) cleaning fluid delivery nozzles 124 may be provided. It should be noted that instead of the rack and pinion assembly for linear actuation system 108, a ball screw, belt driven actuator or other such means may be provided for telescoping nozzles 124.

Referring to FIGS. 1-7, cleaning system 120 may further include a heater (not shown) disposed in cleaning fluid reservoir 122 (or elsewhere in the cleaning fluid circuit) and cleaning fluid pump 170 for supplying preheated cleaning fluid to nozzles 124, thereby spraying preheated cleaning fluid onto the surface of bowling lane BL forward of front wall 128 during the conditioning pass (i.e. pass from foul line to pin deck) of lane conditioning system 100. Cleaning system 120 may further include a duster cloth supply roll 172 and duster cloth unwind motor 174 operatively connected to roll 172 for discharging duster cloth 184 during the conditioning pass of lane conditioning system 100. In the exemplary embodiment of FIGS. 1-7, duster cloth unwind motor 174 may be a 115 VAC/0.5 A-7 rpm motor. A duster roller 176 may be pivotally mounted below duster cloth supply roll 172 by pivot arms 178 for contacting bowling lane BL when pivoted downward during the conditioning pass and otherwise being pivoted out of contact from the bowling lane or other surfaces. Duster cloth 184 placed on duster cloth supply roll 172 and looped around duster roller 176 may provide mechanical scrubbing action of cleaning fluid prior to extraction by vacuum system 126. A waste roller 180 may be provided above duster roller 176 and operable by a waste roller windup motor 182 to lift duster roller 176 away from a bowling lane surface and simultaneously roll used duster cloth for facilitating subsequent removal and discarding thereof. In the exemplary embodiment of FIGS. 1-7, waste roller windup motor 182 may be a 115 VAC/0.5 A-7 rpm motor, and duster cloth 184 placed on duster cloth supply roll 172 may extend around duster roller 176 and guide shaft 186 to be wound around waste roller 180. In operation, by activating duster cloth unwind motor 174, duster cloth supply roll 172 rotates to produce a slack in duster cloth 184 to allow duster roller 176 to pivot under its own weight into contact with bowling lane BL. The downward travel of duster roller 176 may be detected by a duster down switch 188 or by other means known in the art. After completion of the conditioning pass, waste roller windup motor 182 may be operated to rotate waste roller 180 for removing any slack in duster cloth 184 and for pivoting duster roller 176 upwards out of contact from bowling lane BL. The upward travel of duster roller 176 may be detected in a similar manner as the downward travel by a duster up switch 190 or by other means known in the art.

Cleaning system 120 may further include a squeegee system 192, removable waste reservoir 194 for storing fluid suctioned by vacuum system 126, and a vacuum hose 196 fluidly connecting squeegee system 192 to waste reservoir 194 and vacuum hose 196 fluidly connecting waste reservoir 194 to vacuum pump 198. A pair of transversely disposed resilient squeegees 202 may be pivotally mounted by pivot arms 204 and operated by first and second linkages (not shown) which move squeegees 202 into contact with a bowling lane surface by means of a squeegee up/down motor (not shown). In the exemplary embodiment of FIGS. 1-7, the squeegee up/down motor may be a 115 VAC/0.75 A or a DC equivalent motor. Squeegees 202 may be dimensioned to extend generally across the width of a conventional bowling lane. For lane conditioning system 100, the first linkage may be operatively coupled with pivot arms 204 and the second linkage may operatively couple the squeegee up/down motor with the first linkage. An end of the second linkage may be operatively coupled with the squeegee up/down motor in an offset cam arrangement such that rotation of the motor lifts the first linkage so as to pivot squeegees 202 into contact with a bowling lane surface and operate squeegee down switch (not shown), and such that continued rotation of the motor in the same direction moves the first linkage downwardly to retract squeegees 202 from the lane surface and operate the squeegee up switch. For lane conditioning system 100, cleaning system 120 may optionally include a dryer (not shown) having an opening behind squeegees 202 for drying any remaining moisture not removed by vacuum system 126 before application of lane dressing fluid.

Referring to FIGS. 1-7, drive system 150 may include drive motor 152 operatively connected to drive wheels 154 for facilitating the automatic travel of lane conditioning system 100 during the conditioning pass (i.e. pass from foul line to pin deck) and the return pass (i.e. pass from pin deck back to foul line) thereof. Drive motor 152 may be operable at a plurality of speeds in forward and reverse directions for thereby propelling lane conditioning system 100 at variable speeds along the length of bowling lane BL, and may include a drive sprocket 156 mounted on motor shaft 158. The distance of lane conditioning system 100 may be accurately sensed by using a Hall Effect encoder 118 affixed to one of the non-driven support wheels 144. In the exemplary embodiment of FIGS. 1-7, drive motor 152 may be a ¼ HP gear motor (90 VDC/2 A) for propelling lane conditioning system 100 at up to 60 inch/sec. For the present invention, for the conditioning pass, lane conditioning system 100 may be preferably propelled forward at 12-36 inch/sec and propelled backwards for the return pass at 15-60 inch/sec. Moreover, for the present invention, lane conditioning system 100 may be propelled forward at a generally constant velocity during the conditioning pass and propelled backwards at a faster velocity to reduce the overall time required for cleaning and/or conditioning a bowling lane. An end-of-lane sensor 119 including a contact wheel 121 may be affixed adjacent front wall 128 of lane conditioning system 100 for preventing further travel of system 100 when wheel 121 rolls off the edge of the pin deck of bowling lane BL. Sensor 119 may be operatively connected to control system 250 (discussed below) to allow system 250 to learn the distance to the end of a lane based upon the number of turns of wheel 121 and/or the number of turns of another wheel of lane conditioning system 100. A drive chain (not shown) may be operatively connected with drive sprocket 156 to drive shaft 162 having drive wheels 154 mounted thereon. A speed tachometer (not shown) may be operatively coupled with an end of drive shaft 162 for sensing and relaying the speed of drive shaft 162.

Turning next to FIGS. 1-7 and 67, as briefly discussed above, lane conditioning system 100 may include dressing application system 140 disposed therein and including buffer 106 and precision delivery injectors 232. Dressing application system 140 may further include dressing fluid tank 220, dressing fluid heater 222, dressing fluid filter 224, dressing fluid pump 226, dressing fluid pressure sensor/regulator 228, dressing fluid flow valve(s) (not shown), dressing fluid pressure accumulator (not shown), and injector rail 230 including precision delivery injectors 232 operatively mounted therein.

Buffer 106 may include a driven sheave (not shown) operatively connected to drive sheave (not shown) of buffer drive motor 238 by a belt (not shown). Buffer drive motor 238 may be configured to drive buffer 106 at a steady or at variable speeds and in a clockwise or counter-clockwise direction depending on the travel speed and direction of lane conditioning system 100 during the conditioning and/or return passes thereof. A linkage (not shown) may be provided for pivoting buffer 106 into contact with bowling lane BL during the conditioning pass when energized by buffer up/down motor (not shown) and otherwise pivoting buffer 106 out of contact from bowling lane BL or other surfaces. Buffer up and down switches (not shown), or other means may be provided for limiting and/or signaling the maximum up and down travel positions of buffer 106. Buffer up and down switches may be similar in operation to the squeegee up and down switches. In the exemplary embodiment of FIGS. 1-7, the buffer up/down motor may be a 115 VAC/0.75 A or DC equivalent motor, and buffer drive motor 238 may be a 115 VAC/6.2 A motor.

Dressing fluid tank 220 may be pressurized or non-pressurized and include dressing fluid pump 226 mounted internally or externally for supplying dressing fluid to injector rail 230, and in the exemplary embodiment of FIGS. 1-7, may include a storage capacity of two (2) or more liters of dressing fluid for conditioning up to eighty (80) bowling lanes. In the embodiment of FIGS. 1-7, dressing fluid tank 220 may be non-pressurized (vented to the atmospheric pressure) and include dressing fluid pump 226 mounted externally. Dressing fluid pump 226 may be configured to provide, for example, up to 500 kPA of pressure for dressing fluid having a viscosity of up to 65 centipoises. Dressing fluid heater 222 may be mounted internally within dressing fluid tank 220 (or elsewhere in the cleaning fluid circuit) to heat the dressing fluid therein to a predetermined temperature, and dressing fluid filter 224 may be operatively disposed between dressing fluid tank 220 and dressing fluid pump 226 to filter any contaminants in the dressing fluid. In the exemplary embodiment of FIGS. 1-7 and 67, dressing fluid heater 222 may be a 25-75 W AC or DC heater, and the dressing fluid may be oil having a viscosity in the range of 10-65 centipoises. Additionally, the dressing fluid may be heated to a temperature within the range of 80-100° F., for example, in order to maintain the viscosity of the dressing fluid within a predetermined range. Those skilled in the art will appreciate in view of this disclosure that the aforementioned temperature ranges may be varied as needed depending on the viscosity and other fluid parameters of the specific dressing fluid used. Dressing fluid pump 226 may circulate the dressing fluid through the entire dressing application system 140 in an open (non-pressurized) loop, while dressing fluid heater 222 is slowly bringing everything up to the desired temperature. This open loop circuit eliminates any unsafe fluid temperatures near dressing fluid heater 222 and also purges any trapped air from the system. Dressing fluid pump 226 may only operate occasionally after the system reaches the desired temperature. The dressing fluid pressure accumulator may be located at the end of injector rail 230 near dressing fluid pressure sensor/regulator 228, followed by the dressing fluid flow valve just before the fluid returns to dressing fluid tank 220. The dressing fluid flow valve may close before start of conditioning the first lane, at which time dressing fluid pump 226 may turn on and charge the dressing fluid pressure accumulator until the desired pressure is achieved. The dressing fluid flow valve(s) may then close to hold the pressure during conditioning of the particular lane. Dressing fluid pressure sensor/regulator 228 may contain a check/relief valve to protect the system from excess pressure. When conditioning is completed on the first lane, the dressing fluid flow valve(s) may open to circulate an amount of dressing fluid before closing to reach a specified pressure for the next lane. Dressing fluid pressure sensor/regulator 228 may be operatively disposed between injector rail 230 and dressing fluid tank 220 to maintain the pressure of dressing fluid within dressing application system 140 at a predetermined pressure(s) and to allow for optimal injection of dressing fluid through precision delivery injectors 232. In the exemplary embodiment of FIGS. 1-7, dressing fluid pressure sensor/regulator 228 may maintain the pressure of the dressing fluid within the range of 160-240 kpa, and preferably at 200 kpa.

As illustrated in FIGS. 1, 11, 13 and 41-45, a predetermined number of precision delivery injectors 232 may be operatively connected into openings 295 in injector rail 230. Precision delivery injectors 232 may be similar to fuel injectors utilized in an automobile, but are instead configured to supply the relatively high viscosity dressing fluid in a predetermined injection pattern and volume to control the amount or thickness of dressing fluid on the bowling lane. It should be noted that the reference to the "high viscosity dressing fluid" is made in the present application to distinguish over standard automotive fuels. In the bowling industry however, dressing fluid within the range of 10-65 centipoises may be referred to as having a low and high viscosity, respectively, and may be readily used with lane conditioning system 100 of the present invention.

Specifically, as shown in FIGS. 11 and 26-31, each precision delivery injector 232 may include an upstream end 260, a downstream end 262 which is distal from upstream end 260, and a longitudinal axis 264 which extends between upstream and downstream ends 260, 262, respectively. As used herein, the term "upstream" refers to the area toward the top of precision delivery injectors 232, while "downstream" refers to the area toward the bottom of precision delivery injectors 232. Precision delivery injectors 232 further include member 266, which extends generally from upstream end 260 to downstream end 262. Member 266 may generally include a valve body, a non-magnetic shell and an overmold, which for the purposes of this disclosure, are collectively recited as member 266. Precision delivery injectors 232 may further include a seat 268 located proximate to downstream end 262, and a guide 270 disposed immediately upstream of seat 268. Seat 268 may include an opening 272 disposed along longitudinal axis 264 for permitting dressing fluid to pass therethrough. A needle 274 operably affixed at a lower end of stator 276 may be disposed within precision delivery injector 232 to move upward away from seat 268 when an electric field is generated by coils 278. Specifically, when the required voltage is applied to coils 278, needle 274 separates from seat 268 to virtually instantaneously inject high viscosity dressing fluid through the discharge openings in orifice plate 280 for the duration of the opening period, and otherwise restrict the flow of dressing fluid through orifice plate 280 in its closed rest position.

Since the injection characteristics of high viscosity dressing fluid differ significantly from those of the relatively low viscosity fuel injected by typical fuel injectors, as a result of extensive research, analysis and experimentation by the inventors of the lane conditioning system disclosed herein, precision delivery injectors 232 for injecting high viscosity dressing fluid may include the orifice plate configurations discussed herein in reference to FIGS. 32-40. Specifically, as illustrated in a first embodiment shown in FIGS. 32-34, precision delivery injectors 232 may include an orifice plate 282 including an elongated slot 284 disposed in a generally conical surface 286 for injecting a mist of high viscosity dressing fluid across the 1 1/16" width of a bowling lane board 285. Alternatively, in a second embodiment shown in FIGS. 35-37, precision delivery injectors 232 may each include an orifice plate 288 including elongated discharge openings 290 disposed in a generally conical surface 292 for injecting a plurality of jets of dressing fluid across the 1 1/16" width of a bowling lane board 285. In yet a third further alternative embodiment shown in FIGS. 38, 39A and 39B, precision delivery injectors 232 may each include an orifice plate 294 including discharge openings 296 disposed in a generally conical surface 298 for injecting a plurality of jets of dressing fluid across the 1 1/16" width of a bowling lane board 285. In a fourth alternative embodiment shown in FIGS. 40A-40C, precision delivery injectors 232 may each include an orifice plate 301 including five discharge openings 303 disposed in a generally pentagonal orientation on conical surface 305 for injecting a plurality of jets of dressing fluid across the 1 1/16" width of a bowling lane board 285. As illustrated in FIG. 40C, openings 303 may be angled to inject dressing fluid in a generally conical pattern onto the bowling lane surface.

After assembly of precision delivery injectors 232 with one of the aforementioned orifice plates, as illustrated in FIGS. 11, 13 and 41-45, injectors 232 may be operatively affixed within openings 295 of injector rail 230 for providing dressing fluid from passage 297 into openings 299 at upstream ends 260 of each injector 232.

For lane conditioning system 100, as discussed above, a multiple number of the precision delivery injectors 232 may deliver a precise volume of dressing fluid based on a predetermined injector pulse duration and frequency for a selected lane dressing pattern. In the exemplary embodiment of FIGS. 1-7, thirty-nine (39) precision delivery injectors 232 may be utilized for delivering dressing fluid onto each board 285 of bowling lane BL across the 1 1/16" width of each of the boards. In the embodiment of FIGS. 1-7, injectors 232 may be equally spaced with a 1.075" gap between adjacent injectors. It should however be noted that instead of thirty-nine (39) precision delivery injectors 232 delivering dressing fluid onto each board 285 of bowling lane BL across the 1 1/16" width, a fewer number of injectors may be utilized to deliver dressing fluid onto one or more boards of bowling lane BL. In the exemplary embodiment of FIGS. 1-7, injector rail 230 may be approximately 46" wide to accommodate the fluid and electronic connections for injectors 232. Since the viscosity of the dressing fluid is one of the primary factors effecting injector flow output, as discussed below, the dressing fluid pressure and temperature may be controlled to optimize and/or further control the injected volume of dressing fluid.

Figure 20:
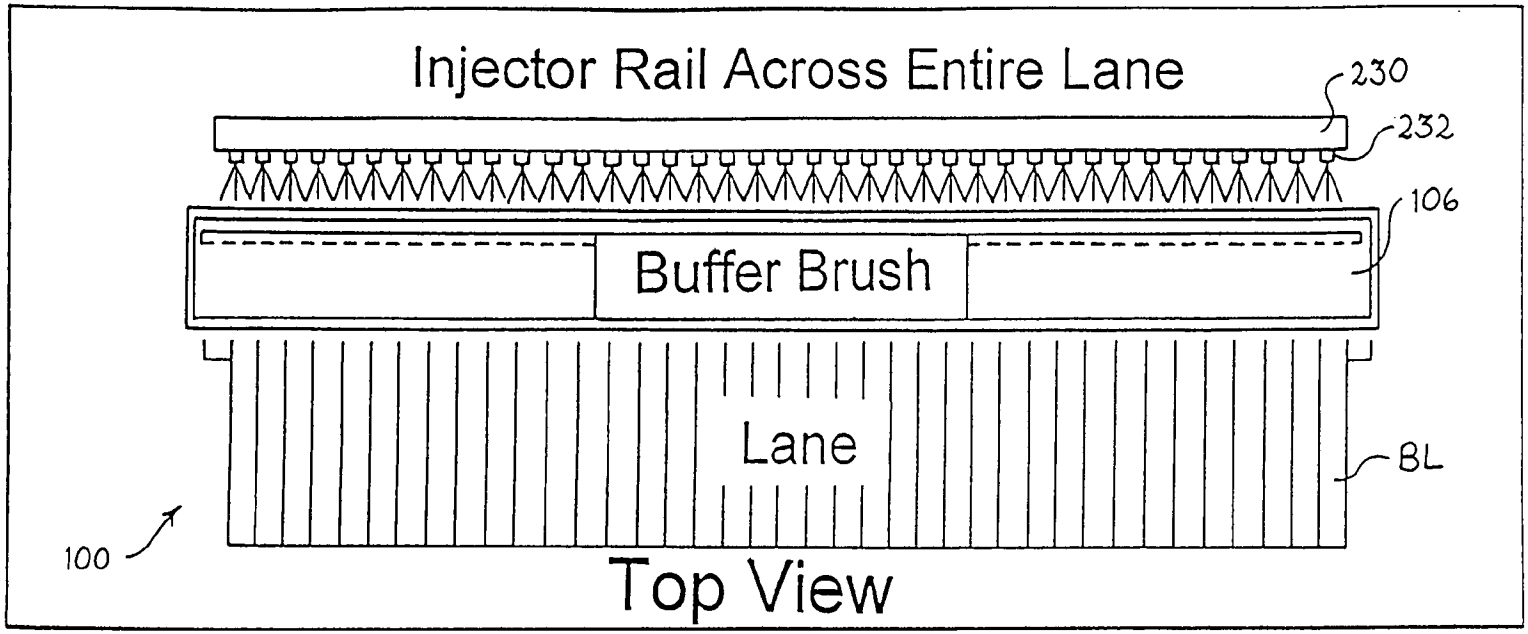
FIG. 20 is a schematic illustrative of a top view of a plurality of precision delivery injectors operatively connected to a fixed injector rail and the buffer for smoothing dressing fluid applied onto a bowling lane.
Figure 21:
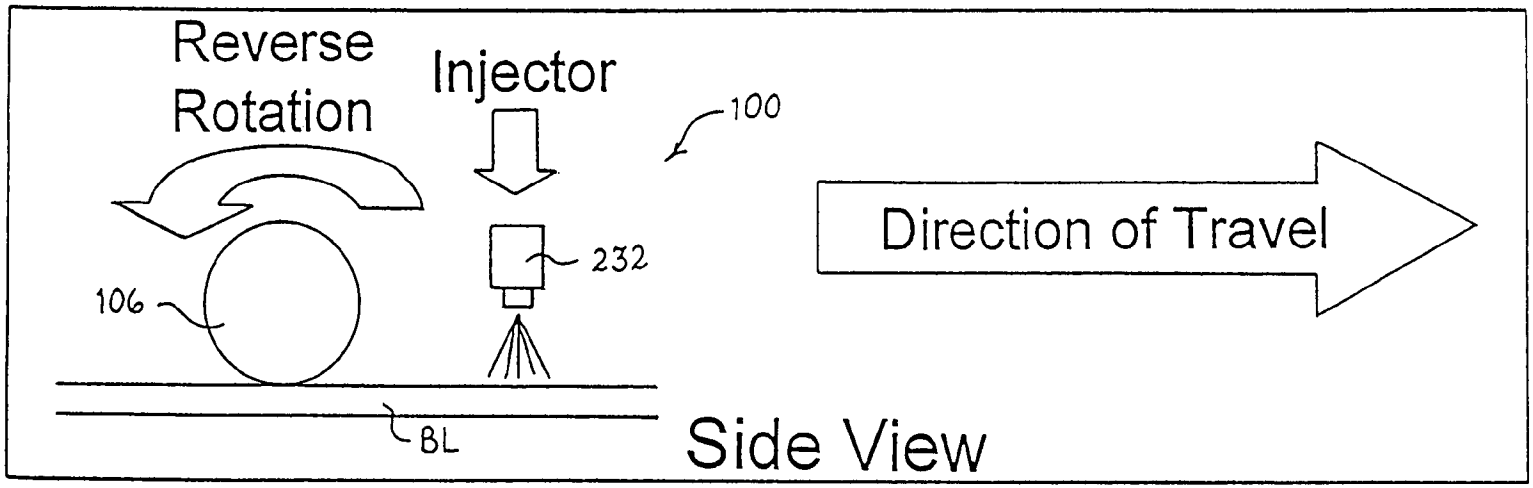
FIG. 21 is a schematic illustrative of a side view of the components of FIG. 20, illustrating a precision delivery injector applying dressing fluid onto a bowling lane and a buffer rotating opposite to the direction of travel of the lane conditioning system of FIG. 1 for smoothing dressing fluid applied onto a bowling lane.
Figure 22:
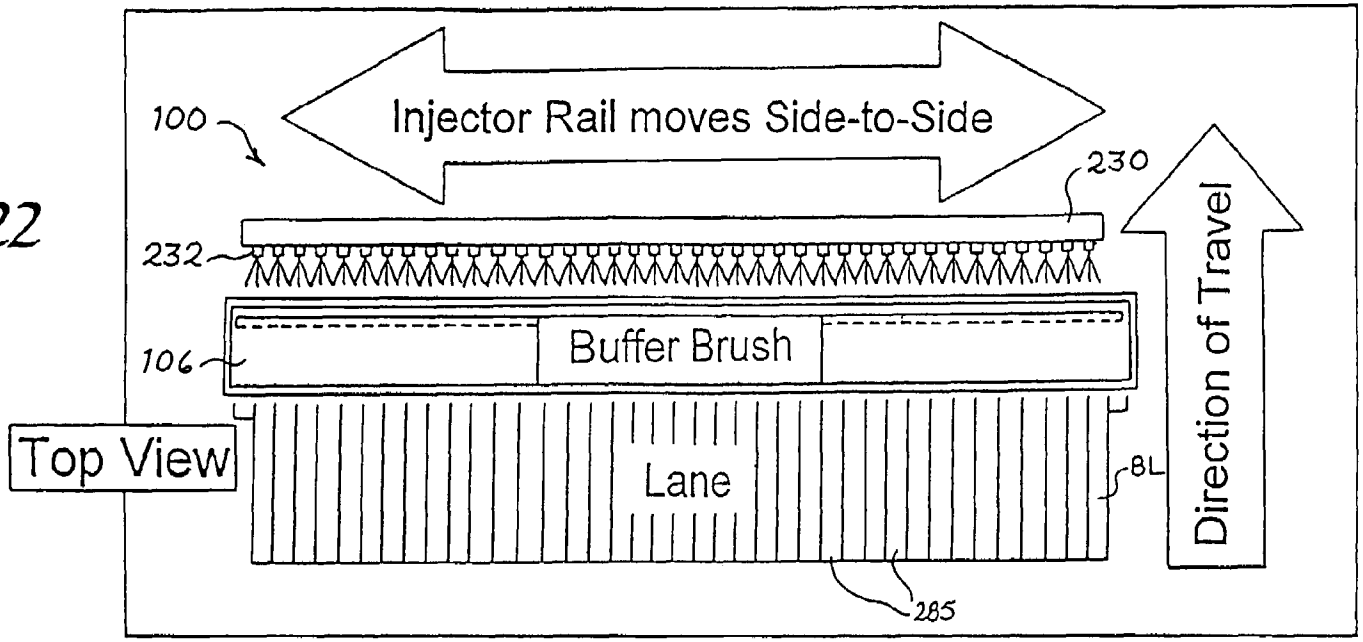
FIG. 22 is a schematic illustrative of a top view of a plurality of precision delivery injectors operatively connected to a reciprocating injector rail and the buffer for smoothing dressing fluid applied onto a bowling lane.
Figure 23:
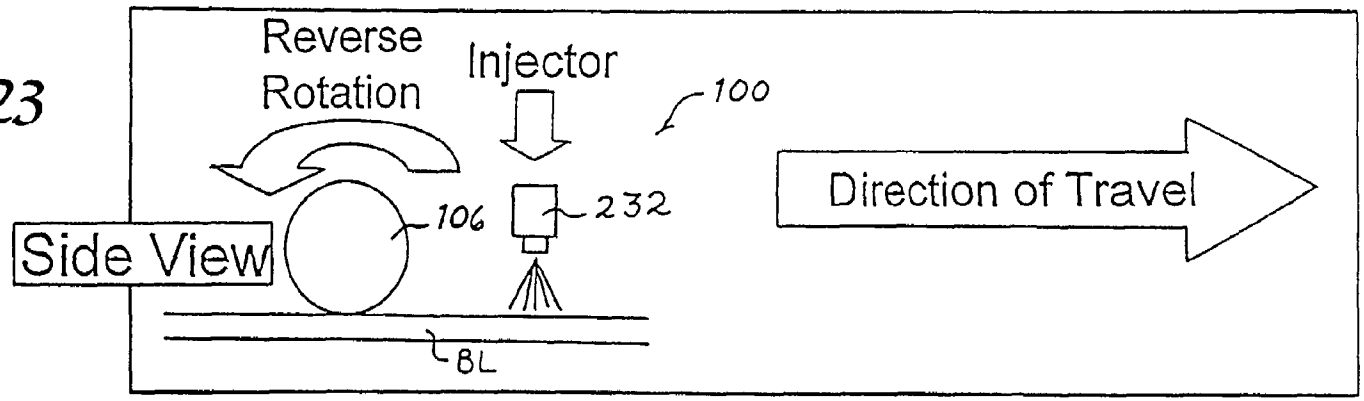
FIG. 23 is a schematic illustrative of a side view of the components of FIG. 22, illustrating a precision delivery injector applying dressing fluid onto a bowling lane and a buffer rotating opposite to the direction of travel of the lane conditioning system of FIG. 1 for smoothing dressing fluid applied onto a bowling lane.
Figure 24:
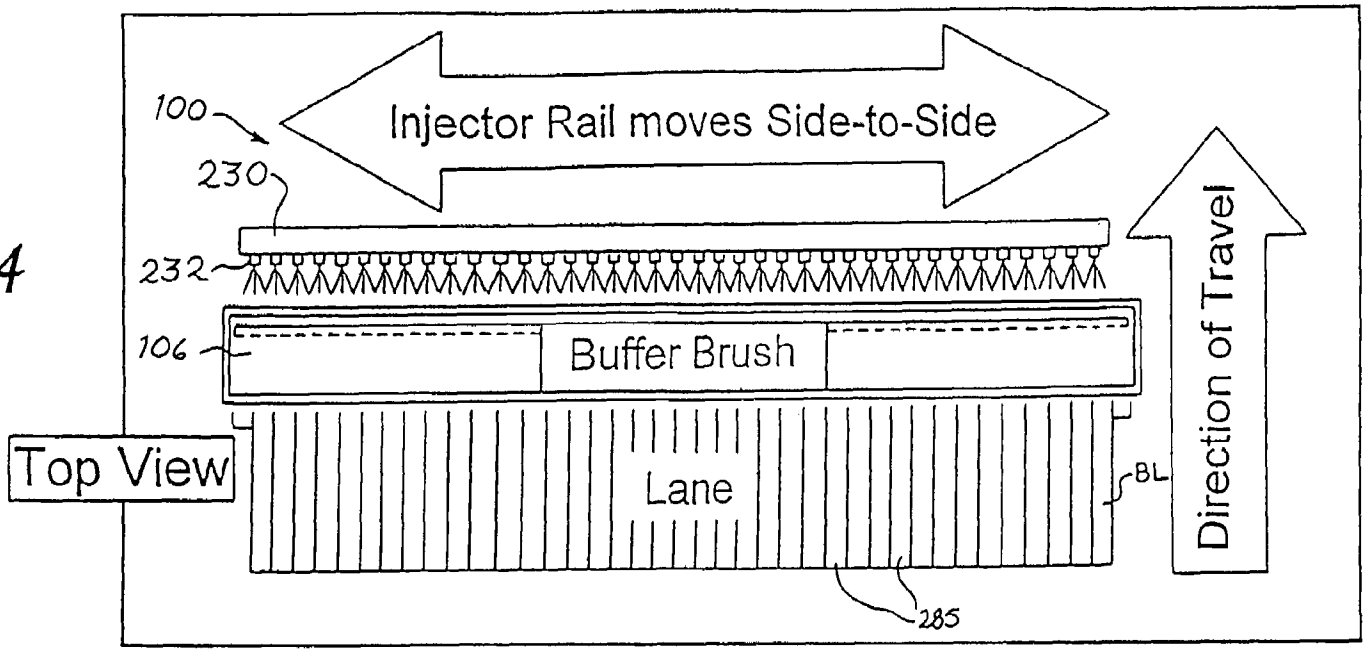
FIG. 24 is a schematic illustrative of a top view of a plurality of precision delivery injectors operatively connected to a reciprocating injector rail and the buffer for smoothing dressing fluid applied onto a bowling lane.
Figure 25:
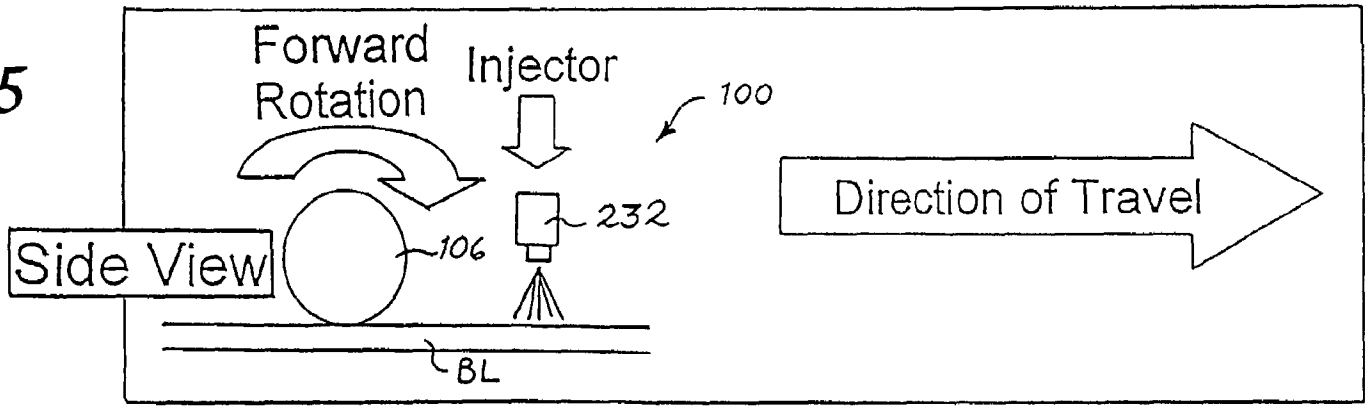
FIG. 25 is a schematic illustrative of a side view of the components of FIG. 24, illustrating a precision delivery injector applying dressing fluid onto a bowling lane and a buffer rotating in the direction of travel of the lane conditioning system of FIG. 1 for smoothing dressing fluid applied onto a bowling lane.
Figure 27:
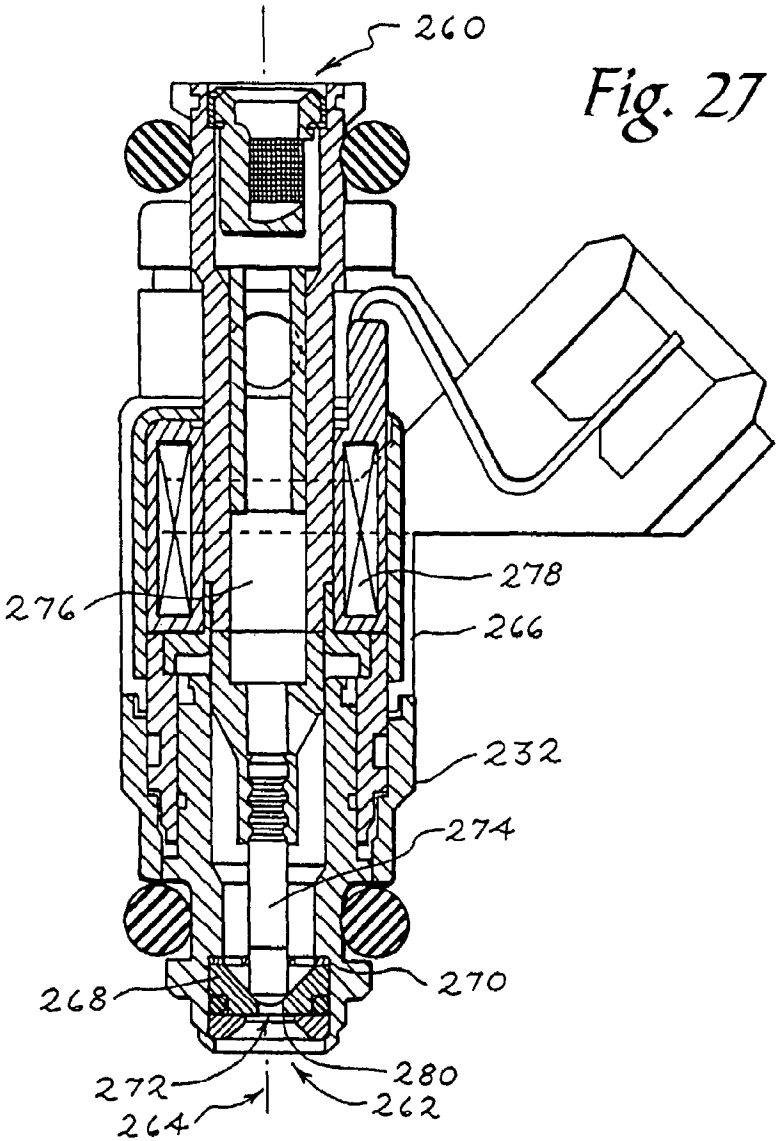
FIG. 27 is a side sectional view of the precision delivery injector of FIG. 26, taken along section 27-27 in FIG. 30.
Figure 26:
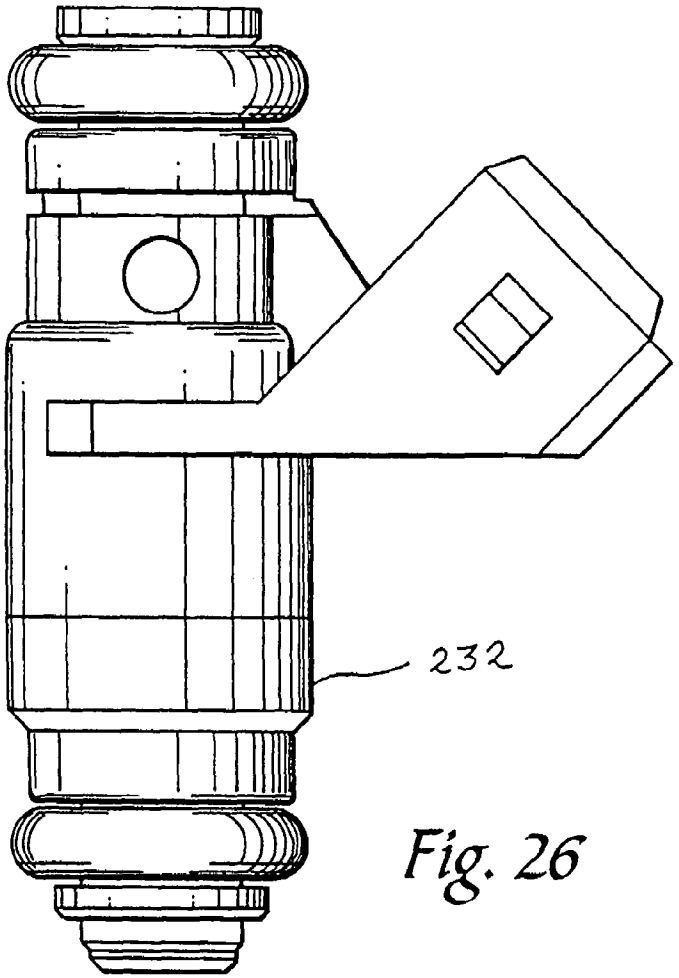
FIG. 26 is a front view of a precision delivery injector according to the present invention for injecting high viscosity dressing fluid.
Figure 28:
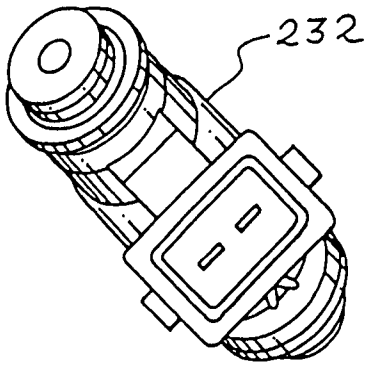
FIG. 28 is an isometric view of the precision delivery injector of FIG. 26.
Figure 31:
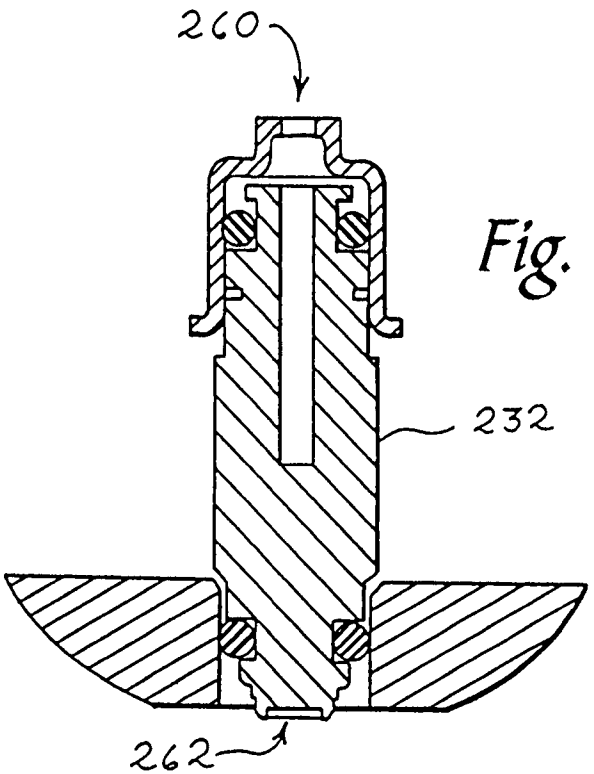
FIG. 31 is a side sectional view of the precision delivery injector of FIG. 30, taken along line 31-31 in FIG. 30, and illustrating the precision delivery injector mounted onto an injector rail.
Figure 30:
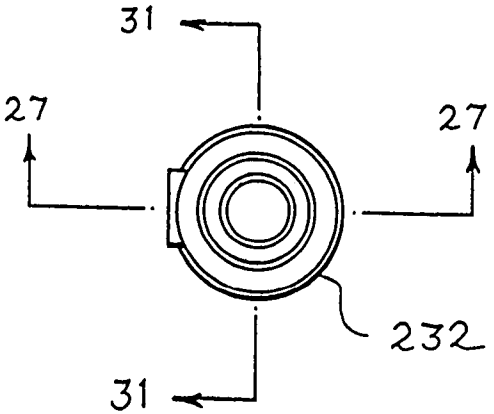
FIG. 30 is a top view of the precision delivery injector of FIG. 29.
Figure 29:
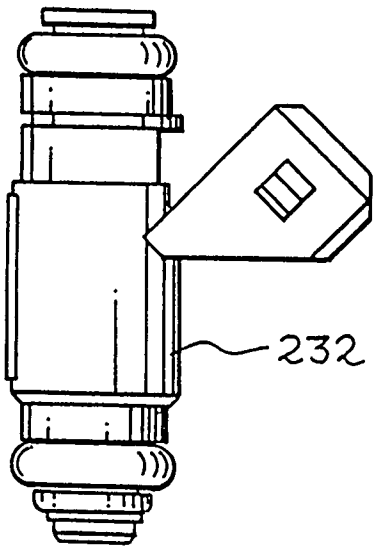
FIG. 29 is another front view of the precision delivery injector of FIG. 26.
Figure 33:
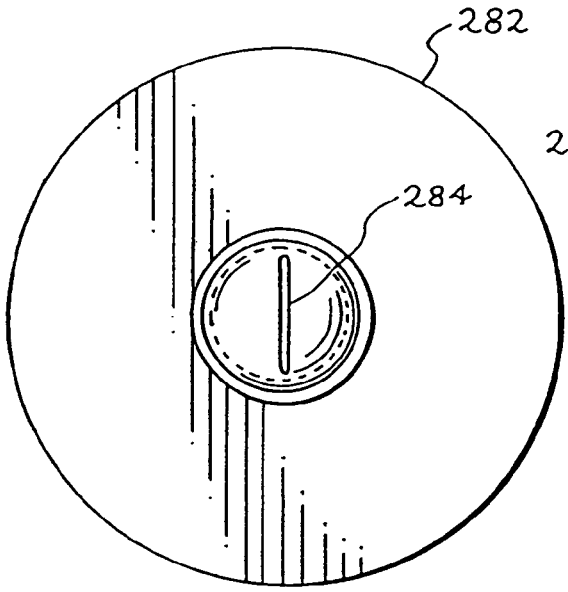
FIG. 33 is an enlarged front view of the first embodiment of the orifice plate of FIG. 32.
Figure 34:
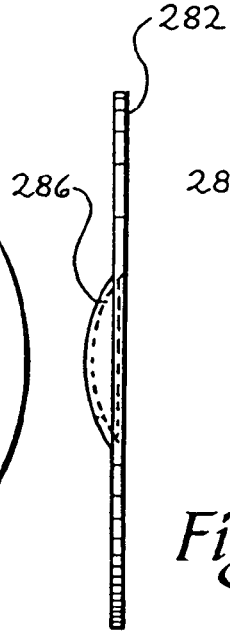
FIG. 34 is a side view of the first embodiment of the orifice plate of FIG. 33.
Figure 32:
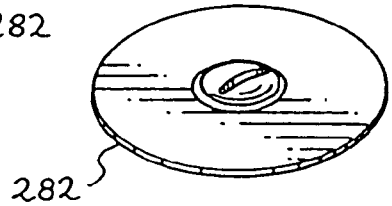
FIG. 32 is an isometric view of a first embodiment of an orifice plate installable on the precision delivery injector of FIG. 26 for injecting high viscosity dressing fluid.
Figure 36:
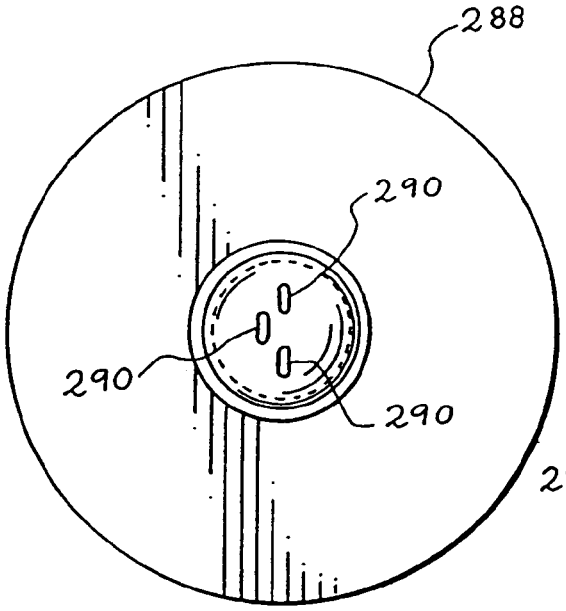
FIG. 36 is an enlarged front view of the second embodiment of the orifice plate of FIG. 35.
Figure 37:
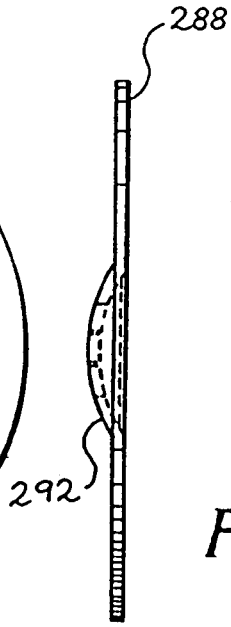
FIG. 37 is a side view of the second embodiment of the orifice plate of FIG. 36.
Figure 35:
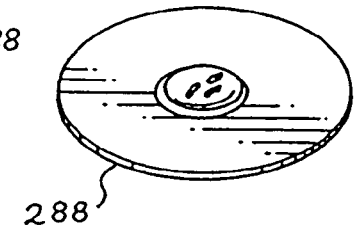
FIG. 35 is an isometric view of a second embodiment of an orifice plate installable on the precision delivery injector of FIG. 26 for injecting high viscosity dressing fluid.
Figure 39A:
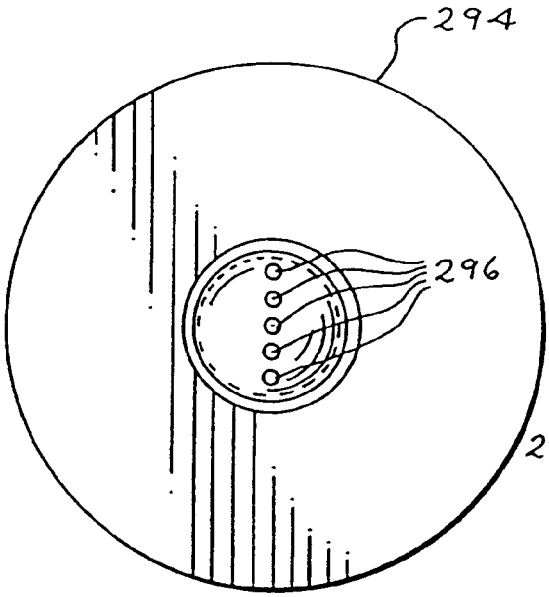
FIG. 39A is an enlarged front view of the third embodiment of the orifice plate of FIG. 38.
Figure 39B:
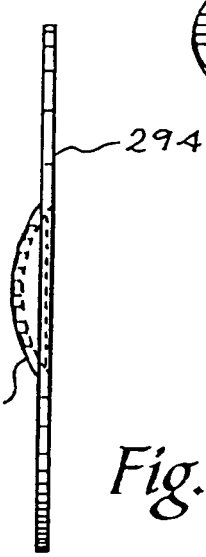
FIG. 39B is a side view of the third embodiment of the orifice plate of FIG. 39A.
Figure 38:
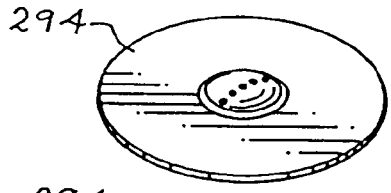
FIG. 38 is an isometric view of a third embodiment of an orifice plate installable on the precision delivery injector of FIG. 26 for injecting high viscosity dressing fluid.
Figure 40B:
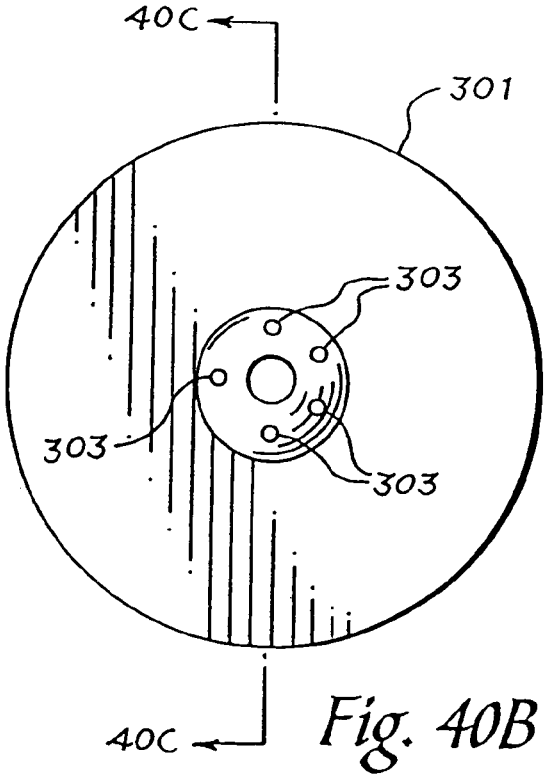
FIG. 40B is an enlarged front view of the fourth embodiment of the orifice plate of FIG. 40A.
Figure 40A:
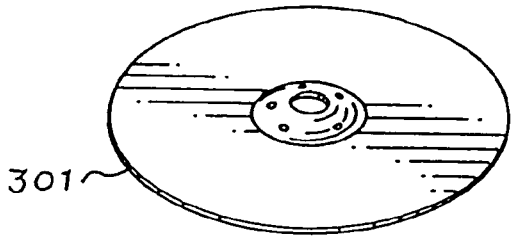
FIG. 40A is an isometric view of a fourth embodiment of an orifice plate installable on the precision delivery injector of FIG. 26 for injecting high viscosity dressing fluid.
Figure 40C:
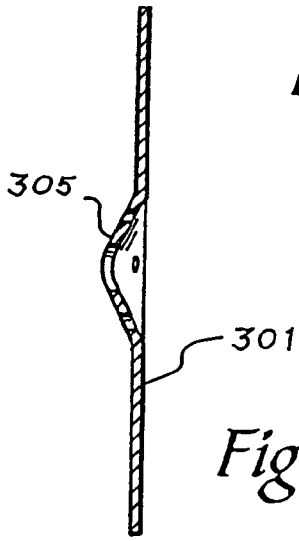
FIG. 40C is a sectional view of the fourth embodiment of the orifice plate of FIG. 40B, taken along section A-A in FIG. 40B.
Figure 41:
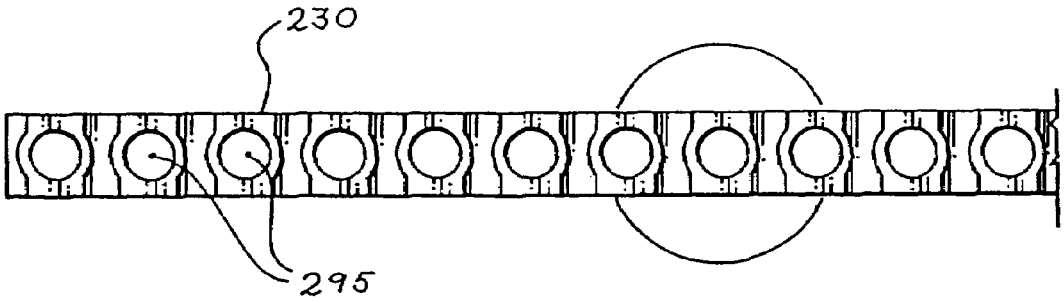
FIG. 41 is a bottom view of an injector rail in which the precision delivery injectors of FIG. 26 may be operatively connected to deliver high viscosity dressing fluid.
Figure 42:
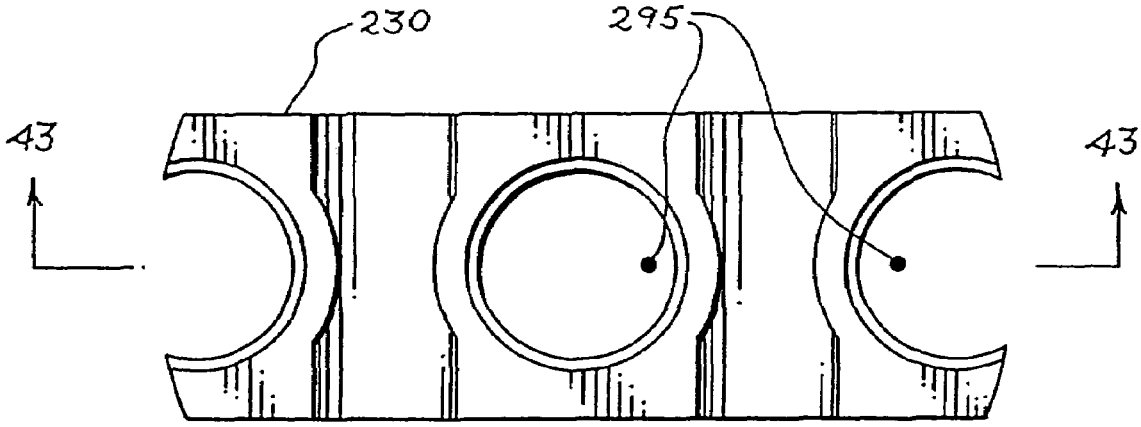
FIG. 42 is an enlarged bottom view of the injector rail of FIG. 41.
Figure 43:
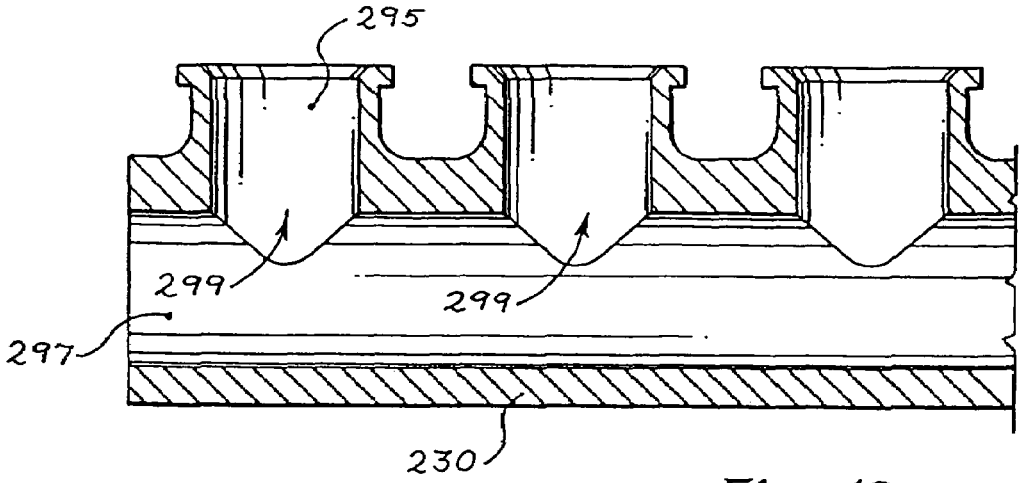
FIG. 43 is a sectional view of the injector rail of FIG. 42, taken along line 43-43 in FIG. 42.
Figure 44:
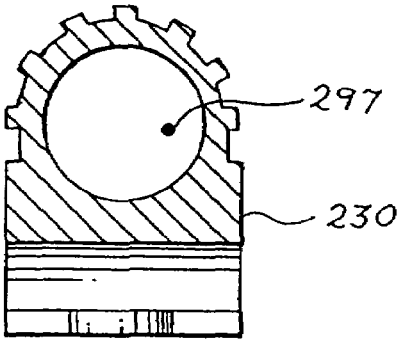
FIG. 44 is a right side view of the injector rail of FIG. 41.
Figure 45:
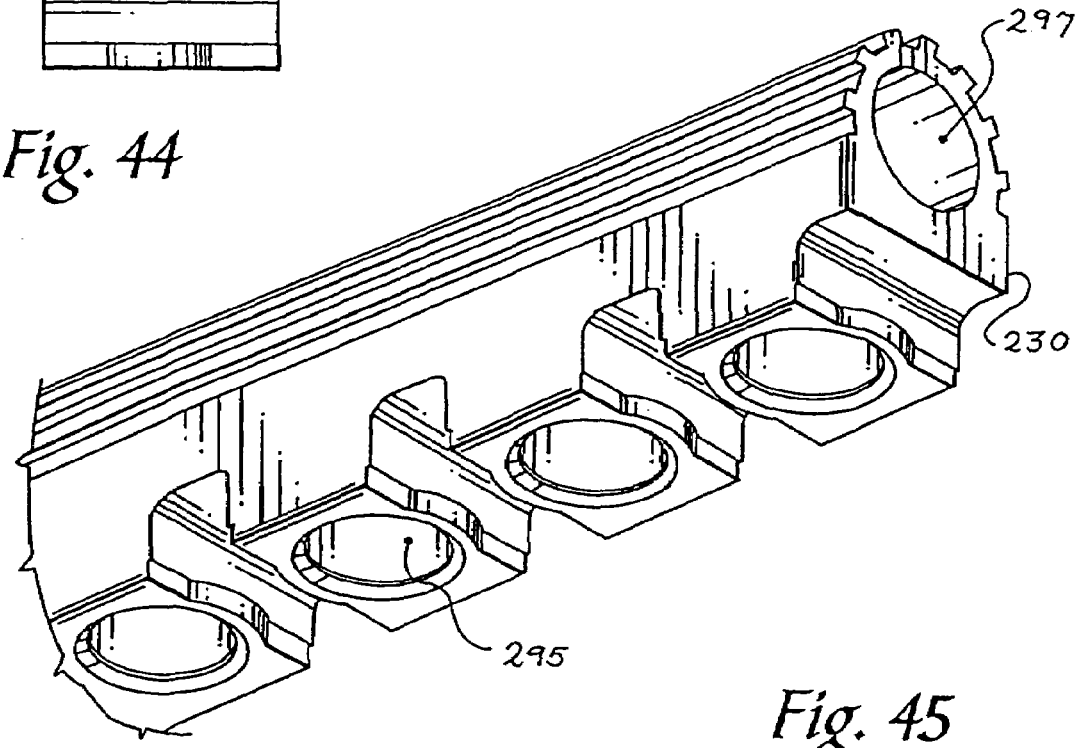
FIG. 45 is an isometric view of the injector rail of FIG. 41.

For the exemplary embodiment of FIGS. 1-7, dressing fluid pump 226 may be operatively connected to dressing fluid tank 220 to draw dressing fluid from tank 220 and supply the dressing fluid to precision delivery injectors 232 at a constant pressure of 200 kpa, for example. Dressing fluid supplied to precision delivery injectors 232 may be directly injected onto bowling lane BL and thereafter smoothed by buffer 106. In order to facilitate the spreading of dressing fluid onto a bowling lane board, injector rail 230 may be reciprocated from side to side parallel to the longitudinal axis thereof such that during travel of lane conditioning system 100 for the conditioning pass, dressing fluid is evenly applied to a lane and thereafter smoothed by buffer 106. For the embodiment of FIGS. 1-7, precision delivery injectors 232 may be reciprocated by means of a rail reciprocation motor (not shown) operatively connected to injector rail 230 to reciprocate rail 230 back and forth over a range of one (1) inch, for example. On the return pass, with precision delivery injectors 232 shut off, buffer 106 may continue to operate to further smooth the dressing fluid applied onto bowling lane BL during the conditioning pass. In the exemplary embodiment of FIGS. 1-7, injector rail 230 may be reciprocated within a range of 45 to 90 rpm, and preferably at 55 rpm. Additionally, precision delivery injectors 232 may be pulsed at a predetermined frequency and duration to inject dressing fluid onto bowling lane BL at approximately one (1) inch intervals for a lane conditioning system 100 conditioning pass travel speed of 18 inch/sec. It should be noted that precision delivery injectors 232 may be pulsed accordingly for faster or slower conditioning pass travel speeds of lane conditioning system 100 such that dressing fluid is applied onto bowling lane BL at a preselected interval controllable by an operator by means of control system 250, as discussed below. It should also be noted that instead of being reciprocated, injector rail 230 may be provided in a fixed configuration for lane conditioning system 100, as illustrated in FIG. 20.

For the embodiment of FIGS. 1-7, for the conditioning and return passes of lane conditioning system 100, buffer 106 may be operable to rotate in the direction opposite to the travel direction of lane conditioning system 100 such that buffer 106 rotates opposite to the rotation direction of drive wheels 154. It should be noted that buffer 106 may be selectively counter-rotated to operate opposite to the direction of travel of lane conditioning system 100, or instead, may be operable to rotate in the direction of travel of lane conditioning system 100.

The operation of lane conditioning system 100 will next be described in detail.

Figure 64:
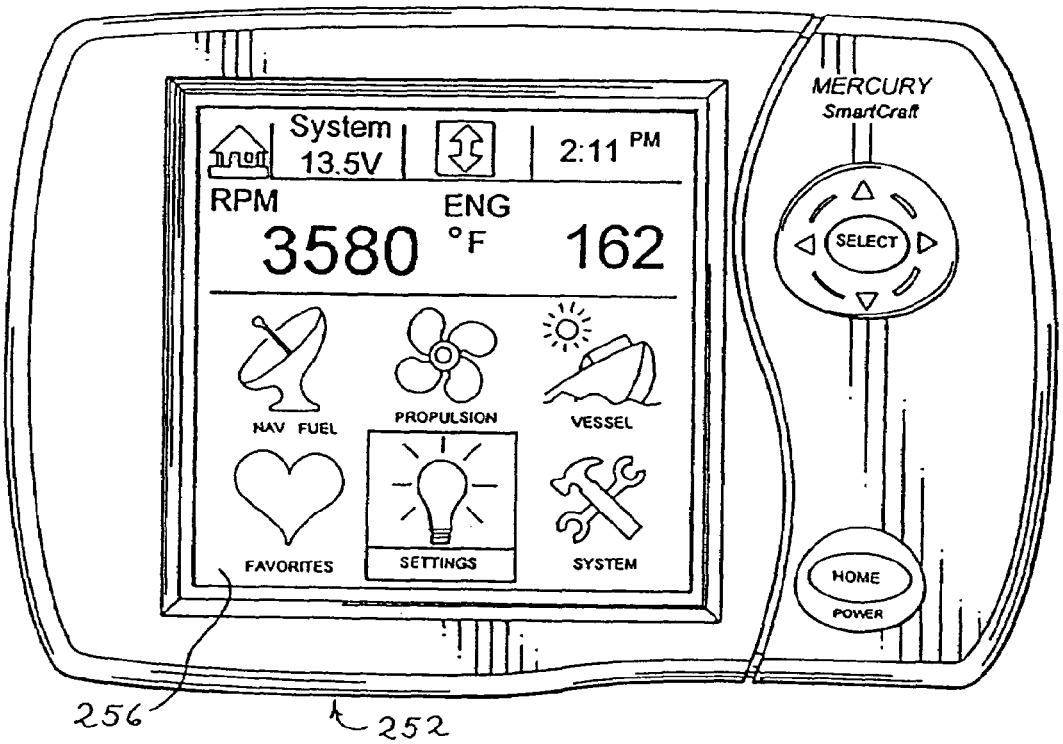
FIG. 64 is an exemplary display for a user interface for controlling operation of the aforementioned lane conditioning systems according to the present invention.
Figure 64:
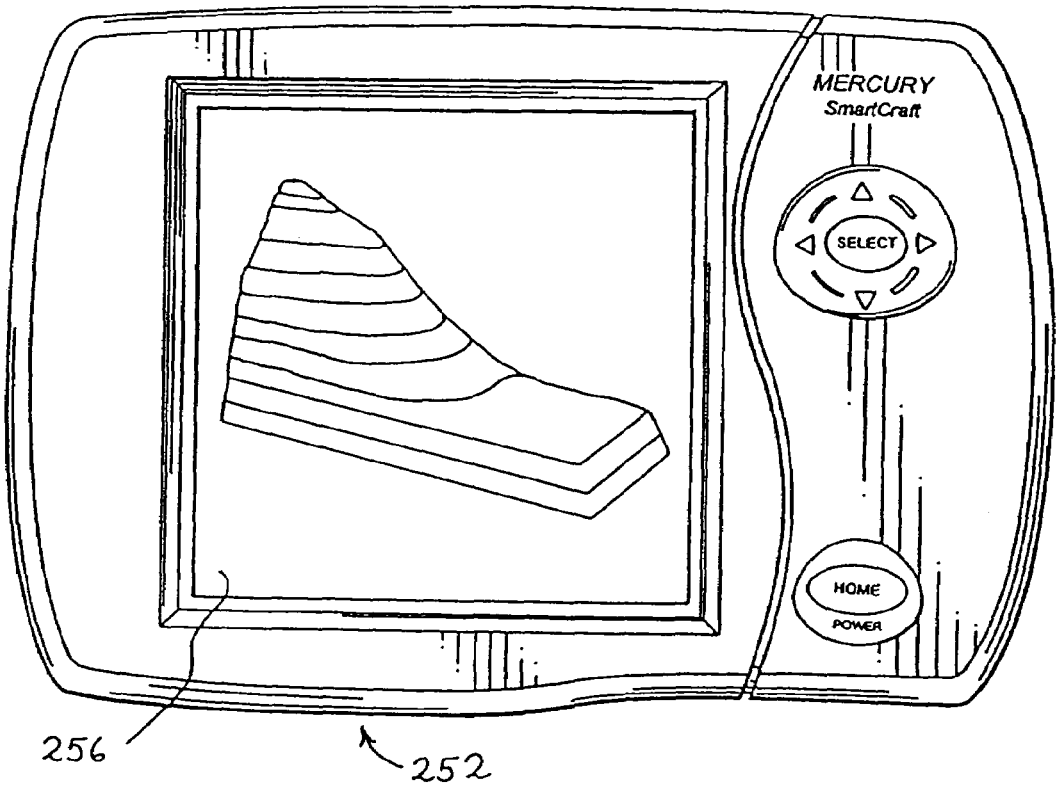
Figure 65:
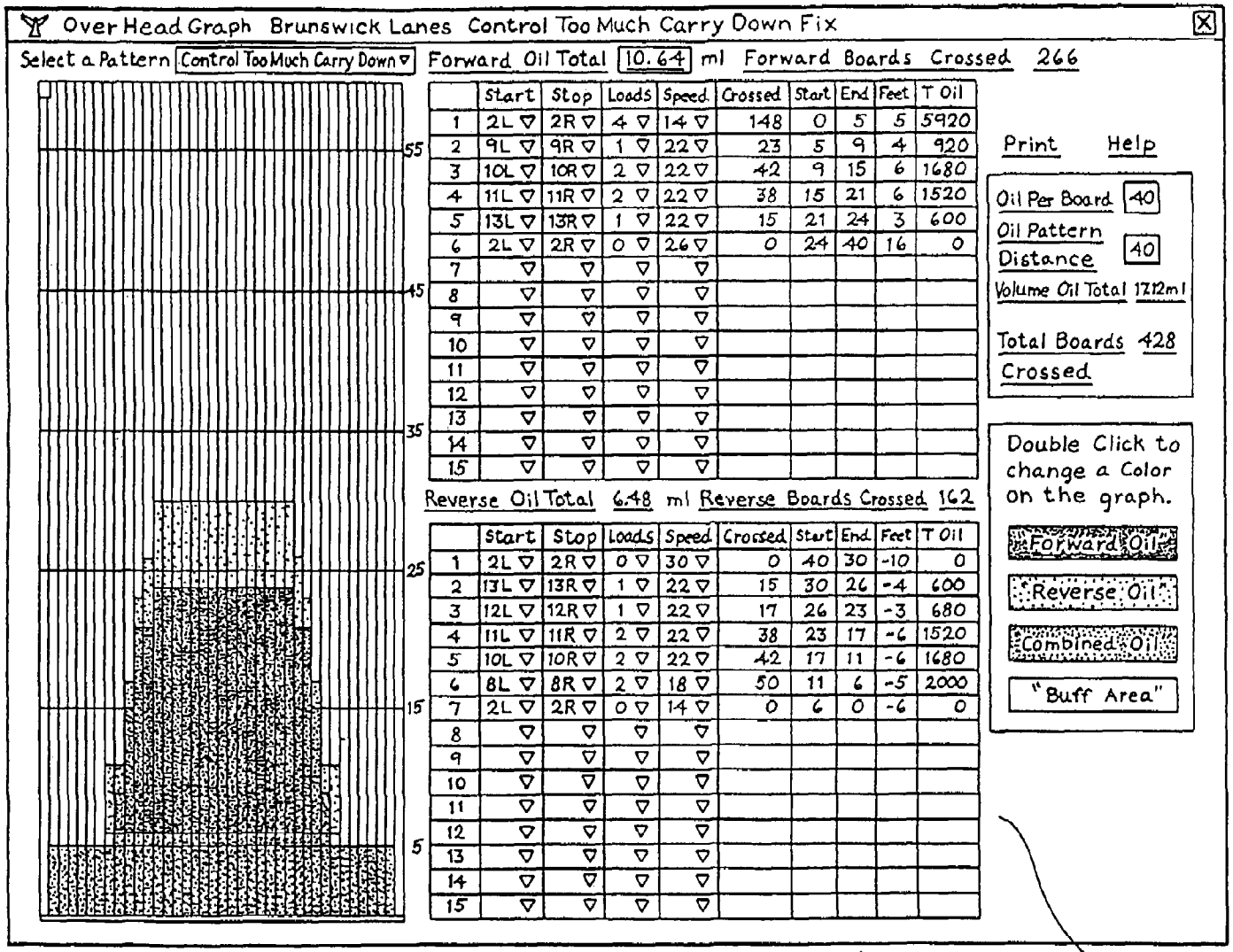
FIG. 65 is another exemplary display for a user interface for controlling operation of the aforementioned lane conditioning systems according to the present invention.
Figure 66:
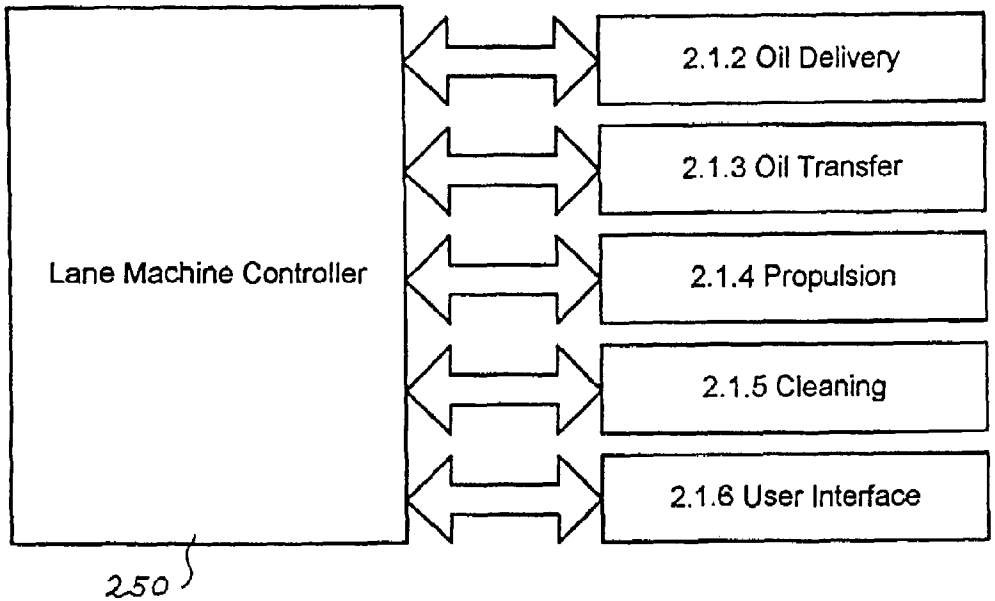
FIG. 66 is an exemplary control system flow chart for controlling the dressing fluid delivery, dressing fluid transfer, propulsion, cleaning and user interface.
Figure 67:
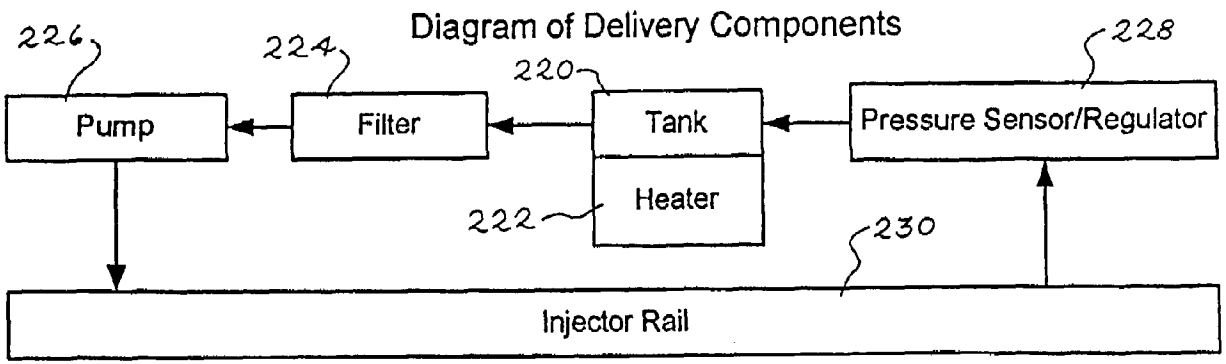
FIG. 67 is an exemplary block diagram layout of the flow of dressing fluid through the dressing application system for the aforementioned lane conditioning systems according to the present invention.
Figure 68:
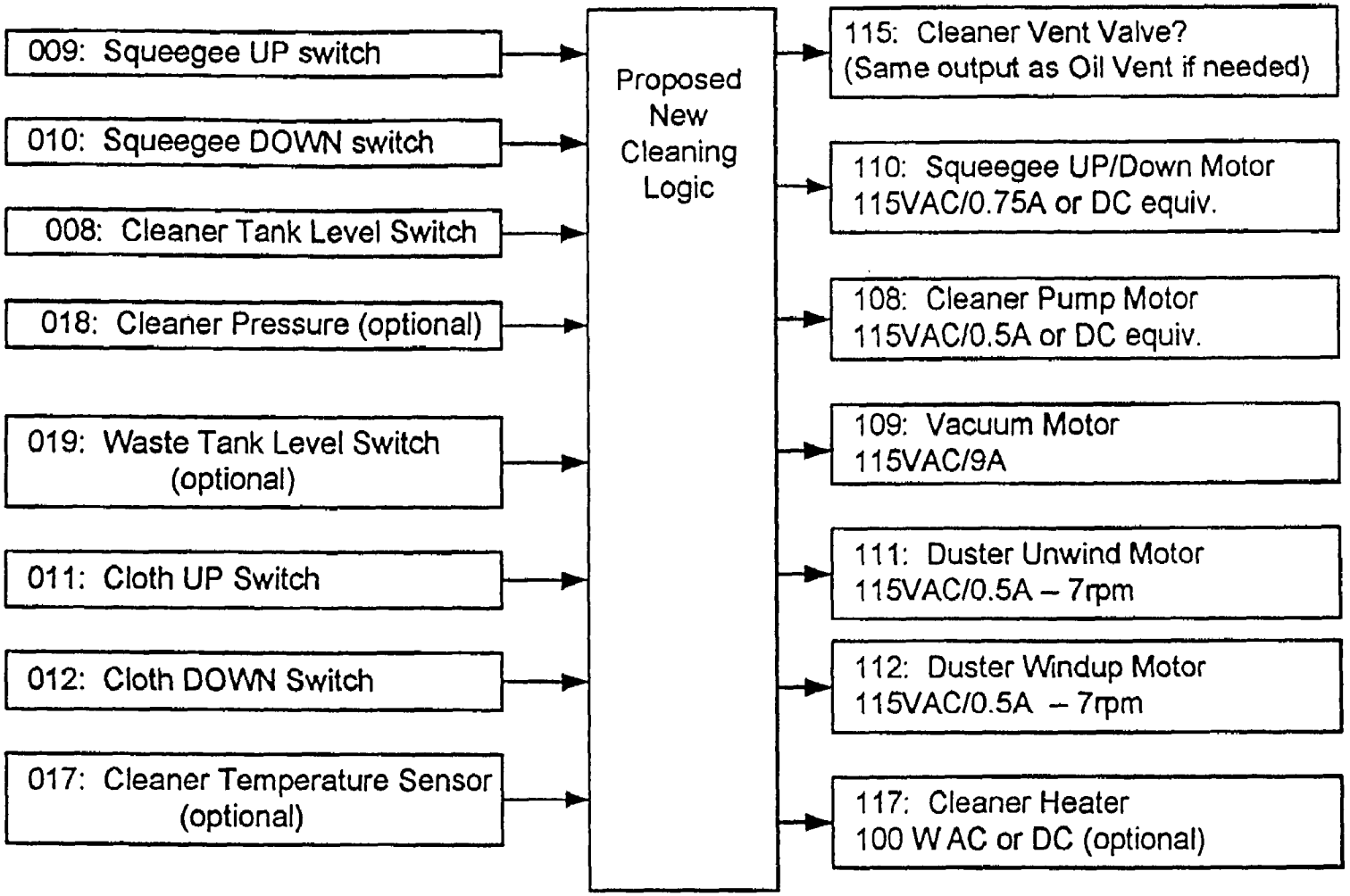
FIG. 68 is an exemplary control system flow chart for controlling the cleaning system of the aforementioned lane conditioning systems according to the present invention.
Figure 69:
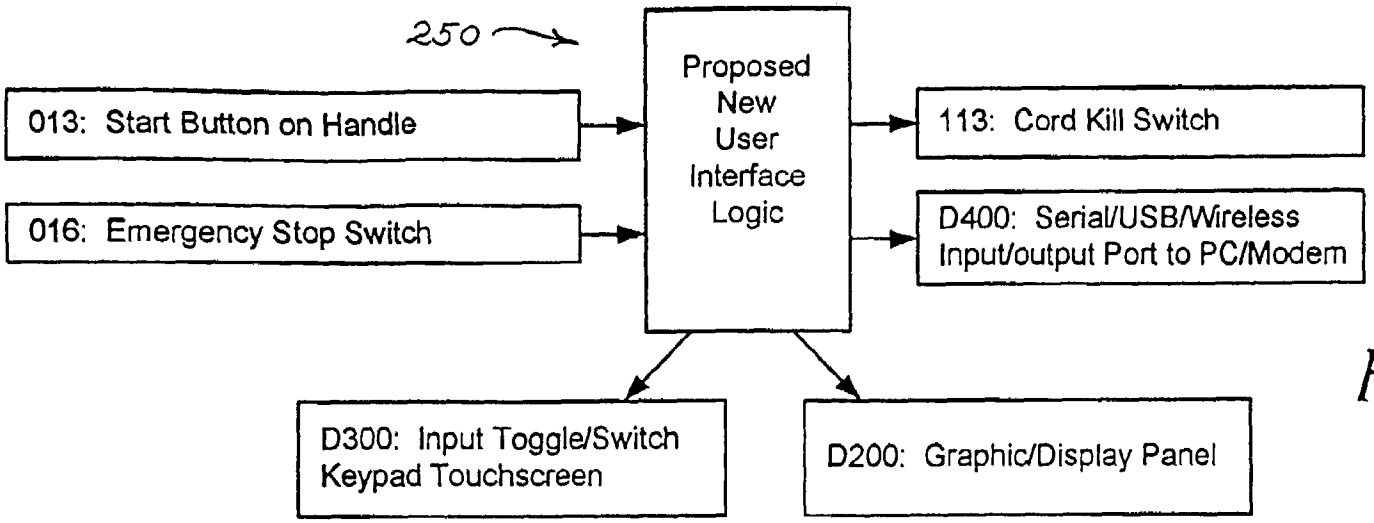
FIG. 69 is an exemplary control system flow chart for controlling the user interface and start/stop operations of the aforementioned lane conditioning systems according to the present invention.
Figure 70:
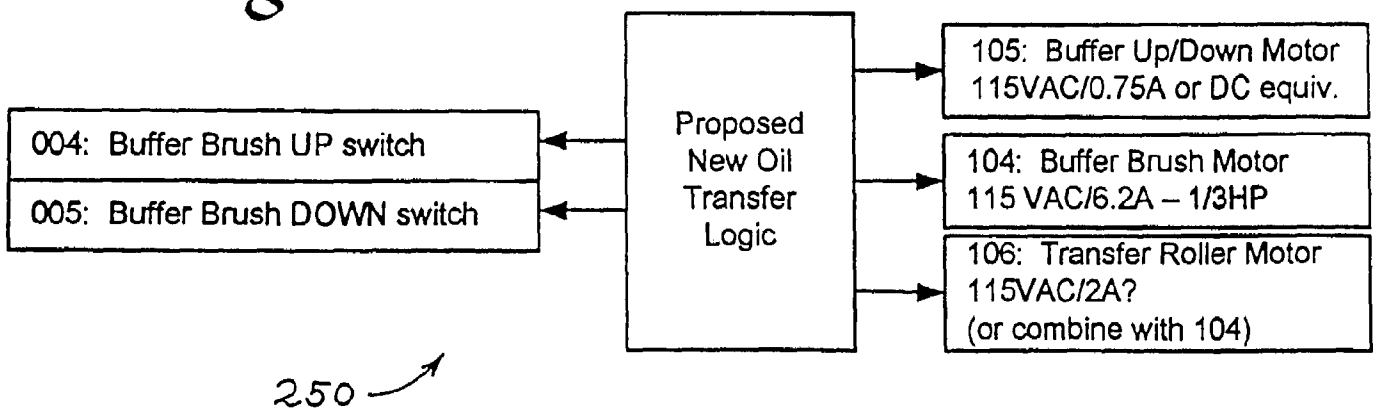
FIG. 70 is an exemplary control system flow chart for controlling buffer operations of the aforementioned lane conditioning systems according to the present invention.
Figure 71:
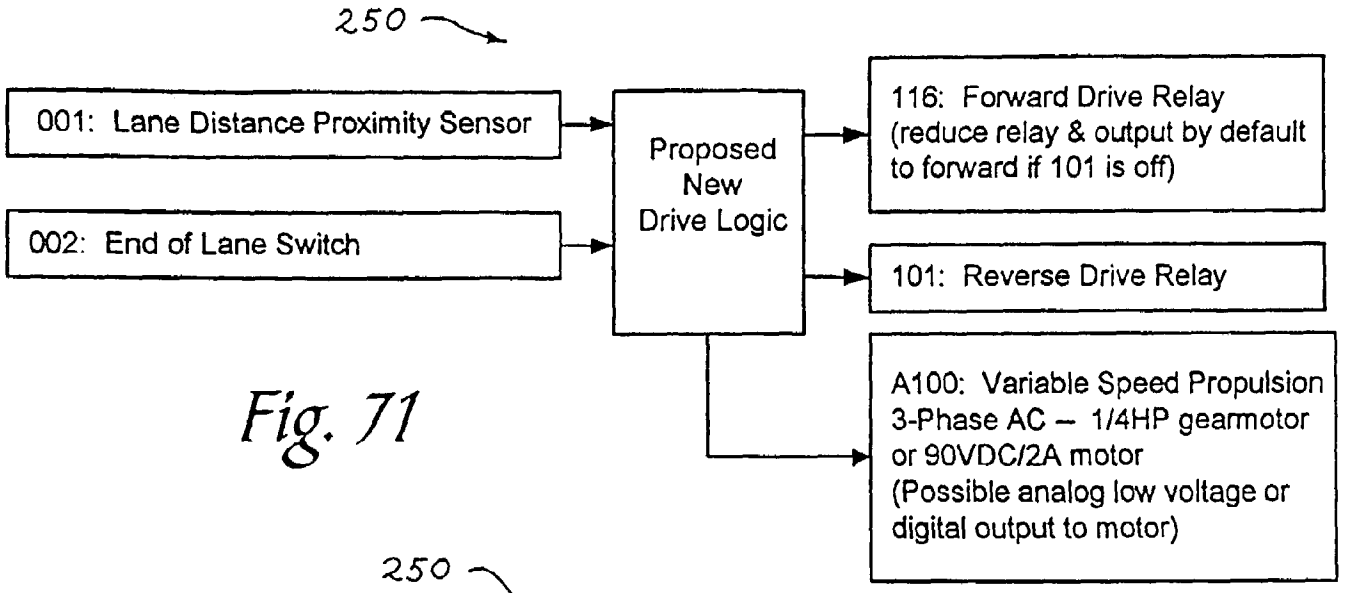
FIG. 71 is an exemplary control system flow chart for controlling the drive system of the aforementioned lane conditioning systems according to the present invention.
Figure 72:
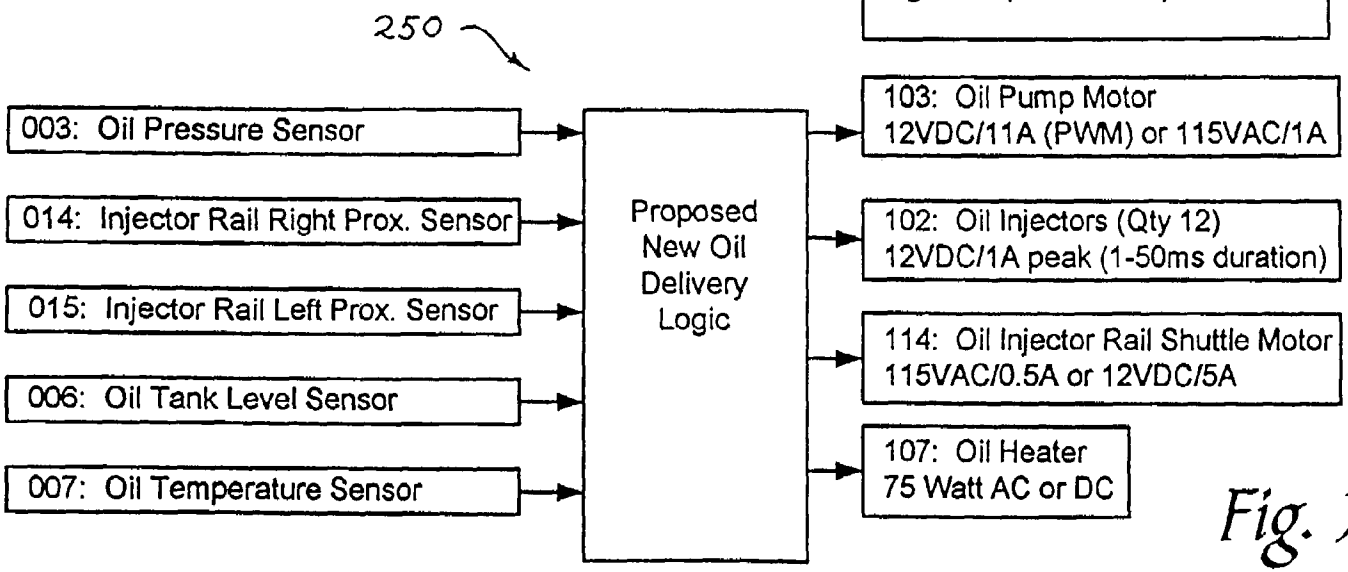
FIG. 72 is an exemplary control system flow chart for controlling the dressing application system of the aforementioned lane conditioning systems according to the present invention.

Referring to FIGS. 1-7, 64-66 and 68-72, the operation of lane conditioning system 100 may generally be controlled by control system 250 operated by user interface 252. In the exemplary embodiment of FIGS. 1-7, control system 250 may be one or more PCM 555, embedded PC or programmable logic controllers configured to control multiple components of lane conditioning system 100. For example, a single PCM 555 controller having twelve (12) control outputs may be utilized to control twelve (12) precision delivery injectors 232 individually. As shown in FIGS. 64 and 65, user interface 252 may include a monochrome or color monitor 256 with options for selecting a cleaning and/or conditioning routine from a host of predetermined options or otherwise programming control system 250 via user interface 252 for a custom cleaning and/or conditioning application. User interface 252 and monitor 256 may display on-screen sensor outputs and error messages for the various sensors and up/down switches provided in lane conditioning system 100. User interface 252 may provide an operator with the ability to control the distance of the conditioning pattern and the speed of lane conditioning system 100 for applying dressing fluid onto bowling lane BL. Control system 250 may include a connection (not shown) to a personal computer or the like for loading custom software and other programs, and may also include diagnostics software for determining corrective action for facilitating the precise control of precision delivery injectors 232 for custom applications and the like.

In order to clean and condition bowling lane BL, lane conditioning system 100 may first be placed on the bowling lane just beyond the foul line. The operator may then select a cleaning and/or conditioning routine from a host of predetermined options or otherwise program control system 250 via user interface 252 for a custom cleaning and/or conditioning application, as illustrated in FIGS. 64 and 65. For example, the operator may simply choose a desired conditioning pattern from viewing a two or three dimensional layout of dressing fluid, as illustrated in FIG. 64, at various locations along the length of bowling lane BL, or may likewise specify a desired conditioning pattern via user interface 252, as illustrated in FIG. 65. In the embodiment of FIGS. 1-7, user interface 252 may include popular lane dressing patterns for recreational bowling, league bowling etc. With a cleaning and/or conditioning routine preselected from a host of predetermined options or otherwise programmed for a custom application on user interface 252, start switch 254 may be switched to an on position (i.e. pressed down) to initiate a sequence of automatic cleaning and/or conditioning operations.

Assuming that an operator chooses both the cleaning and conditioning operations, the cleaning operation may be initiated by control system 250 activating vacuum pump 198 and the dryer, and by activating the squeegee up/down motor to lower squeegees 202 into contact with the bowling lane surface. Control system 250 may also activate duster cloth unwind motor 174 to rotate duster cloth supply roll 172 and produce a slack in duster cloth 184. As duster roller 176 engages the bowling lane surface under the slack of duster cloth 184, control system 250 may confirm the downward deployment of squeegees 202 and duster roller 176 by the squeegee down switch and duster down switch 188, respectively. Control system 250 may then activate dressing fluid pump 226, dressing fluid heater 222, and dressing fluid pressure sensor/regulator 228 to begin the flow of dressing fluid through dressing application system 140. At the same time, the buffer up/down motor may be energized to pivot buffer 106 down into contact with bowling lane BL, the contact being confirmed by the buffer down switch.

Upon successful completion of the aforementioned preliminary operations, user interface 252 may prompt the operator to re-press start switch for performing the cleaning and conditioning operations, or may otherwise prompt the operator of any failed preliminary operations. Assuming successful completion of the aforementioned preliminary operations, the operator may then press start switch, for the second time. Control system 250 may then activate drive motor 152 at a preset speed corresponding to the preselected or otherwise customized application selected by the operator, at which time lane conditioning system 100 is propelled forward from the foul line toward the pin deck. Control system 250 may then activate buffer 106 to rotate and thereby spread the injected dressing fluid on the bowling lane. As lane conditioning system 100 is being propelled forward, control system 250 may telescope cleaning fluid delivery nozzles 124 forward of lane conditioning system 100, as discussed above, and activate nozzles 124 to deliver cleaning fluid forward of lane conditioning system 100. The cleaning fluid on bowling lane BL may be agitated by duster cloth 184 and thereafter suctioned and dried by vacuum system 126 and the dryer, respectively, as discussed above. Precision delivery injectors 232 may then inject dressing fluid directly onto bowling lane BL by pulsing dressing fluid at approximately one (1) inch intervals along the length of the bowling lane for a lane conditioning system 100 conditioning pass travel speed of 18 inch/sec., (resulting in a 55 millisecond period between the start of each injector pulse) at a predetermined pulse duration corresponding to the preselected or otherwise customized application selected by the operator. In the exemplary pattern illustrated in FIGS. 64 and 65, the outermost injectors 232 (1-7) and 232 (33-39) may inject dressing fluid at a pulse duration of 1.5-2.5 milliseconds. Inner injectors 232 (8-12) and 232 (28-32) may inject dressing fluid at a pulse duration of 2-8 milliseconds, injectors 232 (13-17) and 232 (23-27) may inject dressing fluid at a pulse duration of 6-20 milliseconds, and injectors 232 (18-22) may inject dressing fluid at a pulse duration of 16-40 milliseconds. The aforementioned pulse durations for injectors 232 (1-39) may be automatically changed as needed based upon a preselected or otherwise customized application along the length of bowling lane BL by means of control system 250 and user interface 252, as lane conditioning system traverses down the bowling lane from the foul line toward the pin deck. Upon reaching the end of the preselected conditioning pattern, the buffer up/down motor may be energized to pivot buffer 106 up and out of contact from bowling lane BL, the raised position being confirmed by the buffer up switch. The rotation of buffer 106 may also be stopped at this time. In this manner, an operator may utilize user interface 252 to visually specify a lane dressing pattern along the length of bowling lane BL and thereafter, at the touch of a button (i.e. start switch), precisely condition the bowling lane without the guesswork associated with specifying when to begin or stop delivery of lane dressing fluid onto a transfer roller or the bowling lane, as with the prior art wick or metering pump lane conditioning systems.

After completion of the forward pass, lane conditioning system 100 may initiate the return pass by shutting off cleaning fluid delivery nozzles 124, vacuum system 126, the dryer, precision delivery injectors 232 and activating waste roller windup motor 182 to operate waste roller 180 to lift duster roller 176 up away from the bowling lane surface. Control system 250 may then reverse the direction of rotation of buffer 106 for rotation in the direction of travel of lane conditioning system 100, and reverse drive motor 152 to propel lane conditioning system 100 at a speed corresponding to a preselected or otherwise customized application selected by the operator.

As discussed above, it should be noted that control system 250 may instead rotate buffer 106 in the direction of travel of lane conditioning system 100 based upon a preselected or otherwise customized application selected by an operator. It should also be noted that for the preselected applications available on user interface 252, lane conditioning system 100 completes the entire conditioning and return passes in less than sixty (60) seconds. For further reducing the time required for the conditioning and return passes, during the return pass and/or at locations along the length of the bowling lane where less dressing fluid is applied during the conditioning pass, control system 250 may operate drive motor 152 at higher speeds, i.e. 36-60 inches per second.

With bowling lane BL cleaned and conditioned, the operator may utilize the handle to move lane conditioning system 100 to another bowling lane as needed and perform further cleaning and/or conditioning operations.

Figure 60:
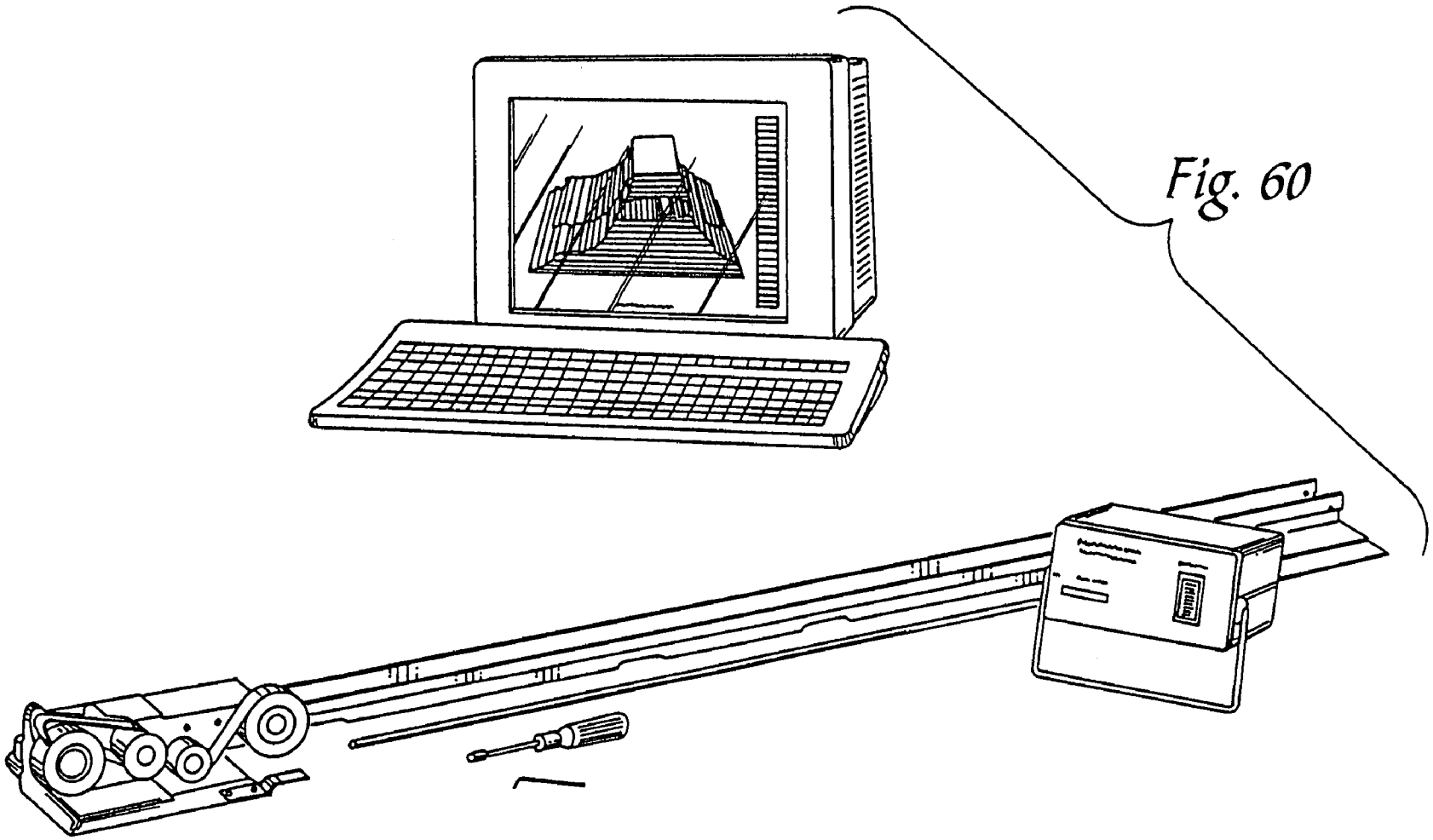
FIG. 60 includes photographs of the Brunswick Lane Monitor and an associated display of a lane dressing pattern on a personal computer.
Figure 61:
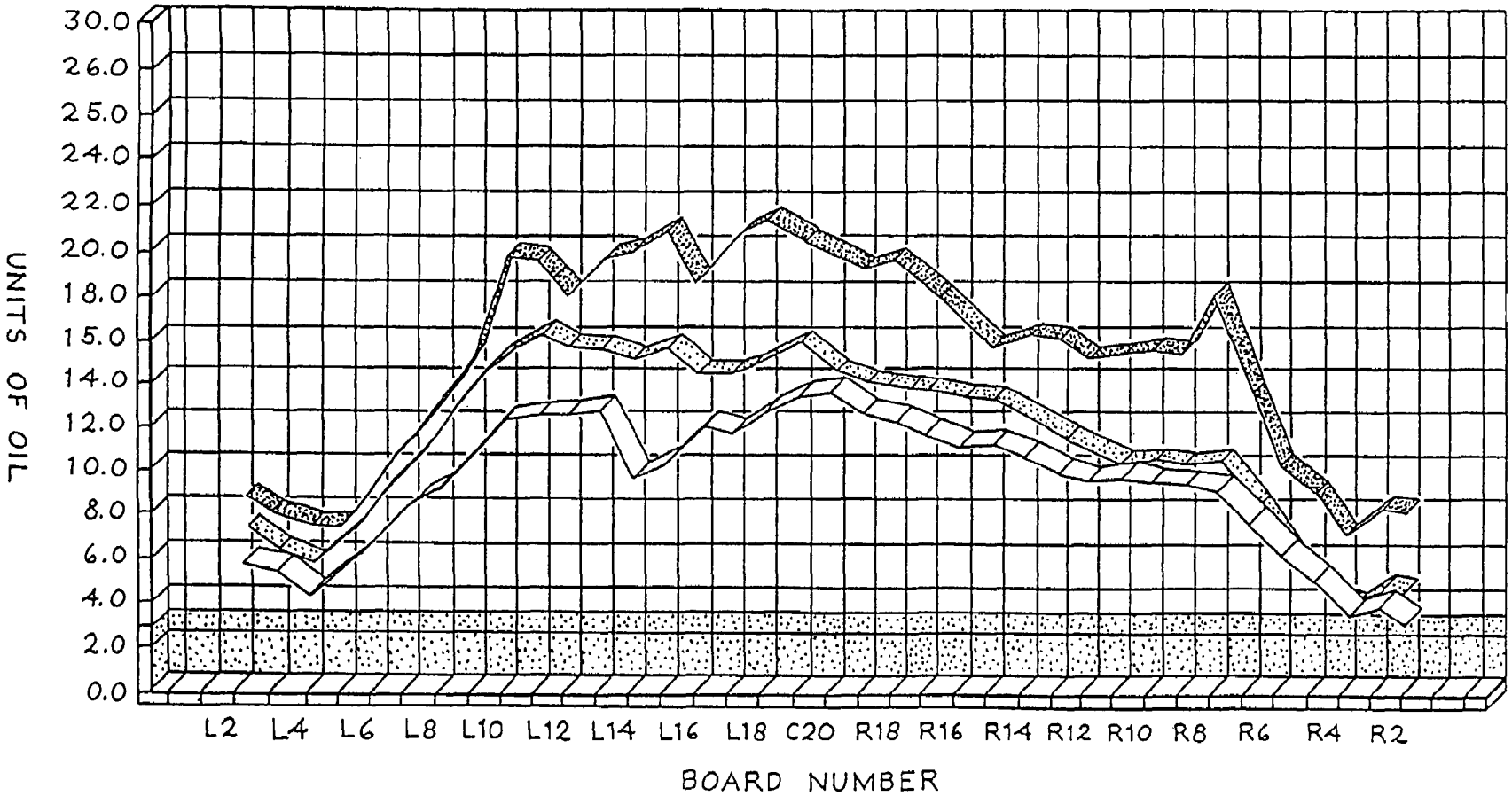
FIG. 61 is a Brunswick Lane Monitor plot illustrating typical 2D dressing fluid profile plots for three tape strip measurements.
Figure 62:
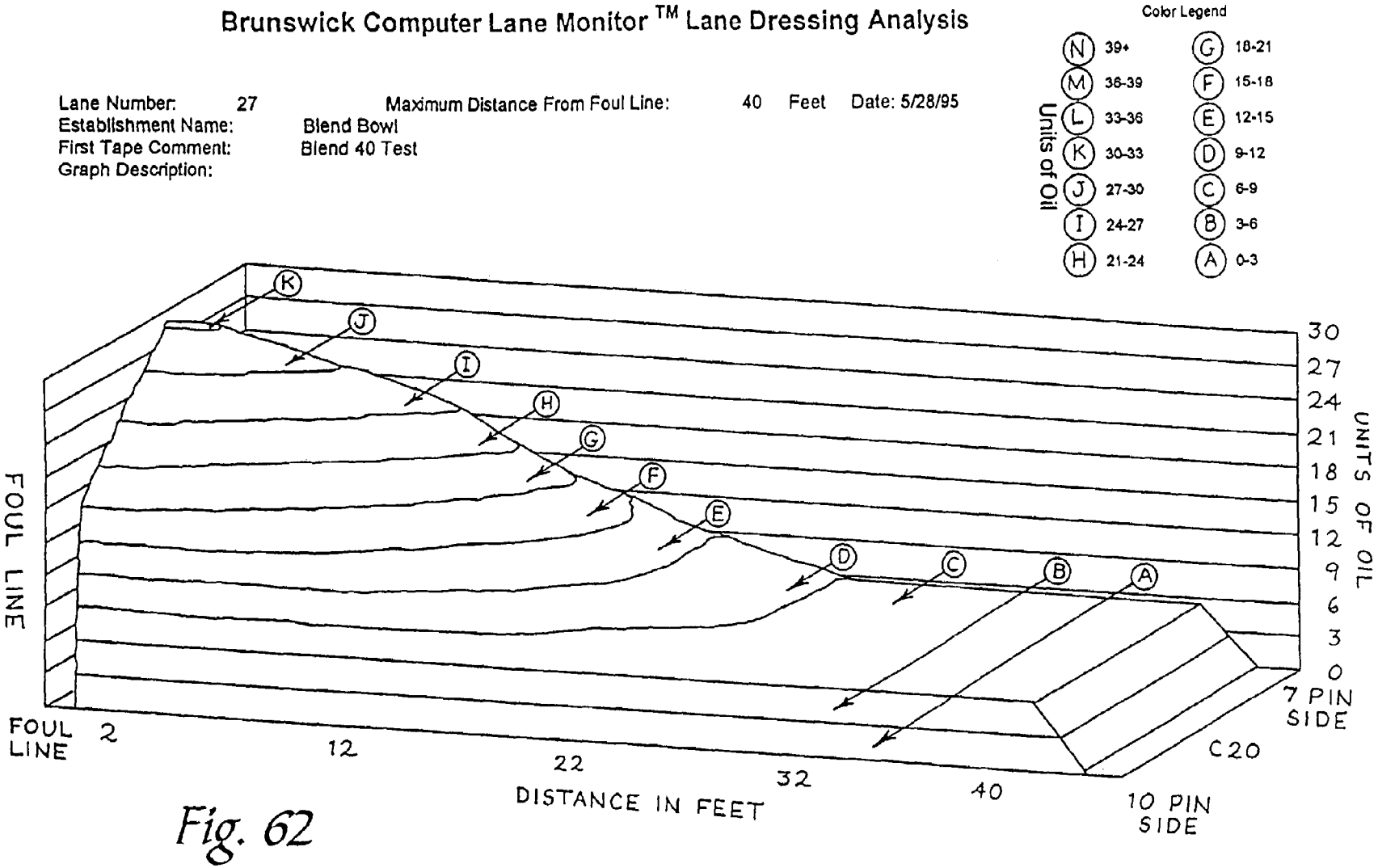
FIG. 62 is a Brunswick Computer Lane Monitor plot illustrating an exemplary dressing fluid layout along the length of a bowling lane.
Figure 63:
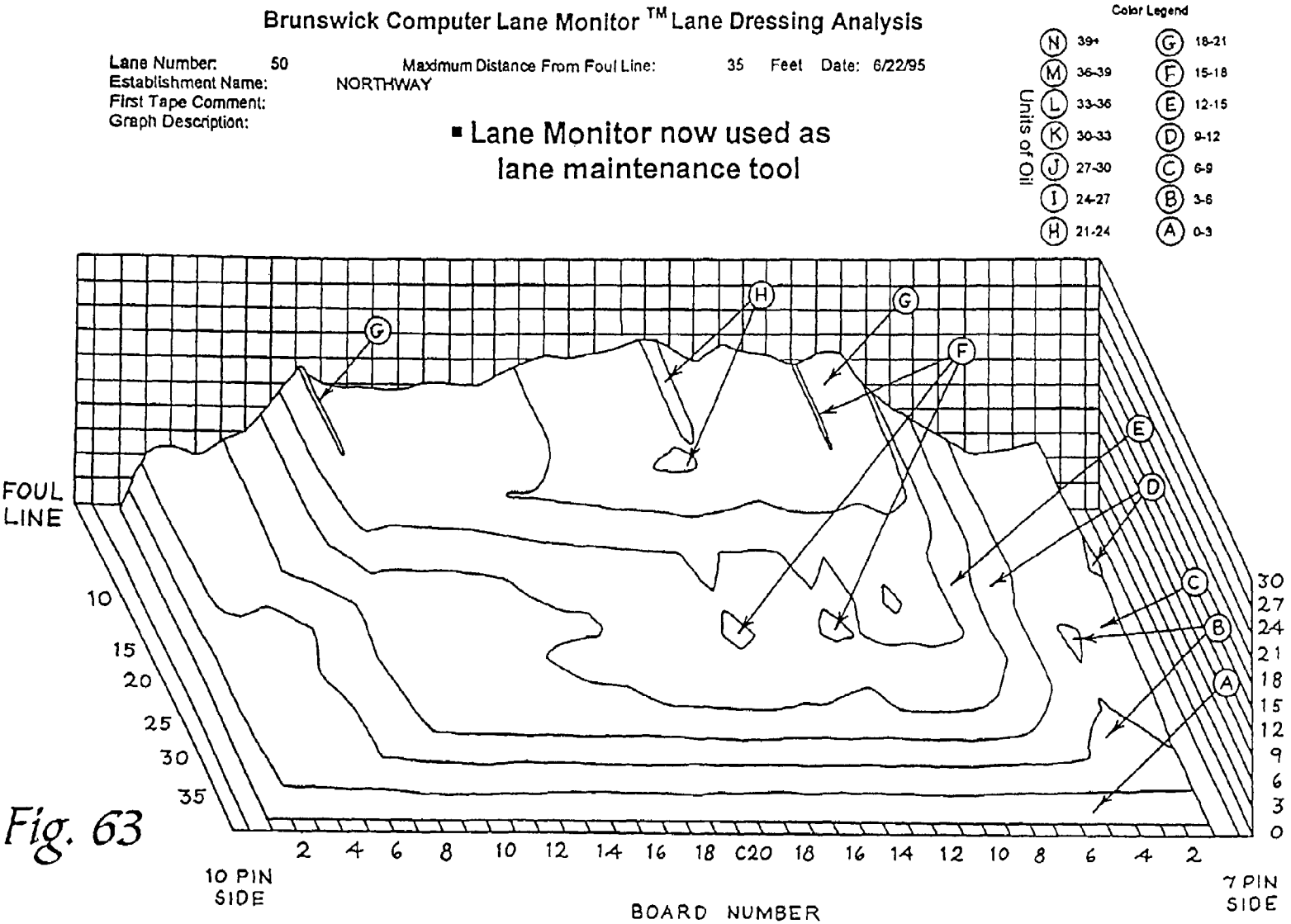
FIG. 63 is another Brunswick Computer Lane Monitor plot illustrating an exemplary dressing fluid layout along the length of a bowling lane.

Alternatively, instead of moving lane conditioning system 100 to another lane, the operator may calibrate lane conditioning system 100 using a calibration option provided on user interface 252. For calibrating lane conditioning system 100, after completion of a conditioning and return pass, the operator may use the only ABC/WIBC accepted method of measuring dressing fluid thickness by using a Lane Monitor (patented and exclusively sold by Brunswick) illustrated in FIG. 60.

As illustrated in FIGS. 60-63, the Lane Monitor utilizes a tape strip to remove the dressing fluid from the entire width of bowling lane BL and plot the amount of dressing fluid units in a 2D graph with units of dressing fluid along the vertical scale and the 39 boards (designated from board number 1 left and right on both edges of the lane, increasing to board number 19 left and right with board number 20 on the center of the lane) along the horizontal scale. This 2D Lane Monitor graph is the accepted standard because of its ease in visualizing the amount of dressing fluid units (thickness) across the width of the lane as plotted from the tape sample. The operator may take 3 tape samples at different distances along the lane (usually at 8 & 15 ft. from the foul line and within 2 ft. of the ending distance of the dressing fluid pattern). By superimposing the different 2D Lane Monitor graphs for each distance, the operator can view the dressing fluid pattern variations along the length of the lane and use Brunswick Computer Lane Monitor software (not shown) to view a 3D graph generated by connecting a surface of the 2D tape graphs at their specified distance along the lane. The operator may also view a top view of the representative lane dressing fluid pattern with the colors indicating the various amounts of dressing fluid units on different areas of a bowling lane.

Based upon the data measured by the Lane Monitor, the operator may enter the data into user interface 252, which would then automatically calculate and thereafter make the necessary adjustments to control system 250 for calibrating lane conditioning system 100 for conformance with the desired lane dressing pattern. Specifically, for calibrating lane conditioning system 100, control system 250 may assign a uniform injection modulation value to each precision delivery injector 232. Control system 250 may then calculate the average units of lane dressing delivered by each precision delivery injector 232. The average amount of lane dressing delivered may be stored in the memory of control system 250 as a conversion factor expressed as the number of injection modulation values per unit of lane dressing delivered (i.e. IM/unit). Control system 250 may also compare the desired amount of lane dressing applied to a lane versus the measured amount for each precision delivery injector 232. Based upon this comparison, control system 250 may calculate a correction factor corresponding to a change in an output signal sent to each individual precision delivery injector 232. Specifically, control system 250 may calculate an adjustment to provide the correct injection modulation value to be sent to each precision delivery injector 232 based upon the conversion factor for creating a desired lane pattern. The calibration process may thereby identify any differences between the injected output of the thirty-nine (39) precision delivery injectors 232, since some injectors 232 may deliver more or less lane dressing as compared to the average of all precision delivery injectors 232, even with the same injection modulation signal. For example, for an injector corresponding to board number ten (10) and delivering four (4) instead of two (2) units of dressing fluid, an adjustment or deviation of two (2) units of dressing fluid would be needed. This identified deviation corresponds to a calculable injection modulation value, as discussed above. After the application of lane dressing, the adjustments needed become readily apparent when the amount actually applied differs from the desired dressing pattern. Therefore, in order to determine the appropriate injection modulation control signal for each precision delivery injector 232, the desired lane dressing thickness (from the desired lane profile) would be multiplied by the lane dressing conversion factor (IM/Unit of lane dressing delivered) and the injector correction factor.

In addition to calibrating each precision delivery injector 232, other variable factors such as lane dressing viscosity, the speed of lane conditioning system 100, lane dressing delivery pressure and other external or internal factors may be compensated for by adjusting the amount of lane dressing injected by precision delivery injectors 232. If only a calibration of precision delivery injectors 232 were performed, then varying an external factor such as lane dressing viscosity, for example, would not be taken into account. Thus, an external factor such as lane dressing viscosity could result in the application of lane dressing that deviates from the desired lane dressing pattern even though precision delivery injectors 232 have been calibrated, as discussed above.

For the calibration method discussed herein, the data stored in the memory of control system 250 for a particular lane dressing profile may also be indicative of the type of delivery pressure used and the particular viscosity of lane dressing utilized. Specifically, when a calibration is conducted on lane conditioning system 100, the viscosity of dressing fluid and delivery pressure provided by dressing fluid pump 226 may be recorded for enabling control system 250 to automatically adjust for the application of lane dressing according to a specific delivery pressure or viscosity of dressing fluid. If an operator of lane conditioning system 100 were to, for example, change the viscosity of the lane dressing used, this information may be input into control system 250, wherein the viscosity triggers control system 250 to send injection modulation control signals to each precision delivery injector 232, which compensates for the change in viscosity.

In addition to the aforementioned features of user interface 252, interface 252 may include user-friendly diagnostics to alert an operator of any problems and/or maintenance requirements for lane conditioning system 100. Such maintenance requirements may include an indication of dressing fluid level, cleaning and waste fluid levels, dressing fluid temperature and pressure, etc.

With lane conditioning system 100 calibrated, as discussed above, the operator may utilize the handle to move lane conditioning system 100 to another bowling lane, or may further calibrate system 100 as needed.

The second embodiment of lane conditioning system, generally designated 300 will now be described in detail in reference to FIGS. 1-7, 46A and 46B.

Figure 46A:
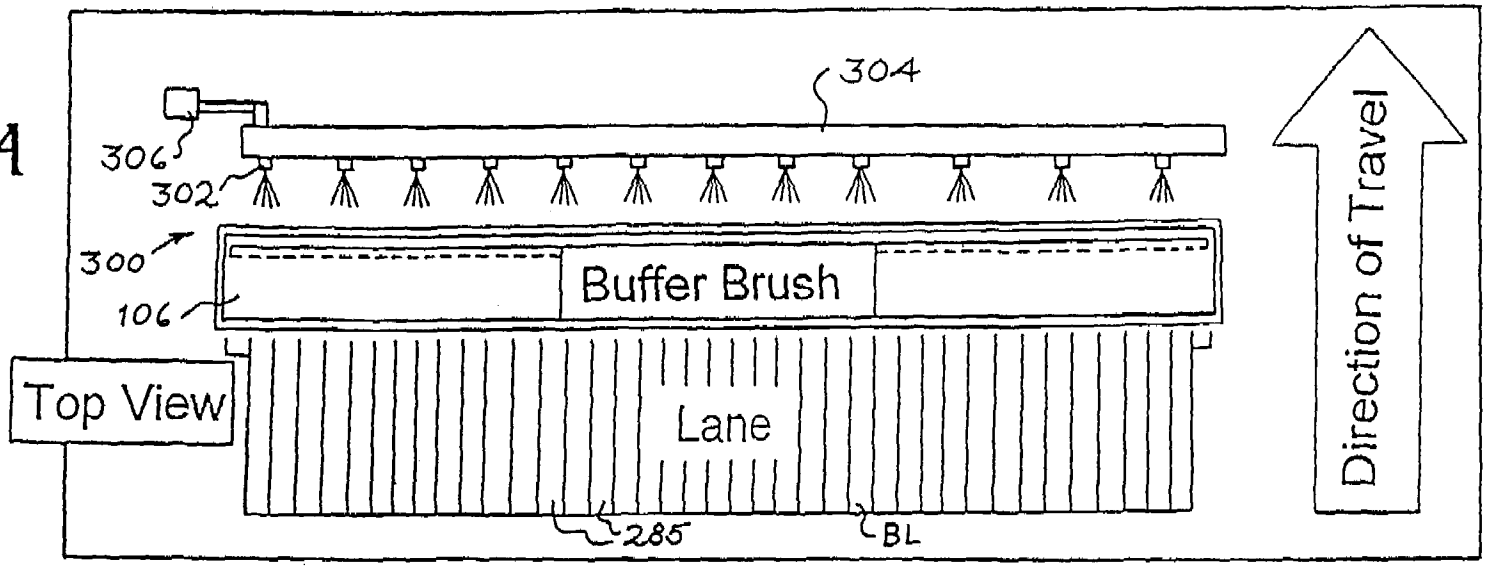
FIG. 46A is a schematic of a second embodiment of a lane conditioning system according to the present invention, illustrative of a top view of a plurality of precision delivery injectors shuttled across the width of a bowling lane and operatively connected to an injector rail, and the buffer for smoothing dressing fluid applied onto the bowling lane.
Figure 46B:
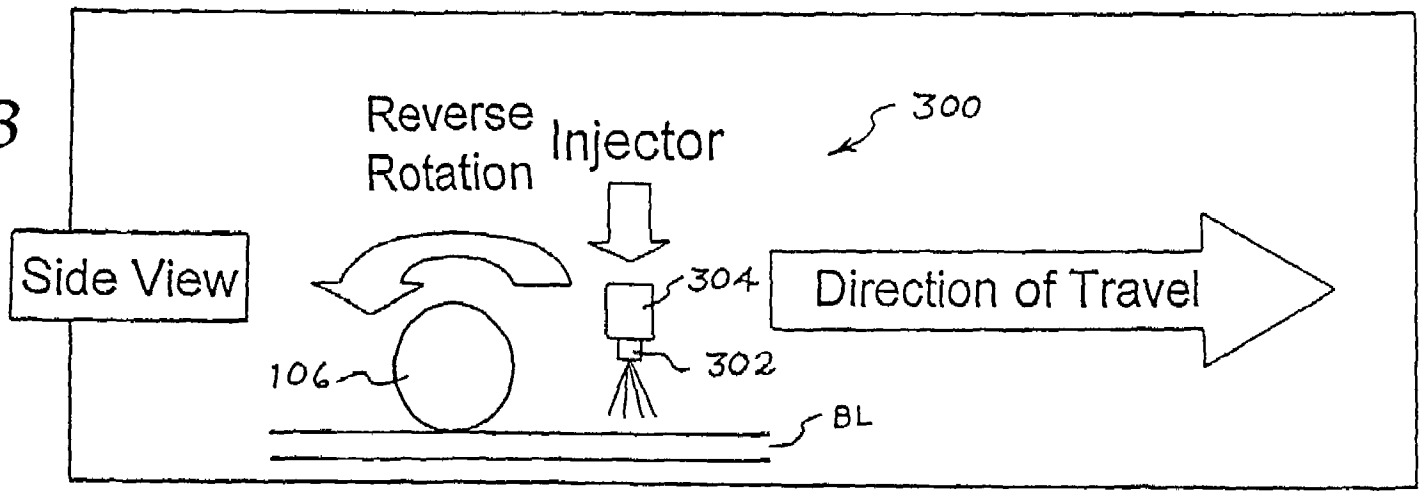
FIG. 46B is a schematic illustrative of a side view of the components of FIG. 46A, illustrating a precision delivery injector applying dressing fluid onto a bowling lane and a buffer rotating opposite to the direction of travel of the lane conditioning system for smoothing dressing fluid applied onto a bowling lane.
Figure 47:
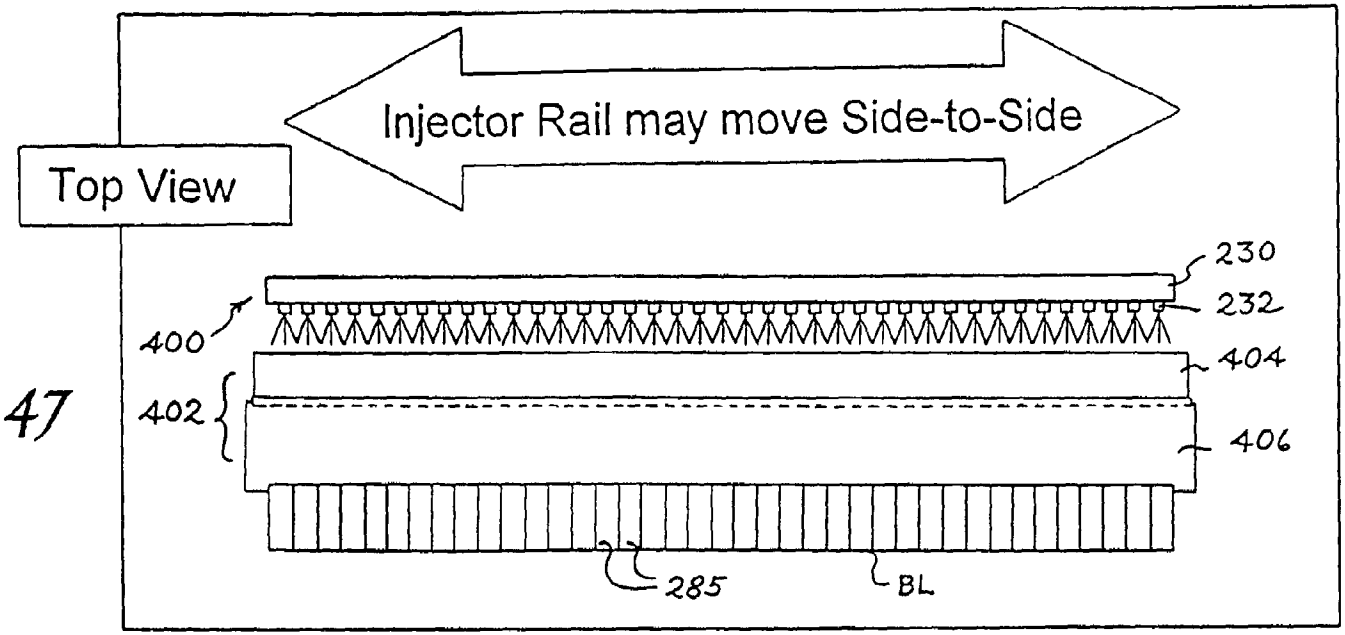
FIG. 47 is a schematic of a third embodiment of a lane conditioning system according to the present invention, illustrative of a top view of a plurality of precision delivery injectors operatively connected to a reciprocating injector rail, a transfer roller and the buffer for applying dressing fluid to a bowling lane from the transfer roller.
Figure 48:
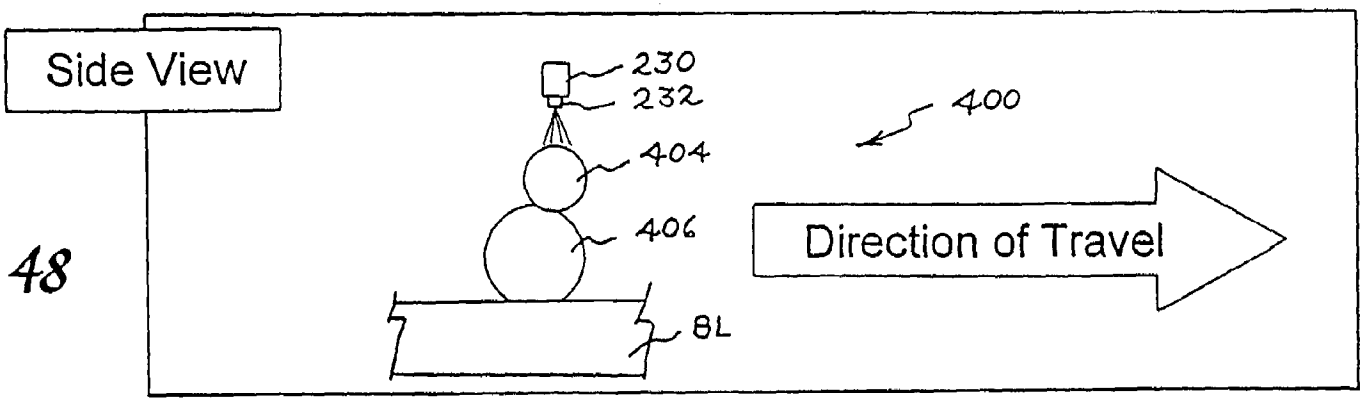
FIG. 48 is a schematic illustrative of a side view of the components of FIG. 47, illustrating a precision delivery injector applying dressing fluid onto the transfer roller and a buffer applying dressing fluid to a bowling lane from the transfer roller.

Referring to FIGS. 1-7, 46A and 46B, for the second embodiment of lane conditioning system 300, the cleaning system 120, vacuum system 126, drive system 150, and squeegee system 192 may be generally identical to the respective systems discussed above for lane conditioning system 100. For the second embodiment of lane conditioning system 300, for dressing application system 140, instead of thirty-nine (39) injectors 232 operatively connected to a reciprocating injector rail 230, twelve (12) precision delivery injectors 302 (similar to injectors 232), for example, may be provided with each of the injectors having a predetermined spacing of approximately 3.3 inches from centers. For the embodiment of FIGS. 46A and 46B, precision delivery injectors 302 may be positioned on an injector rail 304 and shuttled or otherwise reciprocated across the bowling lane width to achieve the desired control of dressing fluid resolution. A motor 306 may be operatively connected to precision delivery injectors 302 to shuttle injectors 302 in predetermined intervals across the length of bowling lane BL. In the embodiment of FIGS. 46A and 46B, injectors 302 may be shuttled approximately at one (1) inch intervals from their rest position adjacent left wall 132 toward right wall 134 for application of lane dressing at one (1) inch intervals across the width of bowling lane BL. Accordingly, after three consecutive one (1) inch shuttles in one direction, injectors 302 may then be shuttled back in one (1) inch intervals to their original position. Dressing fluid supplied to precision delivery injectors 302 may be directly injected onto bowling lane BL and thereafter smoothed by buffer 106.

Other than the aforementioned differences in lane conditioning system 300 versus system 100, the aforementioned features and operational characteristics of lane conditioning system 300 may be identical to those of system 100. Moreover, those skilled in the art would appreciate in view of this disclosure that control system 250 in conjunction with user interface 252 may be utilized to control various characteristics, such as the injection duration and frequency of injectors 302, as well as the interval and speed of shuttles of injector rail 304 relative to the speed of lane conditioning system 300. Injector rail 304 may also shuttle in a continuous motion instead of consecutive intervals. Injectors 302 may be pulsed by control system 250 dependent on the injector rail 304 location or injectors 302 may be pulsed at fixed intervals along the length of bowling lane BL, thus allowing the injector shuttle system to blend the injected lane dressing across the width of the shuttle range.

The third embodiment of lane conditioning system, generally designated 400 will now be described in detail in reference to FIGS. 1-7, 47 and 48.

Referring to FIGS. 1-7, 47 and 48, for the third embodiment of lane conditioning system 400, the cleaning system 120, vacuum system 126, drive system 150, and squeegee system 192 may be generally identical to the respective systems discussed above for lane conditioning system 100. For the third embodiment of lane conditioning system 400, for dressing application system 140, instead of injecting dressing fluid directly onto bowling lane BL, lane conditioning system 400 may include a dressing fluid transfer system 402 including a transfer roller 404 and buffer 406. Specifically, for the third embodiment, dressing fluid may be injected onto transfer roller 404 disposed in contact with buffer 406 and thereafter spread onto bowling lane BL by buffer 406. Transfer roller 404 may be operated by a separate transfer roller motor (not shown) or may instead be operated by buffer drive motor 238 having an additional belt or chain operatively connected from a drive sheave or sprocket (not shown) of motor 238 to driven sheave or sprocket (not shown) of transfer roller 404.

Other than the aforementioned differences in lane conditioning system 400 versus system 100, the aforementioned features and operational characteristics of lane conditioning system 400 may be identical to those of system 100. Moreover, those skilled in the art would appreciate in view of this disclosure that control system 250 in conjunction with user interface 252 may be utilized to control various characteristics, such as the rotational speed and direction of transfer roller 404 and/or buffer 406 for lane conditioning system 400.

The fourth embodiment of lane conditioning system, generally designated 500 will now be described in detail in reference to FIGS. 1-7, 49 and 50.

Figure 49:
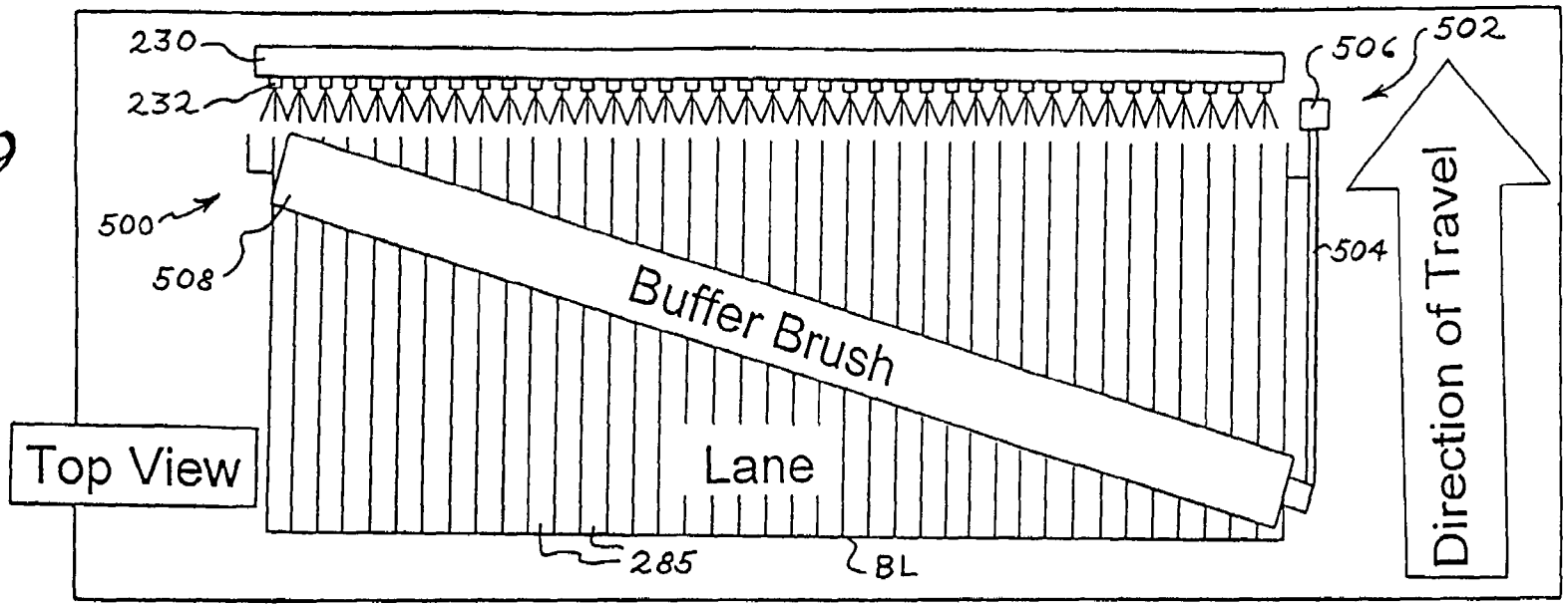
FIG. 49 is a schematic of a fourth embodiment of a lane conditioning system according to the present invention, illustrative of a top view of a plurality of precision delivery injectors operatively connected to an injector rail, and the buffer illustrated in a pivoted configuration for smoothing dressing fluid applied onto the bowling lane.
Figure 50:
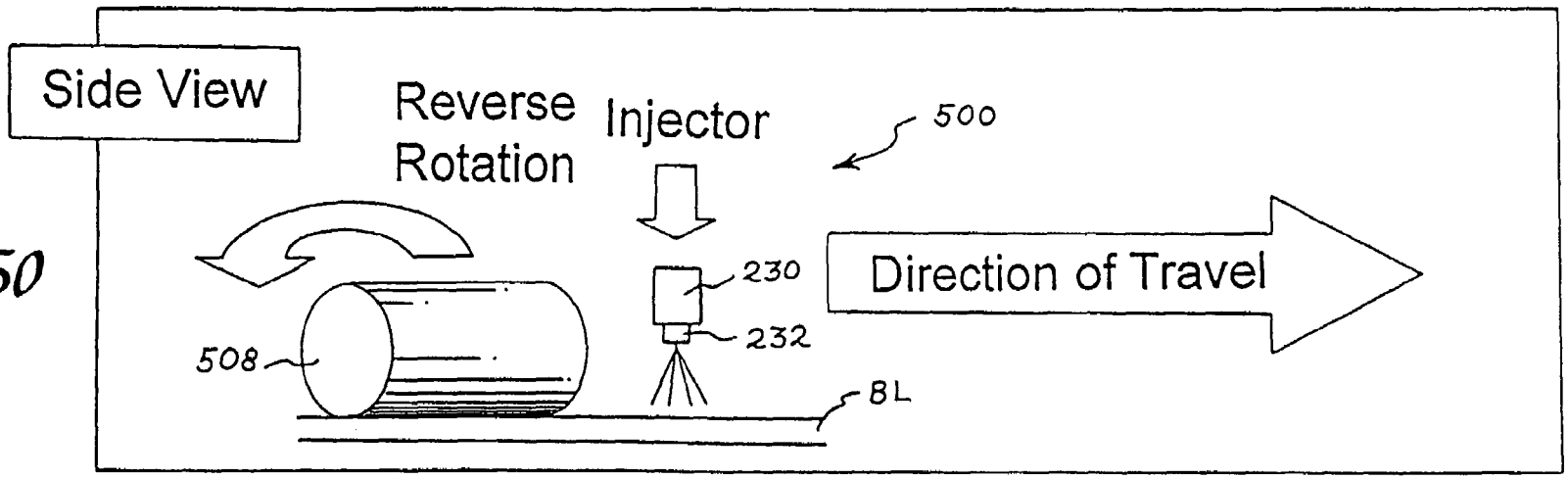
FIG. 50 is a schematic illustrative of a side view of the components of FIG. 49, illustrating a precision delivery injector applying dressing fluid onto a bowling lane and a pivoted buffer rotating opposite to the direction of travel of the lane conditioning system for smoothing dressing fluid applied onto a bowling lane.

Referring to FIGS. 1-7, 49 and 50, for the fourth embodiment of lane conditioning system 500, the cleaning system 120, vacuum system 126, drive system 150, and squeegee system 192 may be generally identical to the respective systems discussed above for lane conditioning system 100. For the fourth embodiment of lane conditioning system 500, for dressing application system 140, instead of the buffer being disposed generally orthogonal to side walls 132, 134 of lane conditioning system 500, buffer 508 may be pivotable transverse to the side walls for further facilitating uniform spreading of dressing fluid once applied to bowling lane BL by precision delivery injectors 232. In the embodiment of FIGS. 49 and 50, buffer 508 may be pivotable up to an angle of approximately 20° relative to side walls 132, 134 of lane conditioning system 500 by means of pivot mechanism 502. Pivot mechanism 502 may include a pivot link 504 operatively coupled to pivot motor 506 to pivot buffer 508 after an operator re-presses start switch 254 after user interface 252 prompts the operator to re-press start switch 254 for performing the cleaning and conditioning operation after completion of the preliminary operations, as discussed above. Once the operator presses start switch 254, control system 250 may activate drive motor 152 to propel lane conditioning system 500 forward from the foul line toward the pin deck. As lane conditioning system 500 is being propelled forward and reaches a predetermined distance from the foul line (i.e. 3 inches), control system 250 may operate pivot motor 506 to pivot buffer 508 at a preset pivot angle of approximately 20°, or at an operator defined pivot angle of less than 20°. As lane conditioning system 500 nears the end of the predetermined conditioning pattern (i.e. 40 feet from the foul line), control system 250 may operate pivot motor 506 in the reverse direction to pivot buffer 508 back to its original position orthogonal to the side walls of lane conditioning system 500.

After completion of the conditioning pass, lane conditioning system 500 may initiate the return pass in the manner discussed above for system 100, but may also have control system 250 operate pivot motor 506 to pivot buffer 508 at the preset pivot angle of approximately 20°, or at an operator defined pivot angle of less than 20°, when lane conditioning system 500 reaches a predetermined distance from the foul line (i.e. 40 feet from the foul line). As lane conditioning system 500 approaches the foul line and is at a predetermined distance from the foul line (i.e. 3 inches) control system 250 may operate pivot motor 506 to pivot buffer 508 back to its original position being generally orthogonal to side walls 132, 134 of lane conditioning system 500.

Other than the aforementioned differences in lane conditioning system 500 versus system 100, the aforementioned features and operational characteristics of lane conditioning system 500 may be identical to those of system 100.

The fifth embodiment of lane conditioning system, generally designated 600 will now be described in detail in reference to FIGS. 1-7, 51 and 52.

Referring to FIGS. 1-7, 51 and 52, for the fifth embodiment of lane conditioning system 600, the cleaning system 120, vacuum system 126, drive system 150, and squeegee system 192 may generally be identical to the respective systems discussed above for lane conditioning system 100. For the fifth embodiment of lane conditioning system 600, in addition to the components described above for lane conditioning system 100, for dressing application system 140, lane conditioning system 600 may include an agitation mechanism 602 including duster cloth 604, brush or absorptive material affixed to a reciprocating head (not shown). Agitation mechanism 602 may be operable by an agitator motor (not shown) or by buffer drive motor 238 operatively connected thereto by including a cam and follower assembly (not shown) for reciprocating mechanism 602 against the bias of a spring (not shown). A linkage (not shown) may be provided for pivoting agitation mechanism 602 into contact with bowling lane BL during the conditioning pass when energized by agitation mechanism up/down motor (not shown), or instead by the buffer up/down motor, and otherwise pivoting agitation mechanism 602 out of contact from bowling lane BL or other surfaces. Agitation mechanism up and down switches (not shown), or other means may be provided for limiting and/or signaling the maximum up and down travel positions of agitation mechanism 602. Agitation mechanism 602 may be disposed forward of buffer 106 to agitate dressing fluid applied to bowling lane BL before further smoothing by buffer 106.

Figure 51:
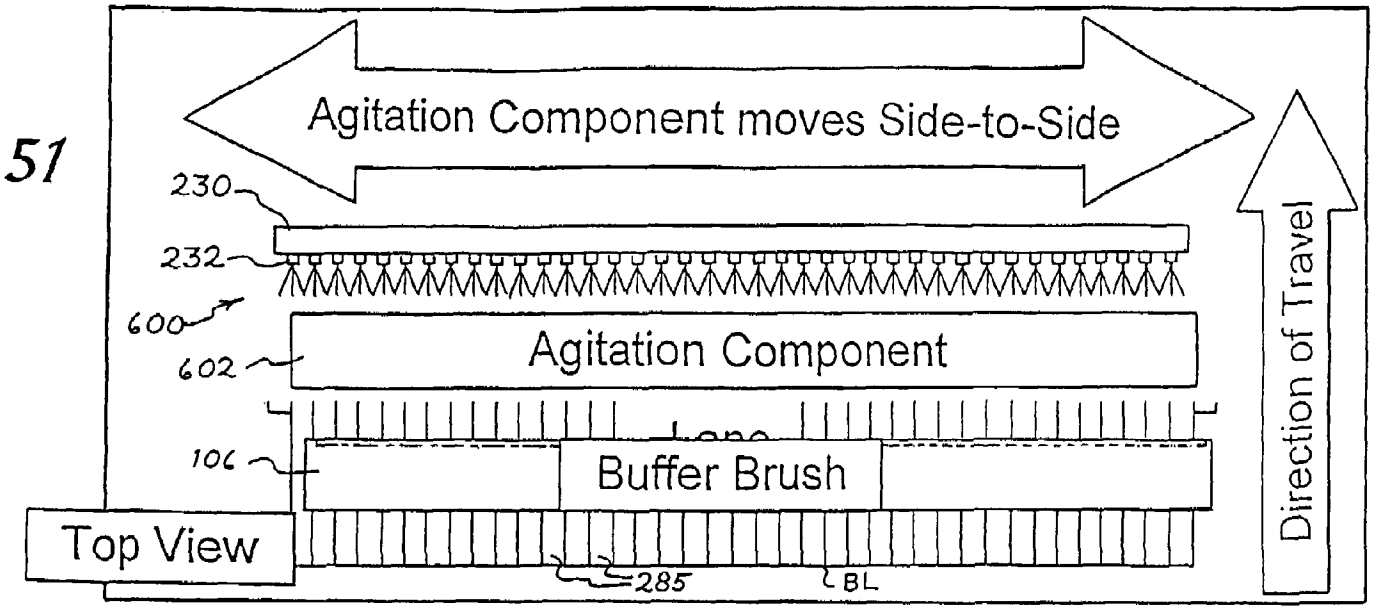
FIG. 51 is a schematic of a fifth embodiment of a lane conditioning system according to the present invention, illustrative of a top view of a plurality of precision delivery injectors operatively connected to an injector rail, an agitation mechanism for agitating dressing fluid applied onto a bowling lane, and a buffer for smoothing dressing fluid applied onto the bowling lane.
Figure 52:
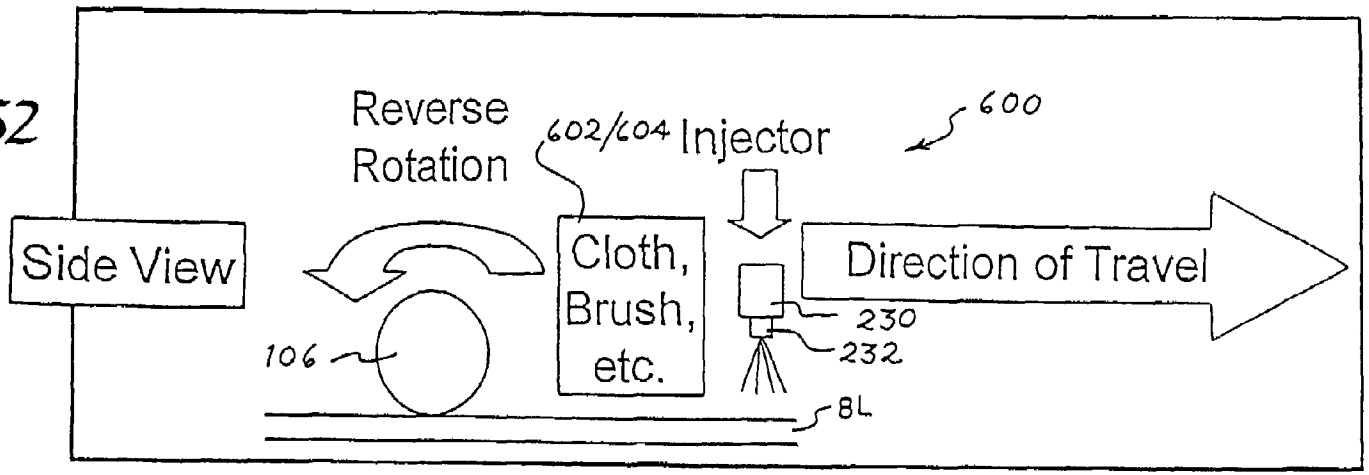
FIG. 52 is a schematic illustrative of a side view of the components of FIG. 51, illustrating a precision delivery injector applying dressing fluid onto a bowling lane, the agitation mechanism, and a buffer rotating opposite to the direction of travel of the lane conditioning system for smoothing dressing fluid applied onto a bowling lane.

During operation of lane conditioning system 600, agitation mechanism 602 may generally be operable only during the conditioning pass, and otherwise be disposed up and away from bowling lane BL or other surfaces. In the embodiment of FIGS. 51 and 52, agitation mechanism 602 may be reciprocated within a range of ¼-3 inches.

Other than the aforementioned differences in lane conditioning system 600 versus system 100, the aforementioned features and operational characteristics of lane conditioning system 600 may be identical to those of system 100. Moreover, those skilled in the art would appreciate in view of this disclosure that control system 250 in conjunction with user interface 252 may be utilized to control various characteristics, such as the reciprocating speed of agitation mechanism 602 for lane conditioning system 600.

The sixth embodiment of lane conditioning system, generally designated 700 will now be described in detail in reference to FIGS. 1-7 and 53.

Referring to FIGS. 1-7 and 53, for the sixth embodiment of lane conditioning system 700, the cleaning system 120, vacuum system 126, drive system 150, and squeegee system 192 may generally be identical to the respective systems discussed above for lane conditioning system 100. For the sixth embodiment of lane conditioning system 700, in addition to the components described above for lane conditioning system 100, for dressing application system 140, lane conditioning system 700 may include a rotary agitation mechanism 702 including a plurality of resilient paddles 704 affixed to a rotary head 706. Rotary agitation mechanism 702 may be operable by an agitator drive motor (not shown) or by buffer drive motor 238 and include a driven sheave (not shown) operatively connected to drive sheave (not shown) of agitator drive motor (not shown), or buffer drive motor 238, by a belt (not shown). A linkage (not shown) may be provided for pivoting rotary agitation mechanism 702 into contact with bowling lane BL during the conditioning pass when energized by agitation mechanism up/down motor (not shown), or instead by the buffer up/down motor, and otherwise pivoting rotary agitation mechanism 702 out of contact from bowling lane BL or other surfaces. Rotary agitation mechanism up and down switches (not shown), or other means may be provided for limiting and/or signaling the maximum up and down travel positions of rotary agitation mechanism 702. Rotary agitation mechanism 702 may be disposed forward of buffer 106 to agitate dressing fluid applied to bowling lane BL before further smoothing by buffer 106.

Figure 53:
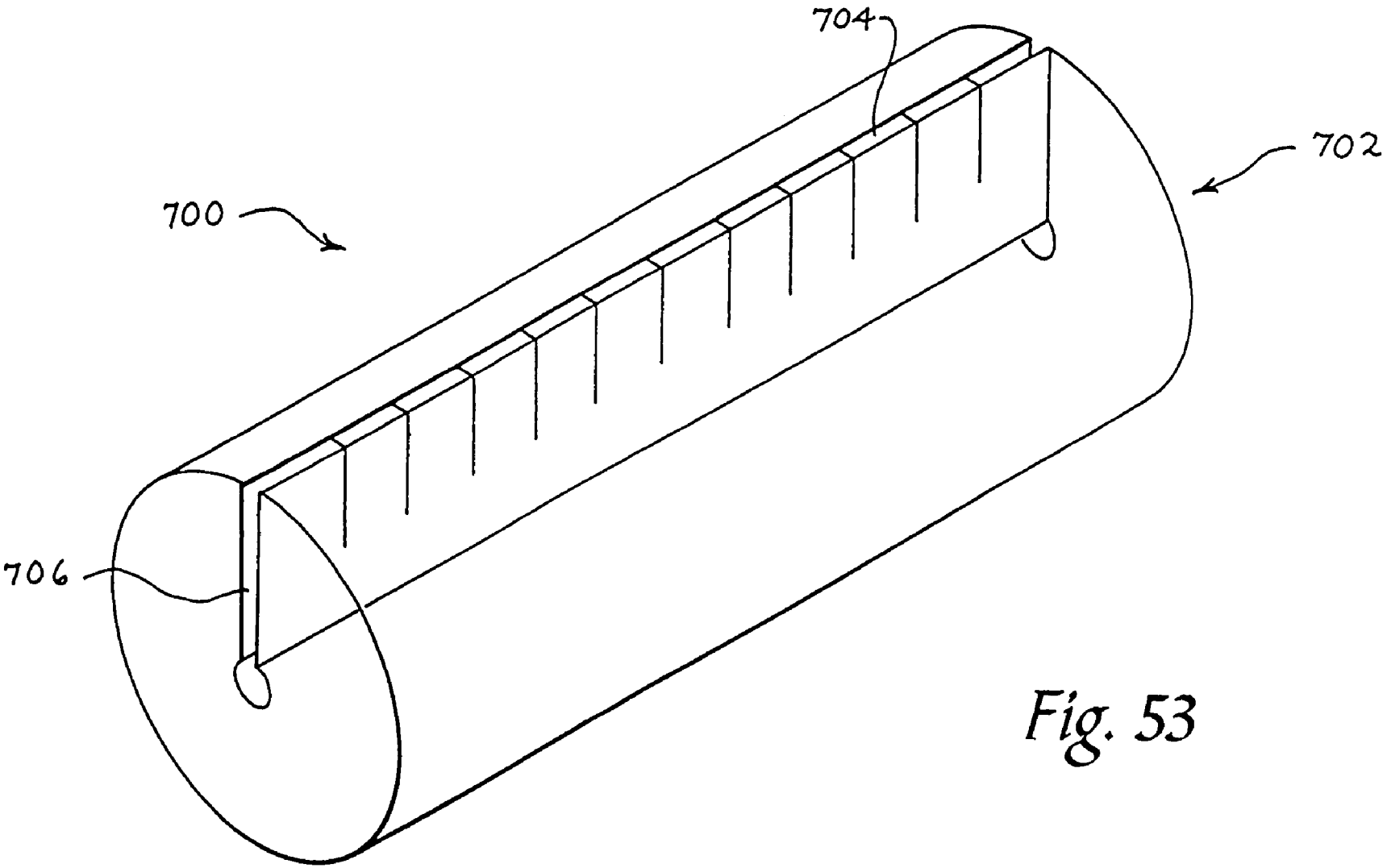
FIG. 53 is a schematic of a sixth embodiment of a lane conditioning system according to the present invention, illustrative of an isometric view of a rotary agitation mechanism for agitating dressing fluid applied onto a bowling lane.

During operation of lane conditioning system 700, rotary agitation mechanism 702 may generally be operable only during the conditioning pass, and otherwise be disposed up and away from bowling lane BL or other surfaces. In the embodiment of FIG. 53, rotary agitation mechanism 702 may be reciprocated within a range of ¼-3 inches.

Other than the aforementioned differences in lane conditioning system 700 versus system 100, the aforementioned features and operational characteristics of lane conditioning system 700 may be identical to those of system 100. Moreover, those skilled in the art would appreciate in view of this disclosure that control system 250 in conjunction with user interface 252 may be utilized to control various characteristics, such as the rotation speed of agitation mechanism 702 for lane conditioning system 700.

The seventh embodiment of lane conditioning system, generally designated 800 will now be described in detail in reference to FIGS. 1-7 and 54-56.

Figure 54:
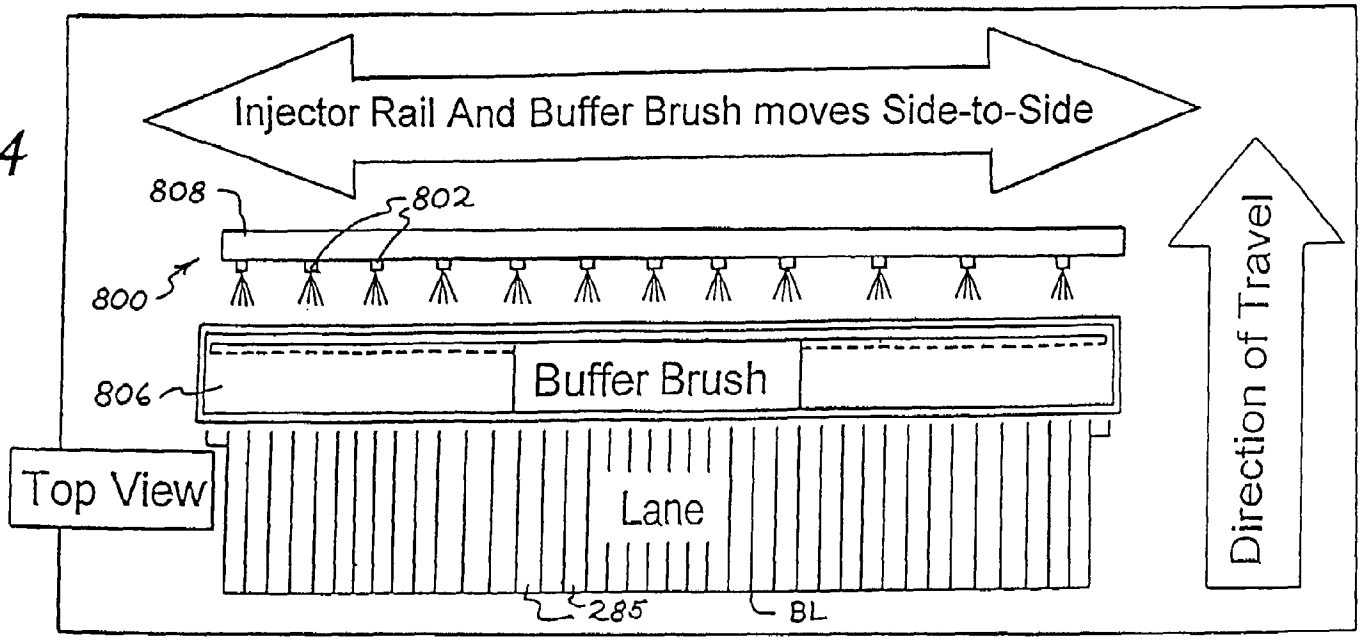
FIG. 54 is a schematic of a seventh embodiment of a lane conditioning system according to the present invention, illustrative of a top view of a plurality of precision delivery shuttled injectors operatively connected to an injector rail, and a reciprocating buffer for smoothing dressing fluid applied onto the bowling lane.
Figure 55:
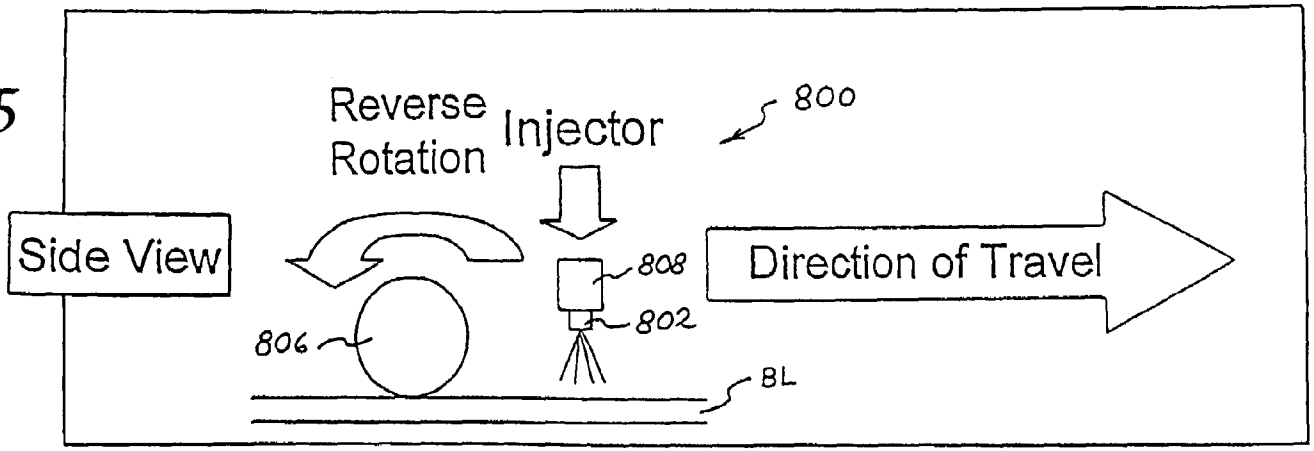
FIG. 55 is a schematic illustrative of a side view of the components of FIG. 54, illustrating a precision delivery injector applying dressing fluid onto a bowling lane, and a reciprocating buffer rotating opposite to the direction of travel of the lane conditioning system for smoothing dressing fluid applied onto a bowling lane.
Figure 56:
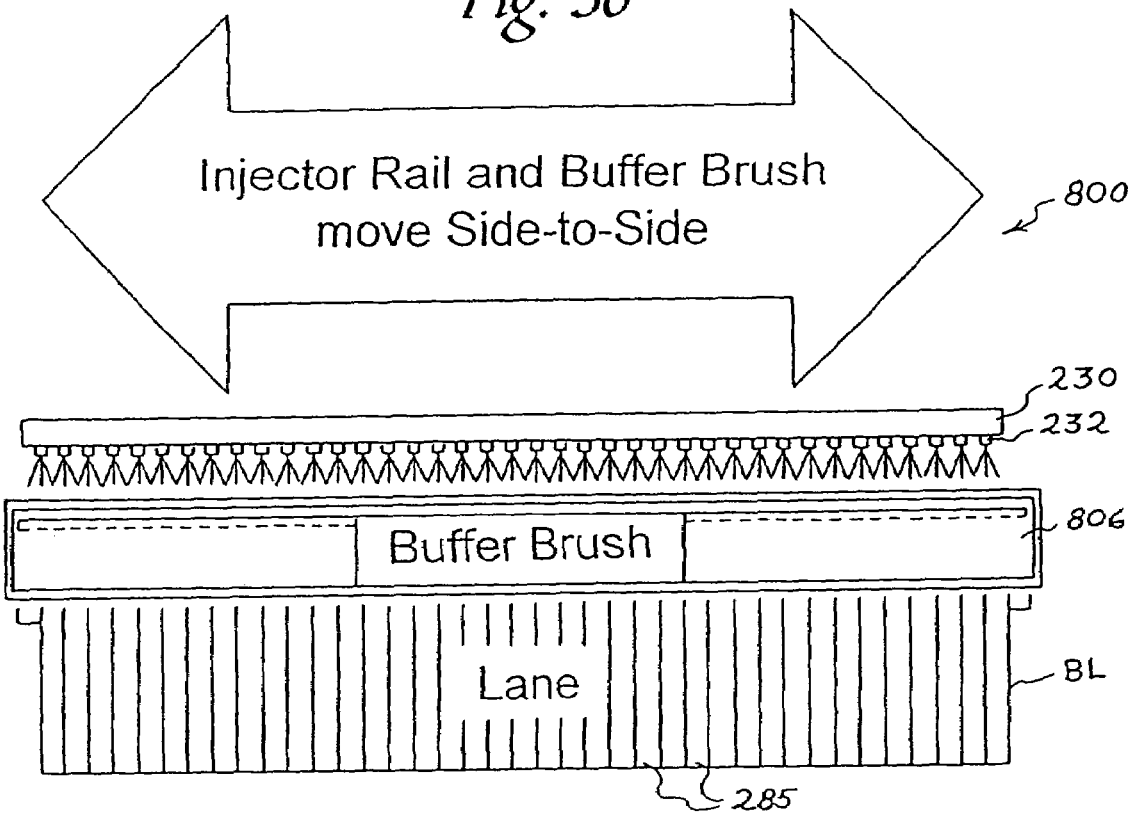
FIG. 56 is another schematic of the seventh embodiment of a lane conditioning system according to the present invention, illustrative of a top view of a plurality of precision delivery injectors operatively connected to a reciprocating injector rail, and a reciprocating buffer for smoothing dressing fluid applied onto the bowling lane.

Referring to FIGS. 1-7 and 54-56, for the seventh embodiment of lane conditioning system 800, the cleaning system 120, vacuum system 126, drive system 150, and squeegee system 192 may generally be identical to the respective systems discussed above for lane conditioning system 100. For the seventh embodiment of lane conditioning system 800, for dressing application system 140, instead of thirty-nine (39) injectors 232 operatively connected to a reciprocating injector rail 230, twelve (12) precision delivery injectors 802 may be operatively connected to an injector rail 808 and include a predetermined spacing of approximately 3.3 inches from centers, for example, as discussed above for the second embodiment of lane conditioning system 300. For the embodiment of FIGS. 54 and 55, in addition to injectors 802 being shuttled, buffer 806 may likewise be reciprocated back and forth generally orthogonal to side walls 132, 134 of lane conditioning system 800. A buffer reciprocation motor (not shown) may be operatively connected to buffer 806 to reciprocate buffer 806 by means of a cam and follower arrangement. Dressing fluid supplied to shuttled injectors 802 may be directly injected onto bowling lane BL and thereafter smoothed by reciprocating buffer 806. In the embodiment of FIGS. 54 and 55, buffer 806 may be reciprocated three (3) inches from left to right. It should be noted that for the seventh embodiment of lane conditioning system 800, for dressing application system 140, instead of twelve (12) precision delivery injectors 802 shuttled as described above, as shown in FIG. 56, thirty-nine (39) injectors 232 may be operatively connected to a reciprocating injector rail 230, as discussed above for lane conditioning system 100.

Other than the aforementioned differences in lane conditioning system 800 versus system 100, the aforementioned features and operational characteristics of lane conditioning system 800 may be identical to those of system 100. Moreover, those skilled in the art would appreciate in view of this disclosure that control system 250 in conjunction with user interface 252 may be utilized to control various characteristics, such as the rotation and/or reciprocation speed of buffer 806 for lane conditioning system 800.

The eighth embodiment of lane conditioning system, generally designated 900 will now be described in detail in reference to FIGS. 1-7 and 57-59.

Figure 57:
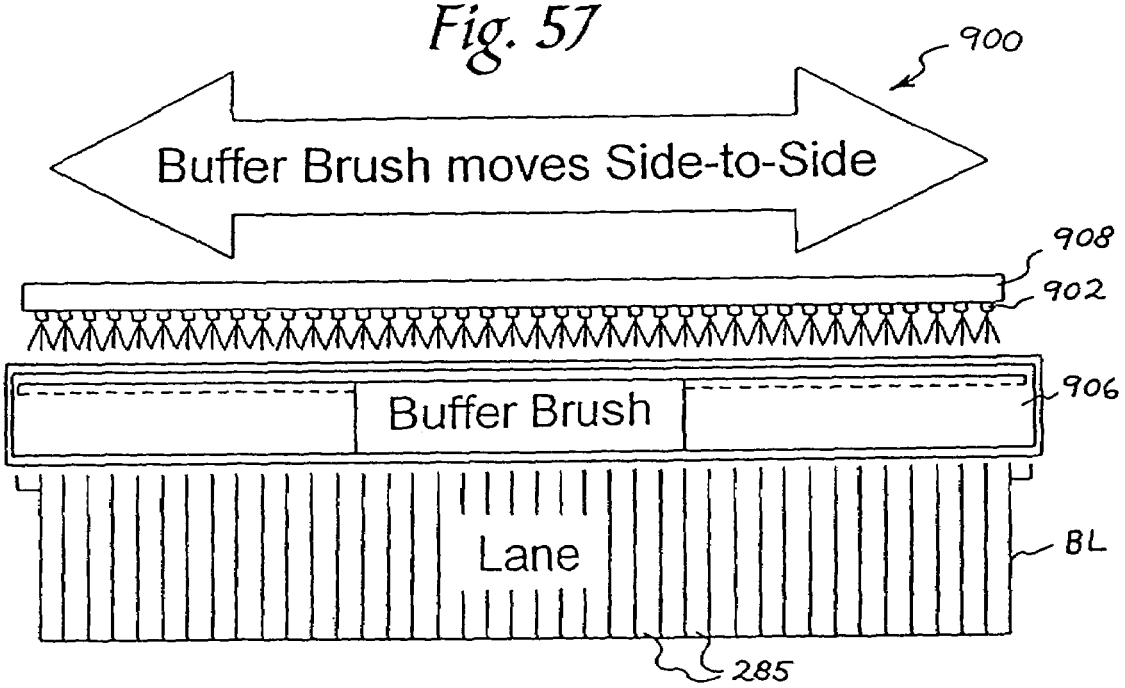
FIG. 57 is a schematic of an eighth embodiment of a lane conditioning system according to the present invention, illustrative of a top view of a plurality of precision delivery injectors operatively connected to a fixed injector rail, and a reciprocating buffer for smoothing dressing fluid applied onto the bowling lane.
Figure 58:
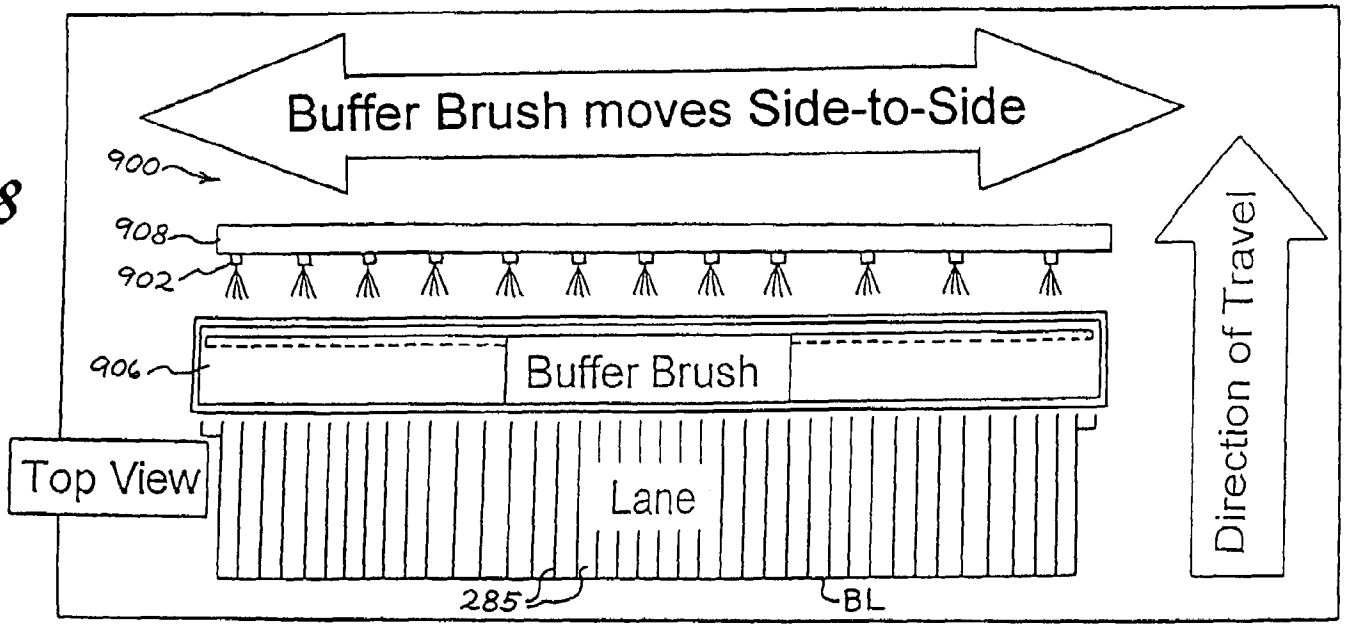
FIG. 58 is another schematic of the eighth embodiment of the lane conditioning system according to the present invention, illustrative of a top view of a plurality of precision delivery injectors operatively connected to a fixed injector rail, and a reciprocating buffer for smoothing dressing fluid applied onto the bowling lane.
Figure 59:
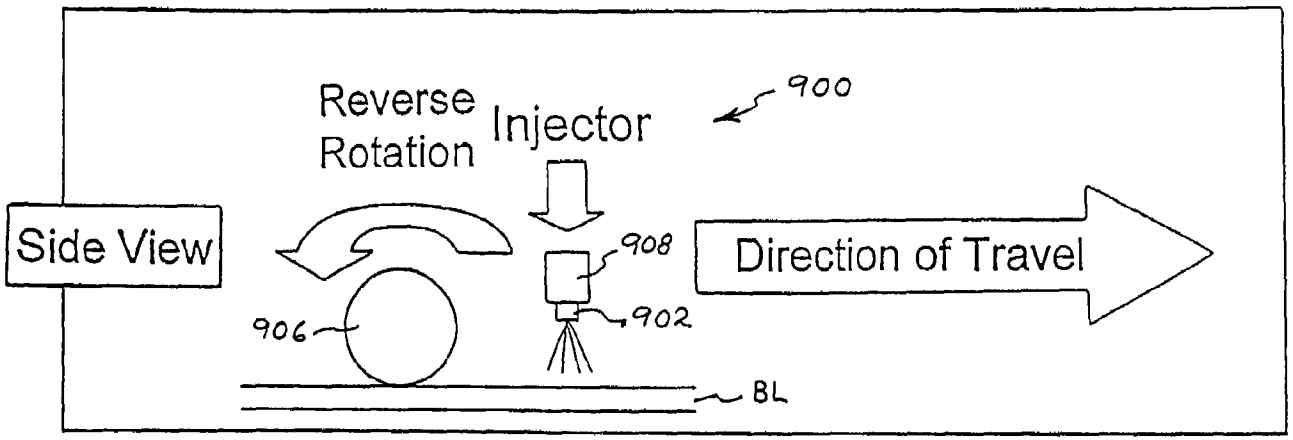
FIG. 59 is a schematic illustrative of a side view of the components of FIG. 58, illustrating a precision delivery injector applying dressing fluid onto a bowling lane, and a reciprocating buffer rotating opposite to the direction of travel of the lane conditioning system for smoothing dressing fluid applied onto a bowling lane.

Referring to FIGS. 1-7 and 57-59, for the eighth embodiment of lane conditioning system 900, the cleaning system 120, vacuum system 126, drive system 150, and squeegee system 192 may generally be identical to the respective systems discussed above for lane conditioning system 100. For the eighth embodiment of lane conditioning system 900, for dressing application system 140, instead of thirty-nine (39) injectors 232 operatively connected to a reciprocating injector rail 230, twelve (12) to thirty-nine (39) precision delivery injectors 902 may be operatively connected to a fixed injector rail 908 and configured to supply dressing fluid across the width of a board 285 of bowling lane BL. For the embodiment of FIGS. 57-59, in addition to injectors 902 being connected to a fixed injector rail 908, buffer 906 may likewise be reciprocated back and forth generally orthogonal to side walls 132, 134 of lane conditioning system 900. A buffer reciprocation motor (not shown) may be operatively connected to buffer 906 to reciprocate buffer 906 by means of a cam and follower arrangement. Dressing fluid supplied to fixed injectors 902 may be directly injected onto bowling lane BL and thereafter smoothed by reciprocating buffer 906. In the embodiment of FIGS. 57-59, buffer 906 may be reciprocated one (1) to three (3) inches from left to right.

Other than the aforementioned differences in lane conditioning system 900 versus system 100, the aforementioned features and operational characteristics of lane conditioning system 900 may be identical to those of system 100. Moreover, those skilled in the art would appreciate in view of this disclosure that control system 250 in conjunction with user interface 252 may be utilized to control various characteristics, such as the rotation and/or reciprocation speed of buffer 906 for lane conditioning system 900.

The ninth embodiment of lane conditioning system, generally designated 1000 will now be described in detail in reference to FIGS. 1-7 and 57-59.

Figure 73:
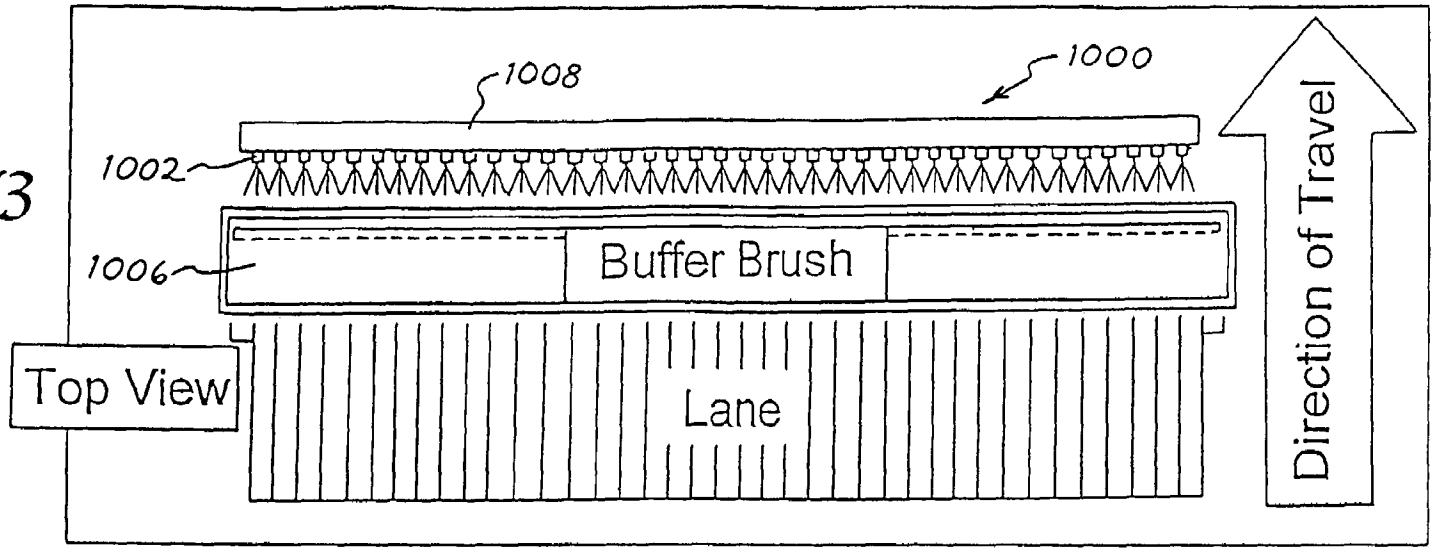
FIG. 73 is a schematic of a ninth embodiment of a lane conditioning system according to the present invention, illustrative of a top view of a plurality of precision delivery injectors operatively connected to a vertically reciprocable injector rail, and a buffer for smoothing dressing fluid applied onto the bowling lane.
Figure 74:
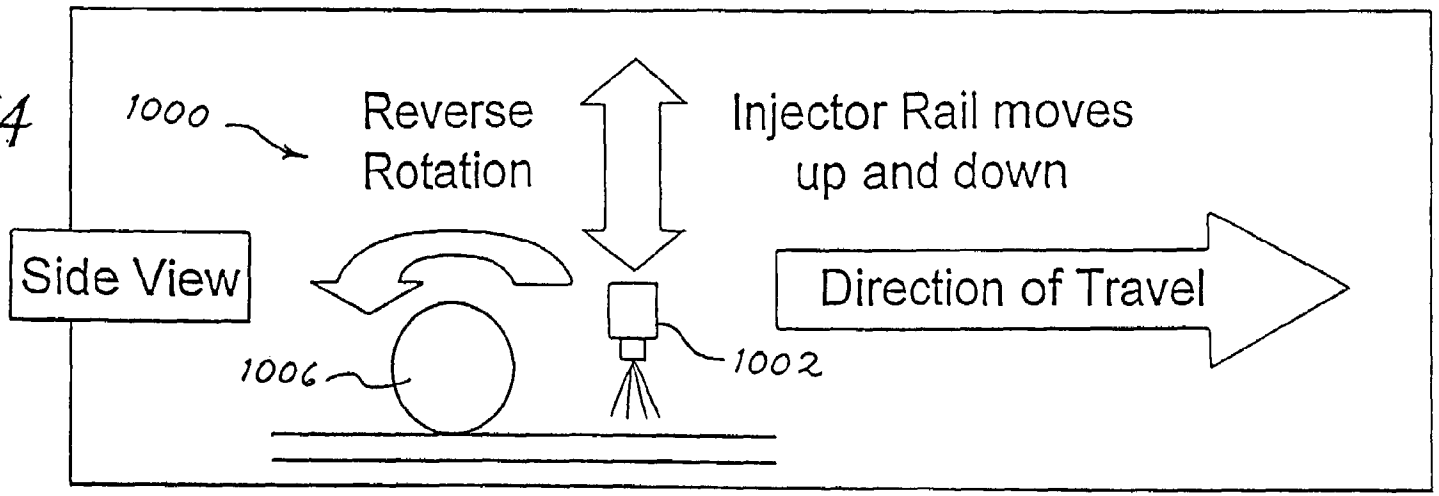
FIG. 74 is a schematic illustrative of a side view of the components of FIG. 73, illustrating a precision delivery injector applying dressing fluid onto a bowling lane, the vertically reciprocable injector rail, and a buffer rotating opposite to the direction of travel of the lane conditioning system for smoothing dressing fluid applied onto a bowling lane.

Referring to FIGS. 1-7 and 73-76, for the ninth embodiment of lane conditioning system 1000, the cleaning system 120, vacuum system 126, drive system 150, and squeegee system 192 may generally be identical to the respective systems discussed above for lane conditioning system 100. For the ninth embodiment of lane conditioning system 1000, for dressing application system 140, instead of thirty-nine (39) injectors 232 operatively connected to a horizontally reciprocating injector rail 230, thirty-nine (39) precision delivery injectors 1002 may be operatively connected to a vertically reciprocable injector rail 1008 and configured to supply dressing fluid across the width of a board 285 of bowling lane BL. A motor (not shown) may be operatively connected to rail 1008 to vertically reciprocate rail 1008 by means of a cam and follower arrangement, for example. Dressing fluid supplied to fixed injectors 1002 may be directly injected onto bowling lane BL and thereafter smoothed by buffer 1006. In the embodiment of FIGS. 73 and 74, rail 1008 may be vertically reciprocated within a range of 1-6 inches from its bottom-most position, shown in FIG. 73, to its top-most position (not shown). By reciprocating rail 1008 vertically, the width of the dressing fluid pattern injected from each injector 1002 may be further controlled by moving rail 1008 upwards to provide a wider injection pattern, and likewise moved downwards to provide a narrower injection pattern.

Figure 75:
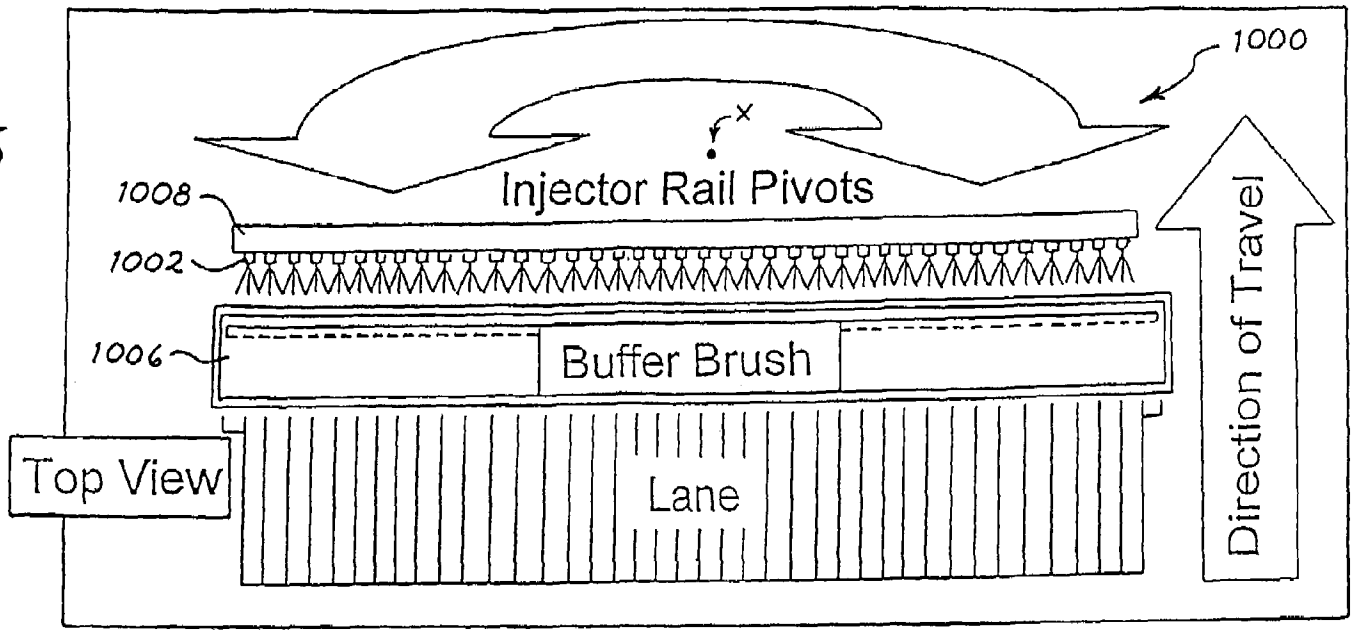
FIG. 75 is a schematic of an alternative configuration for the ninth embodiment of FIG. 73, illustrative of a top view of a plurality of precision delivery injectors operatively connected to a pivotable injector rail, and a buffer for smoothing dressing fluid applied onto the bowling lane.
Figure 76:
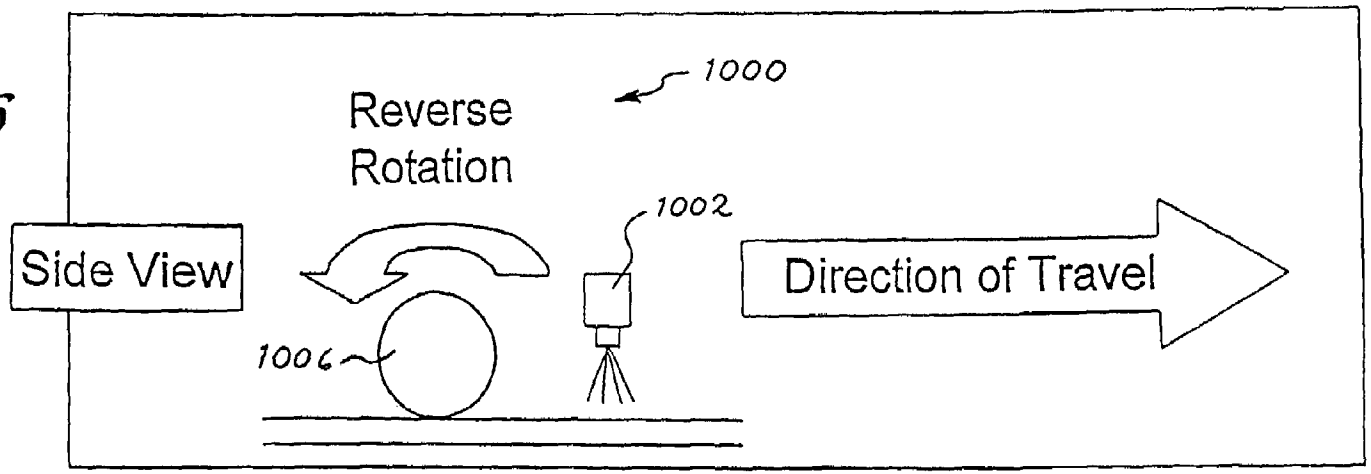
FIG. 76 is a schematic illustrative of a side view of the components of FIG. 75, illustrating a precision delivery injector applying dressing fluid onto a bowling lane, and a buffer rotating opposite to the direction of travel of the lane conditioning system for smoothing dressing fluid applied onto a bowling lane.

Alternatively, for the ninth embodiment of lane conditioning system 1000, instead of reciprocating rail 1008 vertically, as shown in FIGS. 75 and 76, rail 1008 may be pivoted about an offset axis-X generally perpendicular to the longitudinal length of bowling lane BL, when system 1000 is positioned on lane BL. In the embodiment of FIG. 75, axis-X may be positioned generally centrally approximately six (6) inches above rail 1008 to allow outermost injectors 1002 to vertically reciprocate up and down during the conditioning pass of system 1000. By pivoting rail 1008 about axis-X, the width of the dressing fluid pattern injected from each injector 1002 may be further controlled to provide a wider injection pattern when an injector 1002 is in its top-most position, and likewise provide a narrower injection pattern when an injector 1002 is in its bottom-most position. By pivoting rail 1008 about axis-X, the angle of injector 1002 changes in relation to bowling lane BL, thus further spreading the dressing fluid pattern injected from each injector across the width of the lane.

Other than the aforementioned differences in lane conditioning system 1000 versus system 100, the aforementioned features and operational characteristics of lane conditioning system 1000 may be identical to those of system 100. Moreover, those skilled in the art would appreciate in view of this disclosure that control system 250 in conjunction with user interface 252 may be utilized to control various characteristics, such as the rotation and/or reciprocation speed of buffer 1006 for lane conditioning system 1000.

The tenth embodiment of lane conditioning system, generally designated 1100 will now be described in detail in reference to FIGS. 1-7, 77 and 78.

Referring to FIGS. 1-7, 77 and 78, for the tenth embodiment of lane conditioning system 1100, the cleaning system 120, vacuum system 126, drive system 150, and squeegee system 192 may generally be identical to the respective systems discussed above for lane conditioning system 100. For the tenth embodiment of lane conditioning system 1100, for dressing application system 140, instead of thirty-nine (39) injectors 232 operatively connected to a reciprocating injector rail 230, thirty-nine (39) precision delivery injectors 1102 may be operatively connected to a fixed injector rail 1108 and configured to supply dressing fluid across the width of a board 285 of bowling lane BL. Moreover, for the tenth embodiment of lane conditioning system 1100, for dressing application system 140, lane conditioning system 1100 may include a stationary or horizontally reciprocable dispersion roller 1110. Dispersion roller 1110 may include a cylindrical cross-section, and be made of a metal such as steel or aluminum, and include a smooth polished or textured surface. Dispersion roller 1110 may be operable by a dispersion roller drive motor (not shown) or by buffer drive motor 238 and include a driven sheave or sprocket (not shown) operatively connected to drive sheave or sprocket (not shown) of dispersion roller drive motor (not shown), or buffer drive motor 238, by a belt or chain (not shown). Dispersion roller 1110 may also be configured to horizontally reciprocate by means of a reciprocating motor 1104 within a range of ±1", for example.

Figure 77:
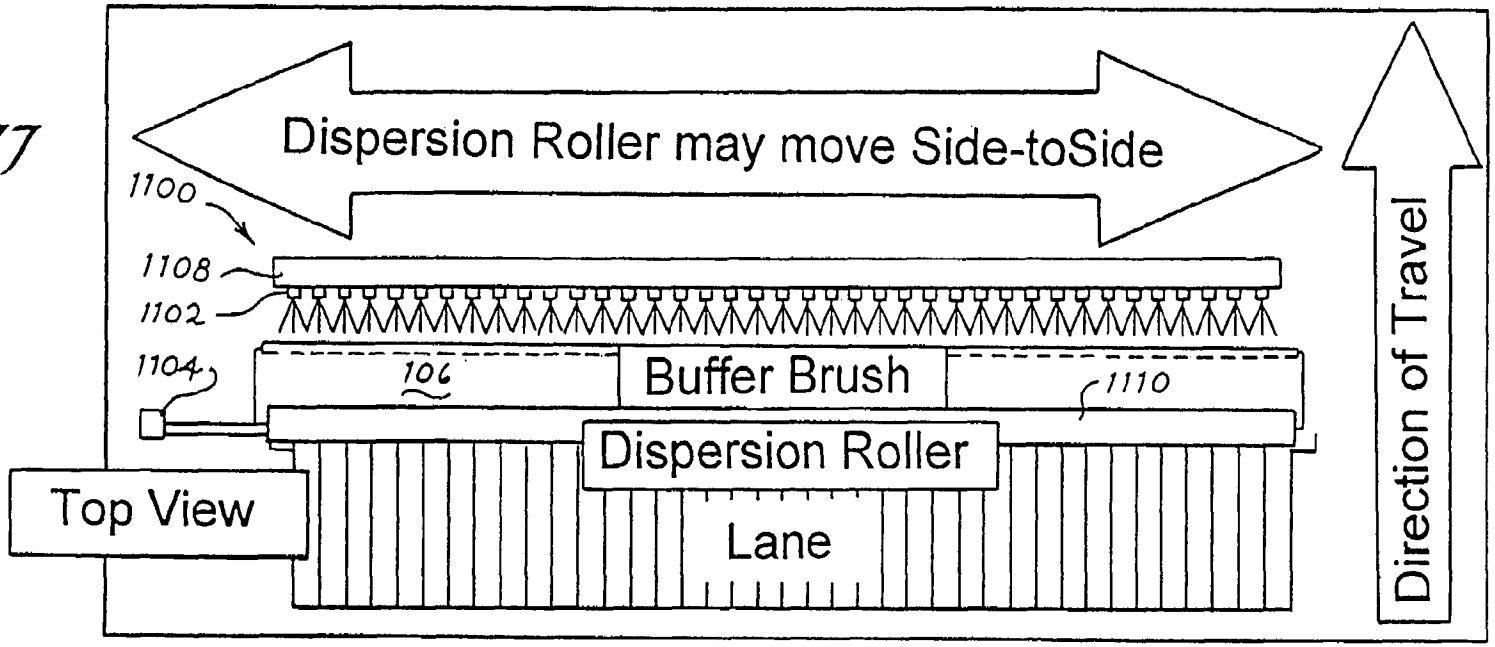
FIG. 77 is a schematic of a tenth embodiment of a lane conditioning system according to the present invention, illustrative of a top view of a plurality of precision delivery injectors operatively connected to an injector rail, a horizontally reciprocable dispersion roller operatively connected to a buffer roller, and the buffer for smoothing dressing fluid applied onto the bowling lane.
Figure 78:
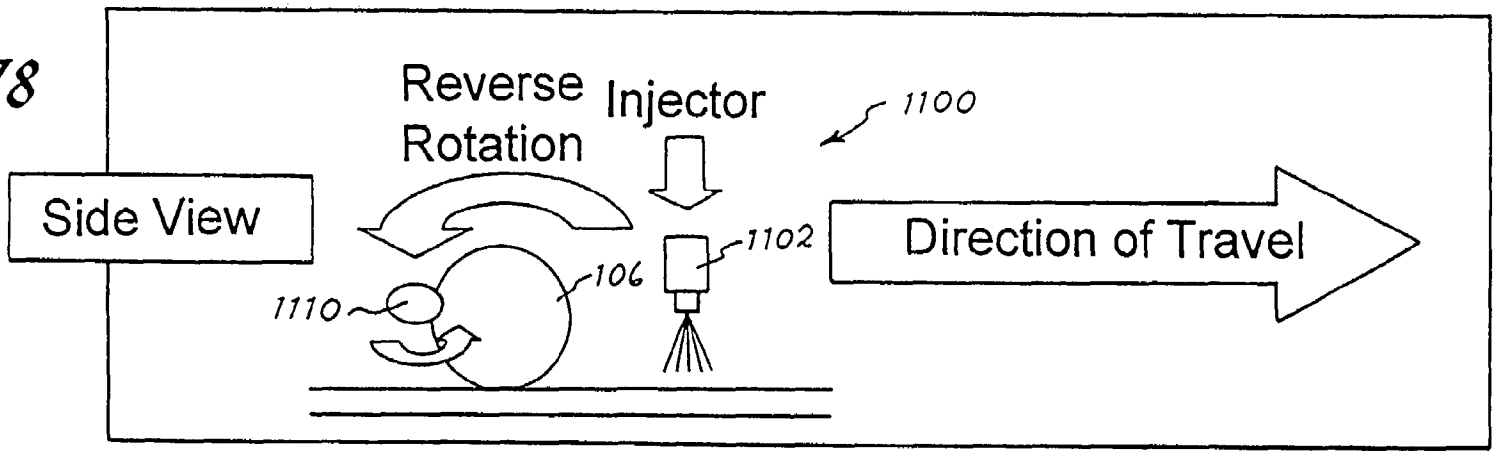
FIG. 78 is a schematic illustrative of a side view of the components of FIG. 77, illustrating a precision delivery injector applying dressing fluid onto a bowling lane, the horizontally reciprocable dispersion roller, and a buffer rotating opposite to the direction of travel of the lane conditioning system for smoothing dressing fluid applied onto a bowling lane.

Therefore, as illustrated in FIGS. 77 and 78, dispersion roller 1110 may be disposed in contact with buffer 106 so as to crush, bend or otherwise deform the bristles of buffer 106. In this manner, dressing fluid on the bristles of buffer 106 may be smoothed and intermingled amongst the various bristles to facilitate spreading thereof onto the bowling lane.

For lane conditioning system 1100 employing dispersion roller 1110, at the start of the conditioning pass, control system 250 may be configured to apply excess dressing fluid at the front end of the lane to wet buffer 106 and thereby allow dispersion roller 1110 to store a predetermined amount of dressing fluid which would thereafter be dispersed by roller 1110. Once the predetermined amount of dressing fluid is on dispersion roller 1110, the stationary or horizontally reciprocative roller 1110 may further act to disperse and otherwise spread out the dressing fluid on buffer 106. During operation of lane conditioning system 1100, dispersion roller 1110 may generally be operable only during a partial length of the conditioning pass, and otherwise be disposed away from buffer 106 to further control the desired spreading and storage of the lane dressing to achieve the proper conditioning pattern.

For the embodiment of FIG. 78, dispersion roller 1110 may be rotated in a direction opposite to the rotation direction of buffer 106. Additionally, for start of the conditioning pass, lane conditioning system 1100 may be placed a predetermined distance, i.e. six (6) inches from the foul line to allow the excess fluid to be placed onto the bowling lane without adversely affecting the applied dressing fluid pattern.

Other than the aforementioned differences in lane conditioning system 1100 versus system 100, the aforementioned features and operational characteristics of lane conditioning system 1100 may be identical to those of system 100. Moreover, those skilled in the art would appreciate in view of this disclosure that control system 250 in conjunction with user interface 252 may be utilized to control various characteristics, such as the rotation speed of dispersion roller 1110 for lane conditioning system 1100.

With regard to the various embodiments of lane conditioning system discussed above with reference to FIGS. 1-59 and 64-78, it should be noted that each of the particular features for a particular embodiment may be combined with or interchangeably used with any of the particular features of the various embodiments discussed above.

FIGS. 79-92 illustrate another embodiment of a lane conditioning system (or "machine"). Like the lane machine in the embodiments described above, this lane machine comprises a drive system (e.g., a drive motor and drive wheels), a cleaning fluid delivery and removal system, and a lane dressing fluid application system. In operation, the drive system automatically propels the lane machine from the foul line to the pin deck and back. As the lane machine is propelled from the foul line to the end of the lane, the cleaning fluid delivery and removal system cleans dirty, depleted oil off the bowling lane, and the lane dressing fluid application system applies fresh oil to the lane to create a lane dressing fluid pattern. Instead of performing both cleaning and conditioning operations, the lane machine can be run in a cleaning-only mode or a conditioning-only mode. In general, the lane conditioning machine of this embodiment is similar or identical to the embodiments described above except as explained below.

Figure 79:
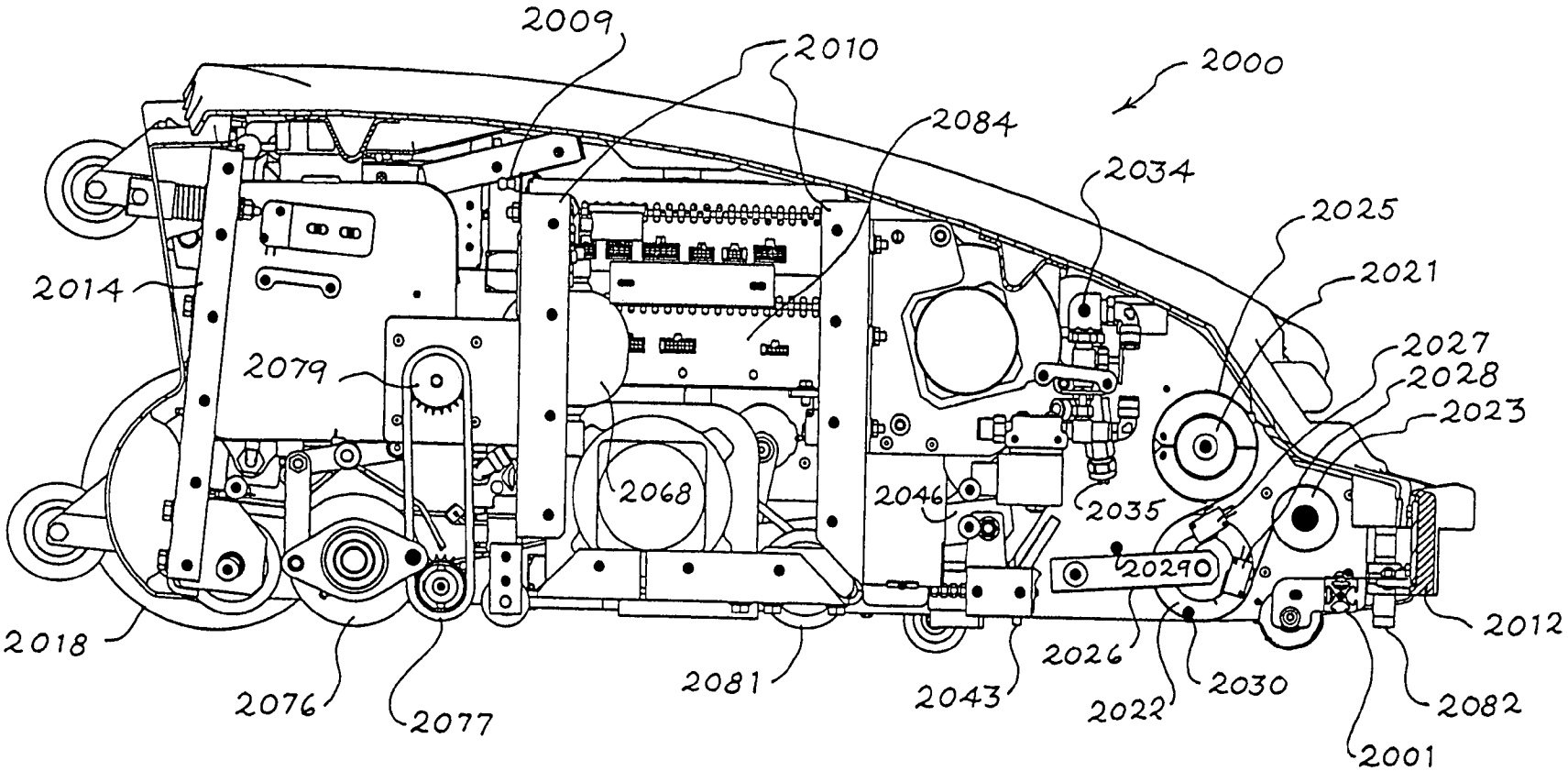
FIG. 79 is a right-hand-side view with cover removed of a lane conditioning system of an embodiment.
Figure 80:
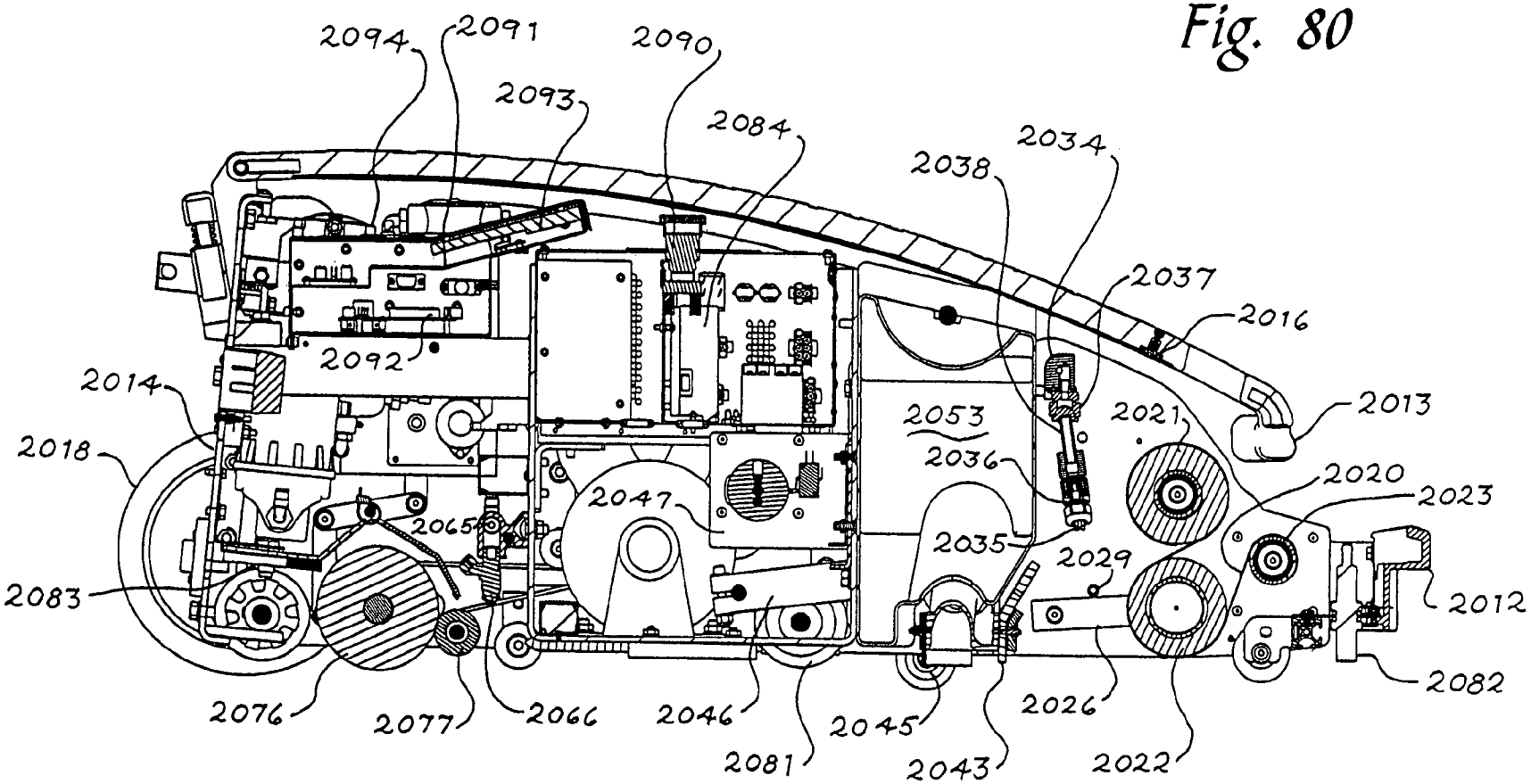
FIG. 80 is a right-hand-side view of a cross-section along the center of a lane conditioning system of an embodiment.
Figure 81:
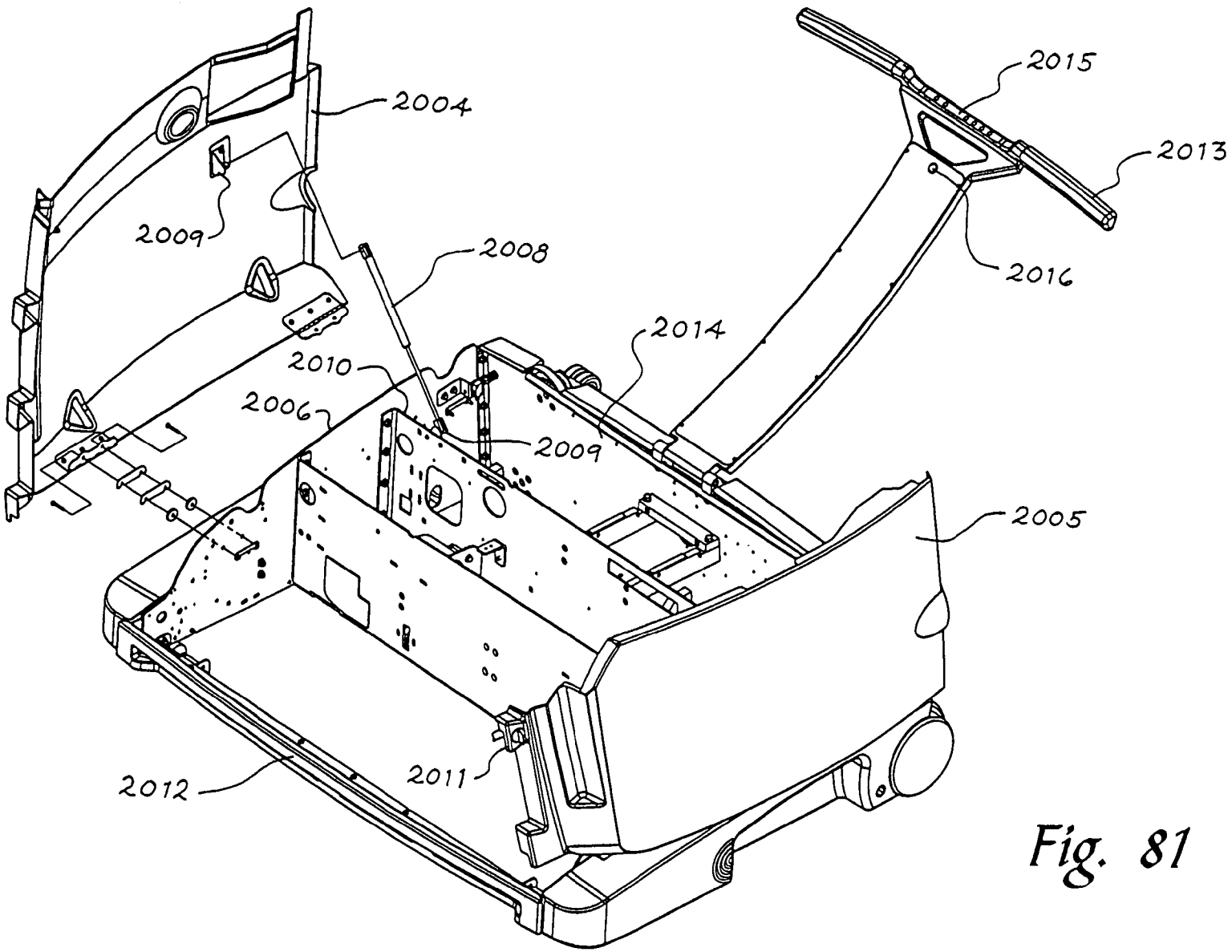
FIG. 81 is a front isometric view of the frame and covers of a lane conditioning system of an embodiment.
Figure 82:
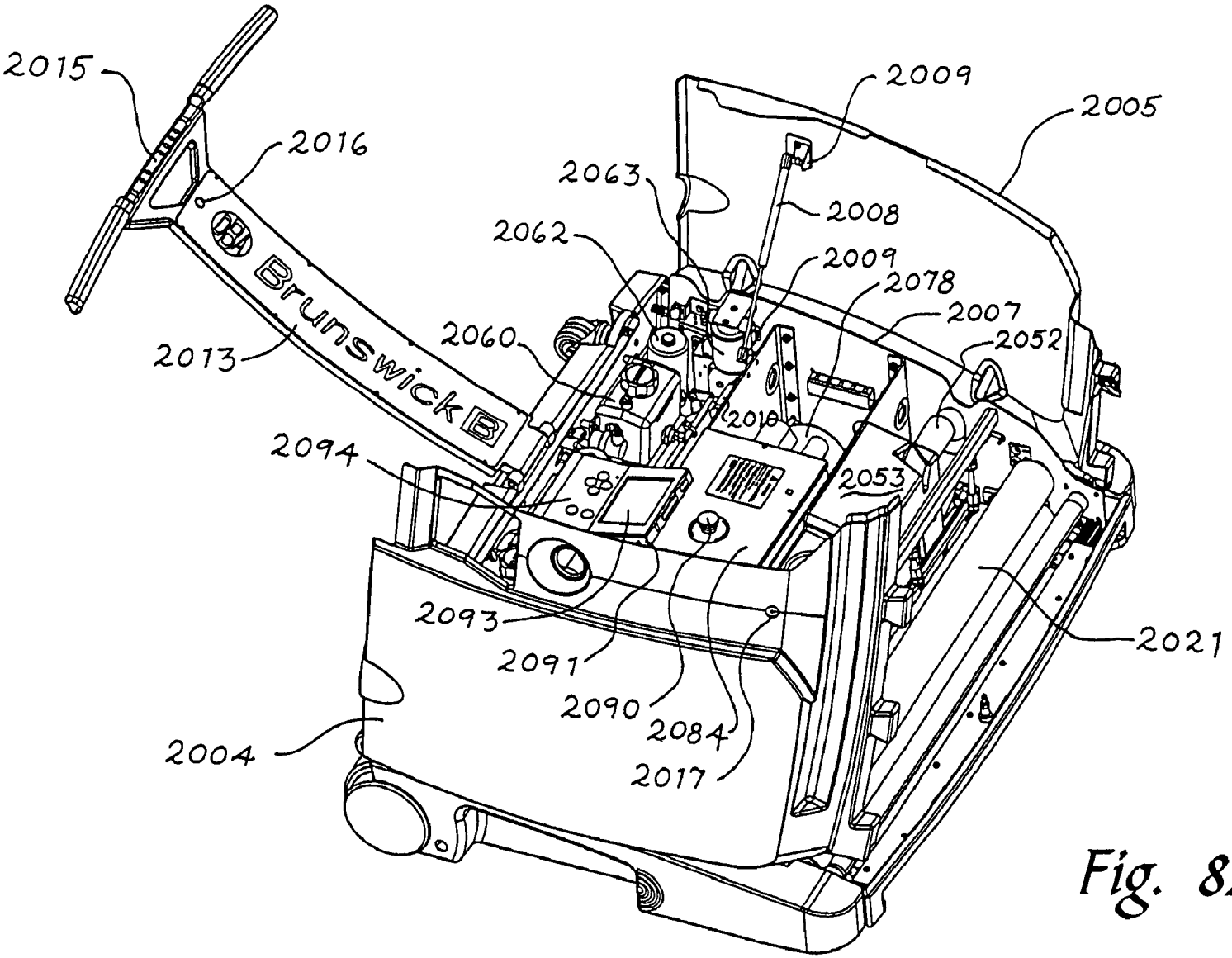
FIG. 82 is a front isometric view of a lane conditioning system of an embodiment.
Figure 83:
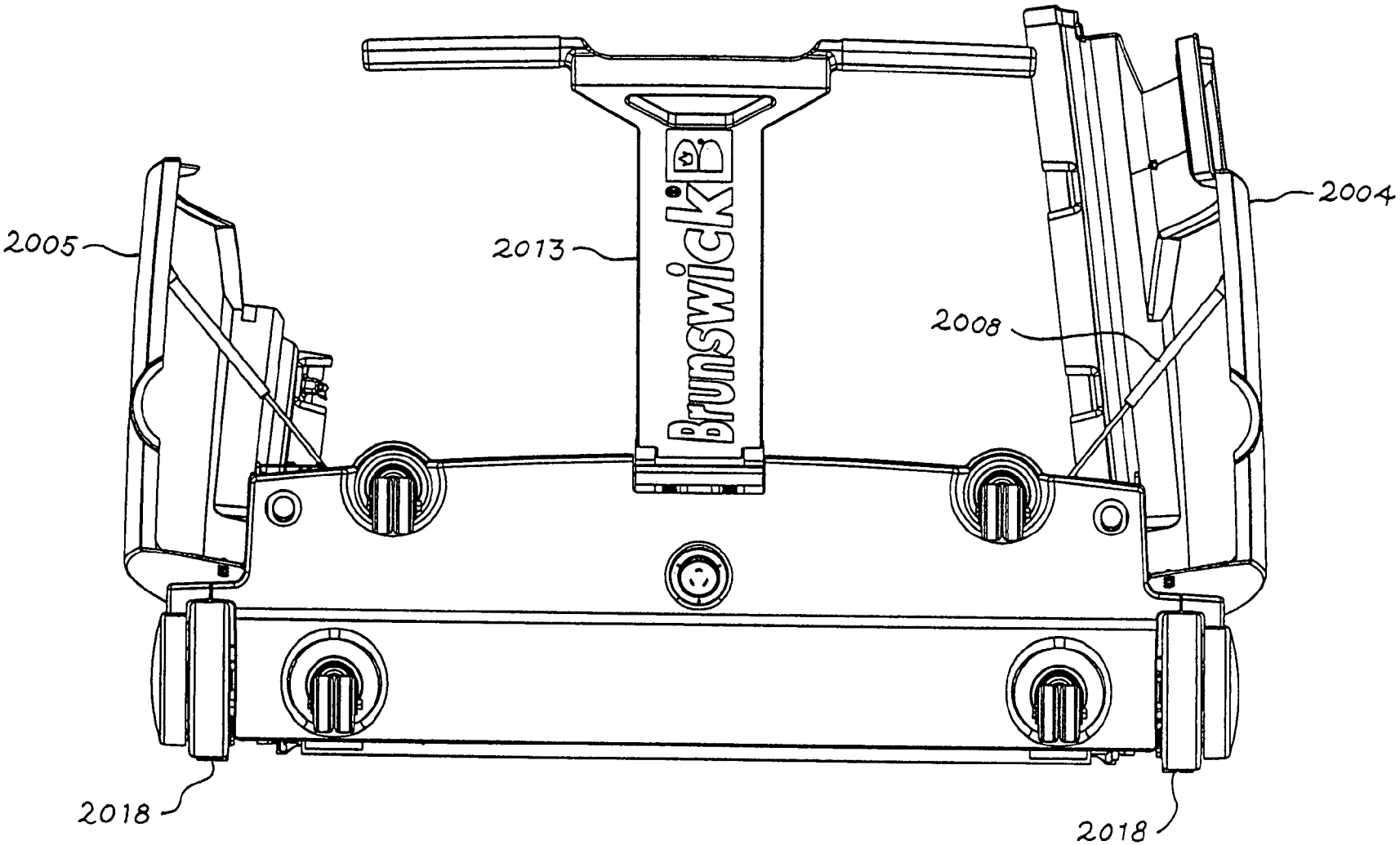
FIG. 83 is a rear view with covers of a lane conditioning system of an embodiment.
Figure 84:
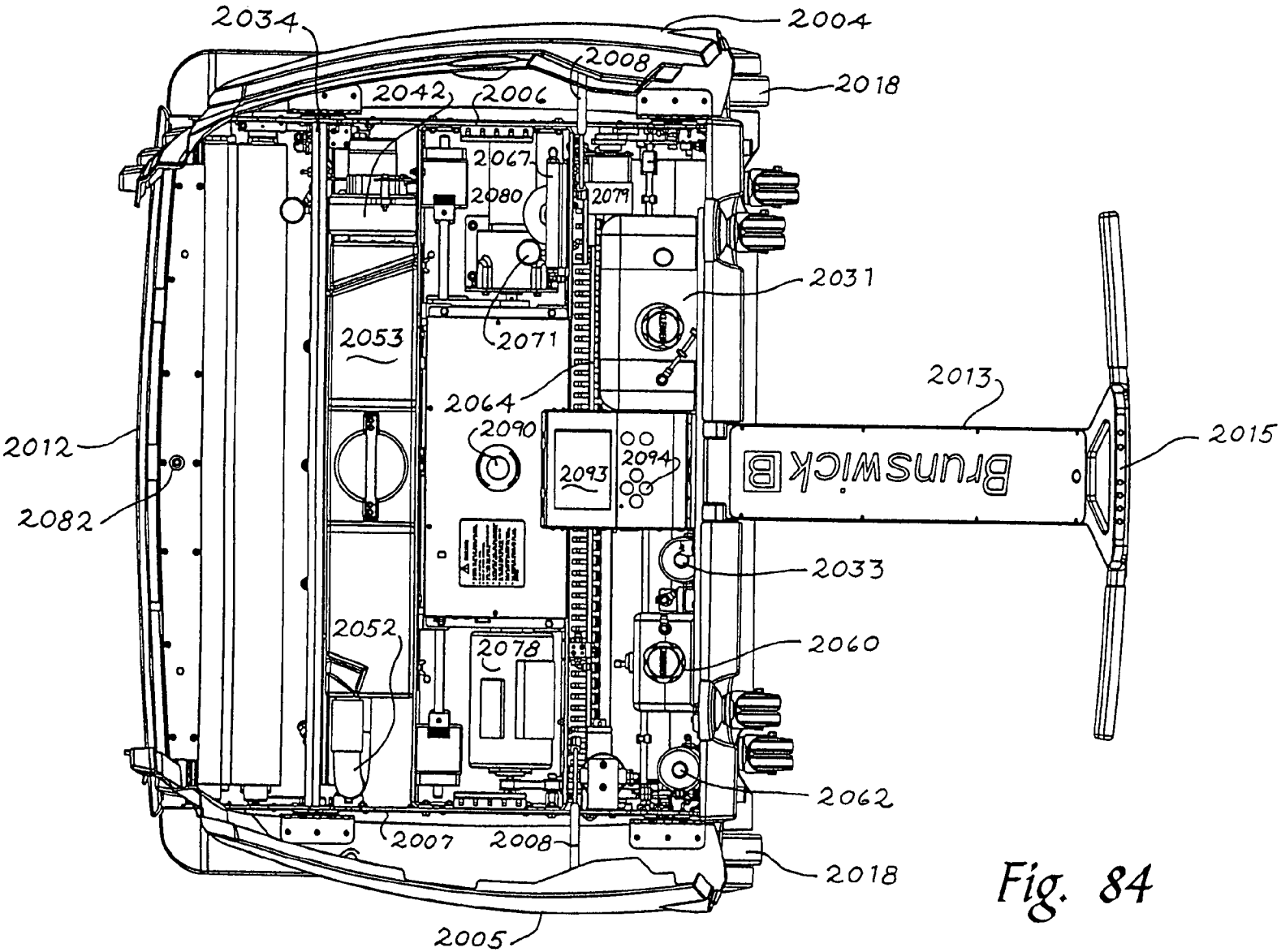
FIG. 84 is a top view of a lane conditioning system of an embodiment.
Figure 85:
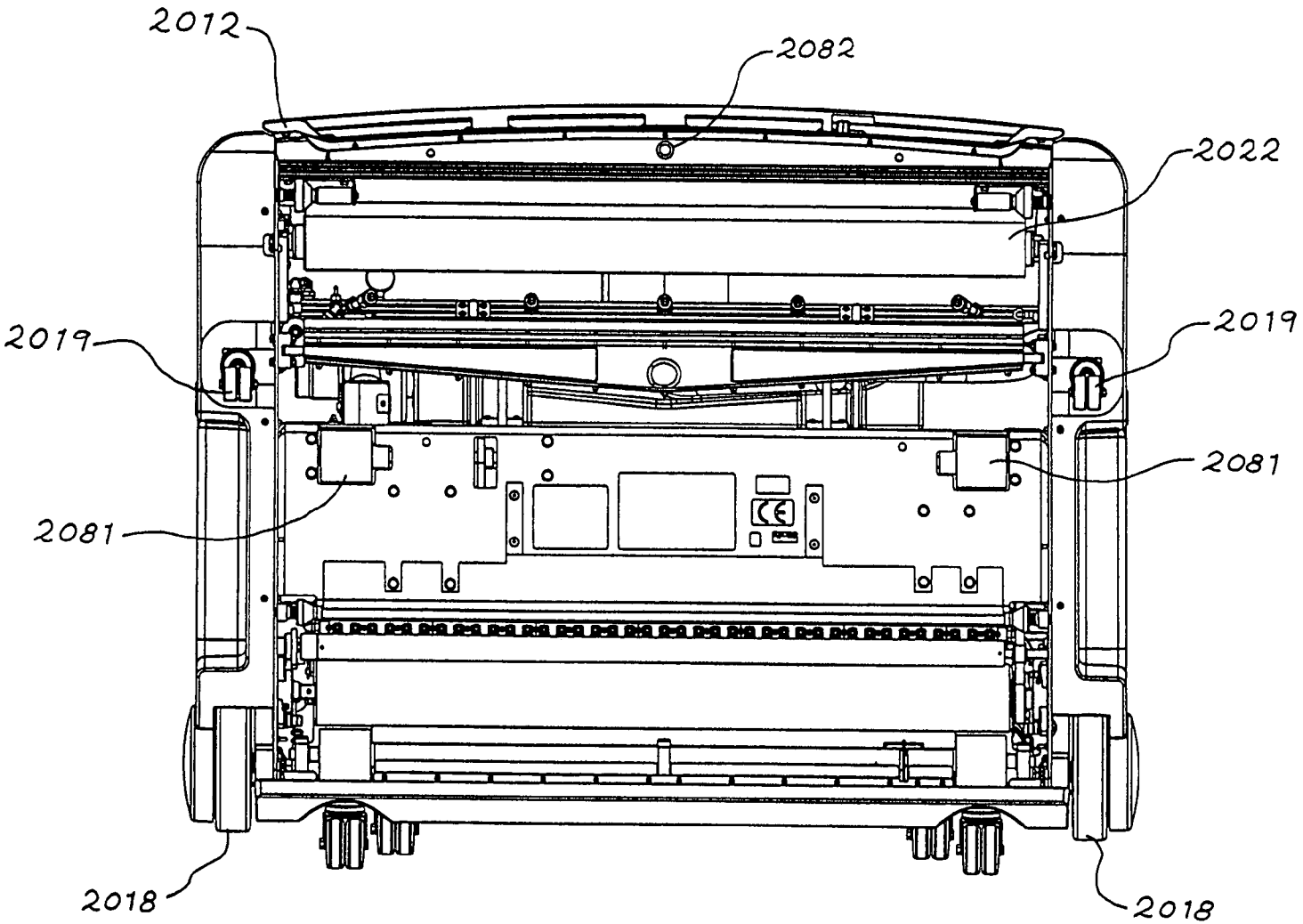
FIG. 85 is a bottom view of a lane conditioning system of an embodiment.
Figure 86:
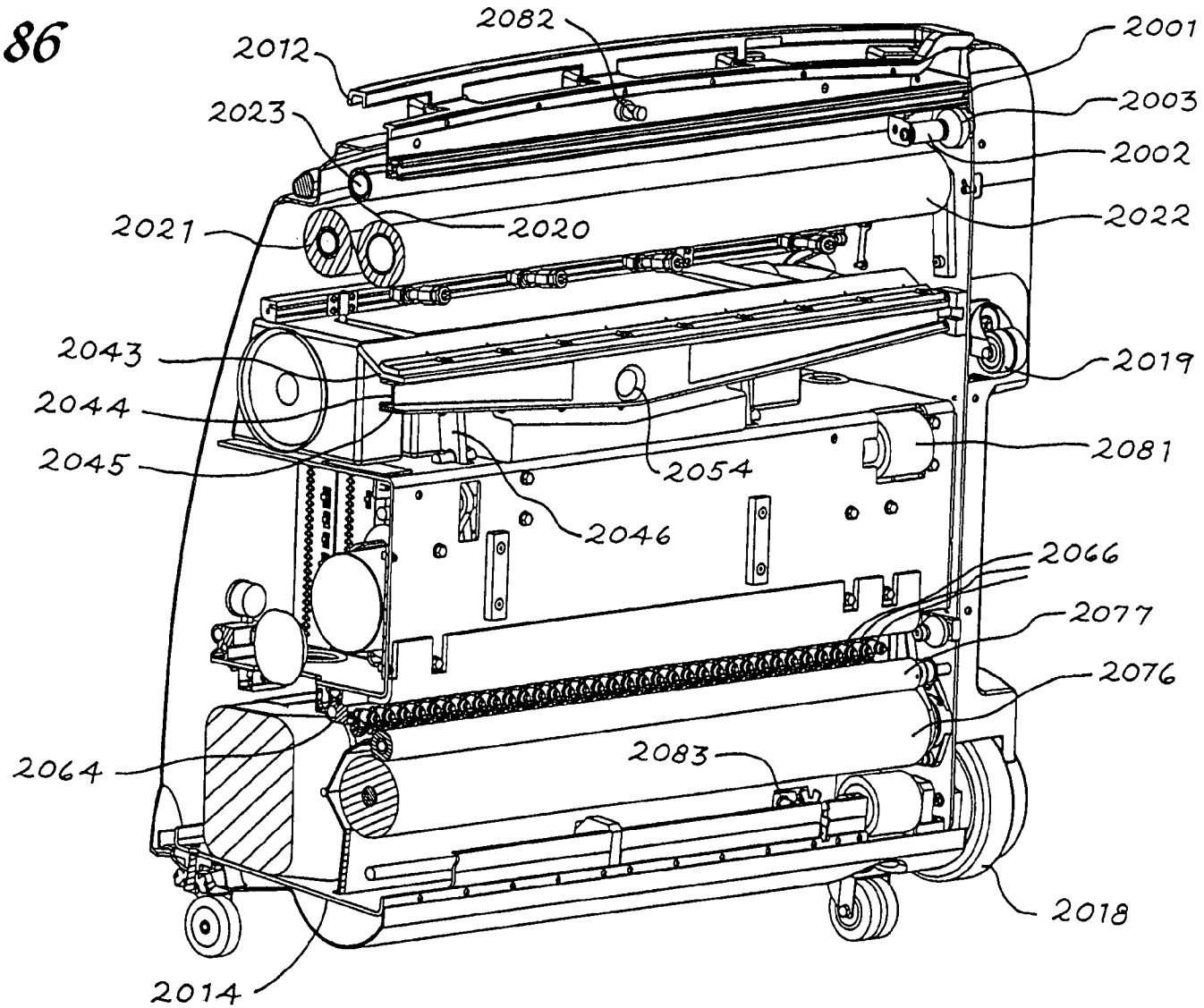
FIG. 86 is a bottom isometric view with cross section of a lane conditioning system of an embodiment.
Figure 87:
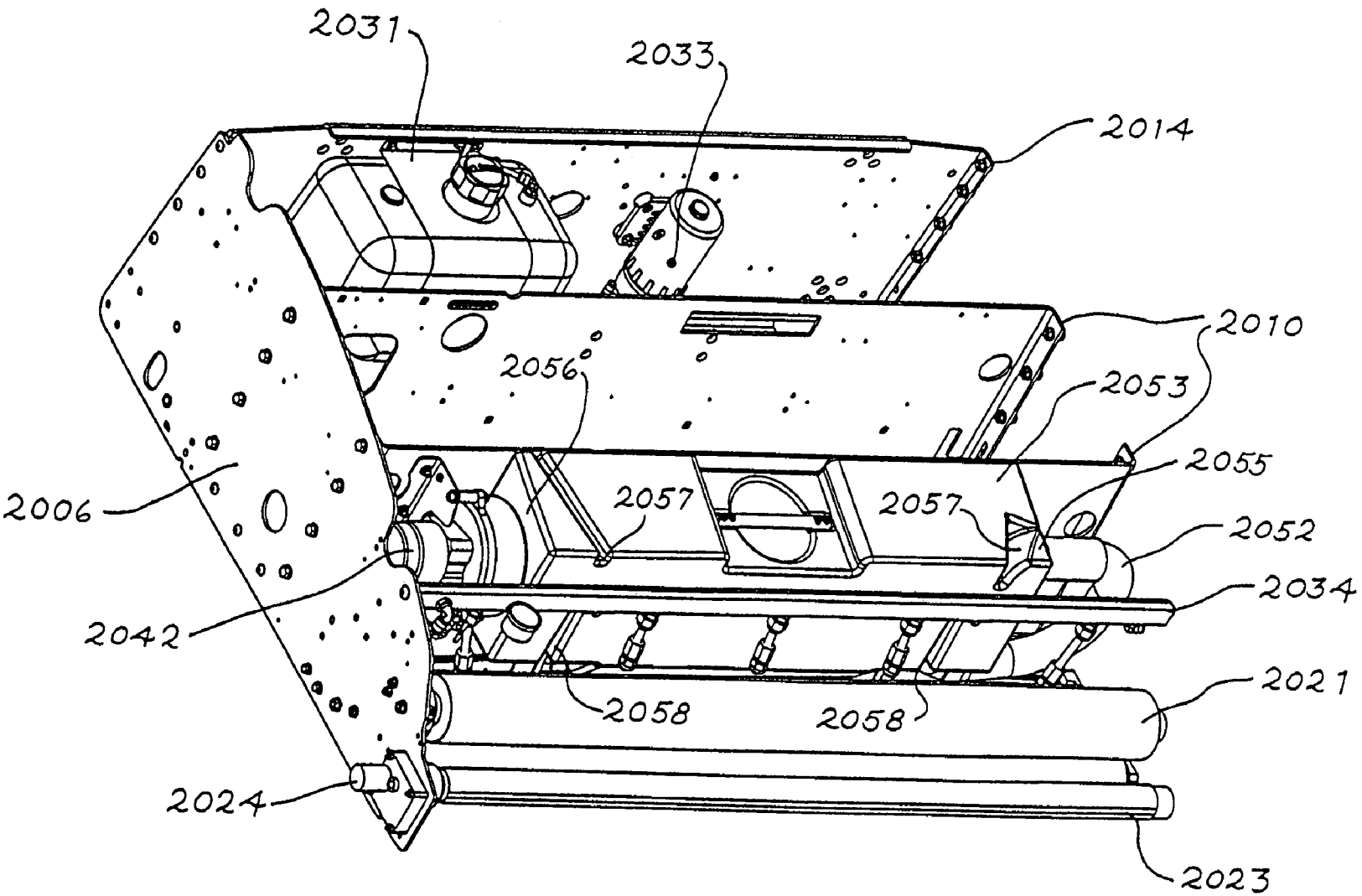
FIG. 87 is an isometric view of a cleaning system of a lane conditioning system of an embodiment.

Turning first to the overall structure, as shown in FIGS. 79, 80, and 86, the lane conditioning machine 2000 in this embodiment has a different frame, cover, and handle design. As a first matter, this embodiment does not include a front wall but instead uses a cross brace 2001 for strength without limiting access. The transfer rollers 2002 and the front guide rollers 2003 are attached to the cross brace 2001. Also, in this embodiment, an open front housing enclosure allows easy cloth access with styled covers that open to the sides for full access from the front or rear. More specifically, the top covers 2004, 2005 (FIGS. 81-84) are hingedly connected to the left and right side walls 2006, 2007 to permit the best access to the front and rear of the machine 2000. Gas springs 2008 attach between ball joints 2009 on the top covers and center housing section 2010 to help hold the covers 2004, 2005 in the open or closed positions. The left top cover 2005 overlaps the right top cover 2004 in the center of the machine 2000. The left top cover 2005 includes a ¼-turn latch 2011 to keep the covers 2004, 2005 closed when the machine 2000 is lifted into the vertical transport position. A full width front handle/bumper 2012 is attached to the left and right side walls 2006, 2007 to allow two persons to easily lift the machine 2000 into the transport position. The ergonomic rear T-handle 2013 is hingedly connected to the rear wall 2014. This handle 2013 contains a keypad 2015 to easily control the machine functions from the standing operating position. The rear T-handle 2013 can be pivoted to fit into a formed depression in the top covers 2004, 2005 and retained in this position by a magnet 2016 (or other type of catch) on the T-handle 2013, mating with a steel plate 2017 on the right top cover 204. In this way, the T-handle ergonomically folds into the cover for transport. The rear transition wheels of the earlier embodiment are more preferably replaced by 8"-diameter rear wheels 2018 coupled with a fixed rear axle, which allow the machine 2000 to be moved from the bowling lane to the approach area with less effort. By securing the wheels 2018 to a fixed rear axle, the 8"-diameter rear wheels 2018 also function as pivot points to turn the machine 2000 with pivotable front wheels, such as castor-type front transition wheels 2019 (FIGS. 85 and 86) (like a shopping cart). This arrangement provides for a much more predictable guiding operation than existing lane machines with castor-type transition wheels on both the front and rear locations. Further, a fixed rear axle with larger rear wheels (as compared to a castor) results in reduced effort by the user to pull the machine 2000 out of gutter and to control steering.

In one presently preferred embodiment, the lane machine 2000 comprises an aluminum frame that measures 45 inches deep by 57 inches wide by 18 inches high with a minimum thickness of 0.171 inches. Preferably, the cross brace 2001 is aluminum extrusion, the transfer rollers 2002 are high density polyethylene or urethane, the front guide rollers 2003 are Delrin, nylon or polyurethane, the top covers 2004, 2005 are a fiberglass material with a minimum thickness of 0.11 inches, and the left and right side walls 2006, 2007 are aluminum with a minimum thickness of 0.171. It is also presently preferred that the center housing section 2010 be aluminum with a minimum thickness of 0.171, that the front handle/bumper 2012 and the rear T-handle 2013 be cast aluminum and that the rear wall 2014 be aluminum with a minimum thickness of 0.171. Further, it is preferred that the rear wheels 2018 be 8" diameter wheels with roller bearings, and the front transition wheels 2019 be 2" diameter dual urethane wheels in castor brackets.

The lane machine 2000 of this embodiment comprises a cleaning system and a dressing application (or conditioning) system. Turning first to the cleaning system, the cleaning system comprises a duster assembly, cleaning fluid delivery nozzles, and a squeegee assembly. Each of these components will now be described. The duster assembly contains a duster cloth 2020 on a duster cloth supply roll 2021, a duster cloth backup roller 2022, and a duster cloth take-up roll 2023. The portion of the duster cloth that is looped under the backup roller removes surface dust from the bowling lane when the backup roller is in contact with the bowling lane. The duster assembly comprises a single duster cloth motor on take-up with clutch on supply. Specifically, a reversible duster motor 2024 (FIG. 87) is attached to the duster cloth take-up roll 2023, and a friction clutch 2025 (FIG. 79) is attached to right side walls 2006 and engages with the duster cloth supply roll 2021. The backup roller 2022 is attached to pivot arms 2026. The duster up switch 2027 and duster down switch 2028 monitor whether the pivot arm 2026 is in the up position or the down position.

In one presently preferred embodiment, the duster cloth 2020 is nonwoven Rayon, the duster motor 2024 is a 5 rpm gearmotor (12 v DC), the friction clutch 2025 is a McMaster-Carr #57145K87 hinged clamp-on collar with leather friction material against the rotating cloth roller hub, and the duster up switch 2027 and the duster down switch 2028 are microswitches with gold contacts, rated for 125 V, 0.1 A.

At the start of the cleaning operation, the duster motor 2024 is activated to rotate the take-up roll 2023 in a reverse (or forward) rotation to produce a slack in the cloth 2020, which allows the backup roller 2022 to pivot under its own weight into contact with the bowling lane. If the lane machine is on the approach instead of on the lane, the pivot arms 2026 contact the adjustable duster down stop 2030 to prevent the backup roller 2022 from contacting the approach surface. The downward travel of the backup roller 2022 is detected by the duster down switch 2028. After wiping dust from the length of the bowling lane, the duster motor 2024 rotates the take-up roll 2023 in a forward (or reverse) rotation for a measured time duration until the backup roller 2022 reaches its full up position against a fixed duster up stop 2029. The upward travel of the backup roller 2022 is detected by the duster up switch 2027. The duster motor 2024 then rotates the take-up roll 2023 an additional percentage of the previously-measured time duration (from the cloth down to cloth up position) to unroll fresh cloth 2020 from the supply roll 2021. The friction clutch 2025 is adjusted so that cloth tension will lift the backup roller 2022 to its full up position before it unrolls fresh cloth 2020 from the supply roll 2021. In one embodiment, the control system automatically measures the time to raise the duster cloth with 40-80% (more preferably, 60-80%) extra engagement for constant advancement length and minimum use of new cloth. This avoids the customer having to reset the ratio of roller diameter when changing the cloth. When the lane machine 2000 travels in reverse back to the foul line, the backup roller 2022 remains in the up position.

Figure 88:
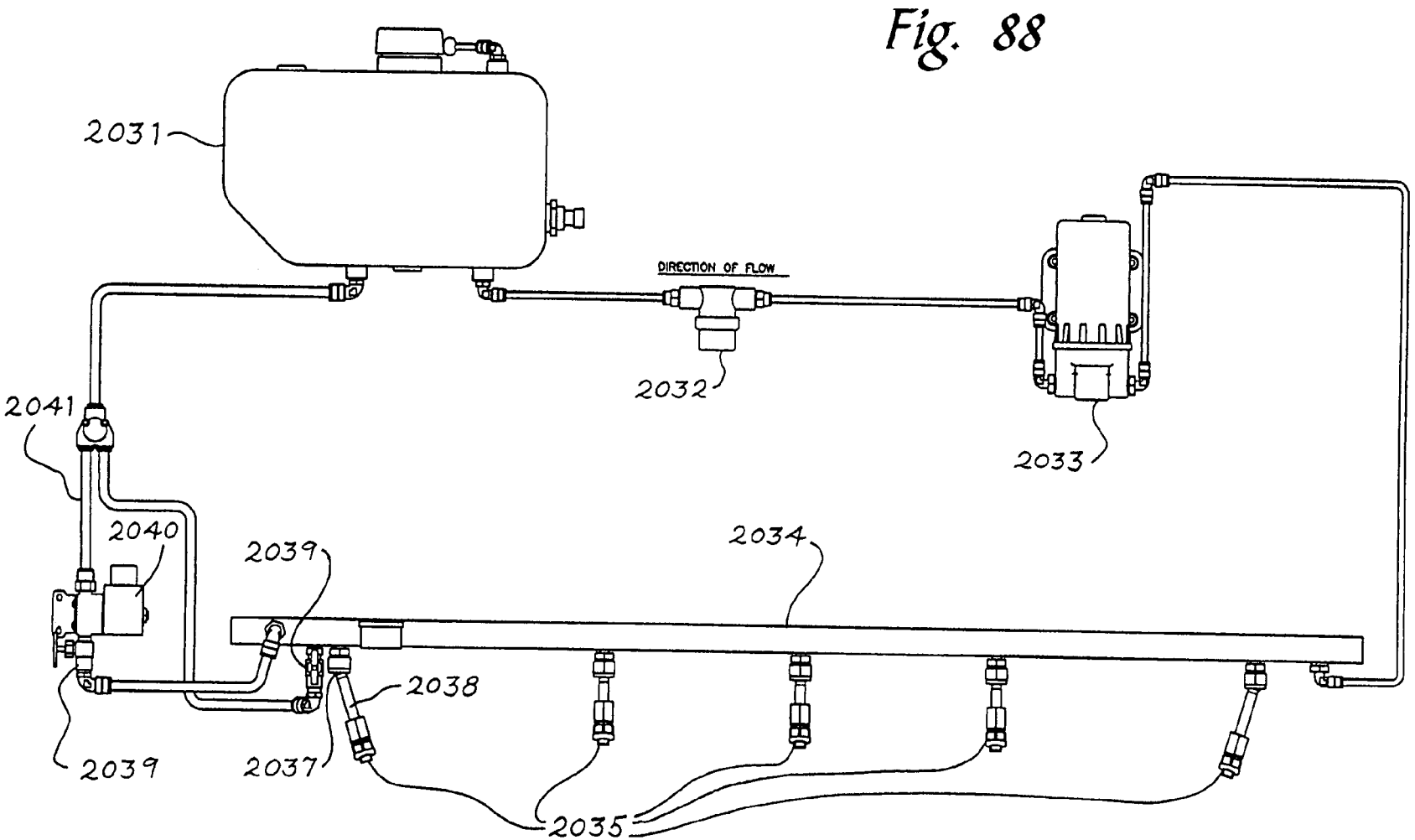
FIG. 88 is a schematic of a cleaning fluid flow diagram of a lane conditioning system of an embodiment.

Turning now to the cleaning fluid delivery nozzles, a fluid flow diagram of the cleaning system is shown in FIG. 88. It includes a cleaning fluid reservoir 2031, a cleaning filter 2032, a cleaning fluid pump 2033, and a cleaning system manifold 2034 containing cleaning fluid delivery nozzles 2035. The lane machine 2000 contains five cleaning fluid delivery nozzles 2035, which apply a constant mist of cleaning fluid to the bowling lane after it has been dusted by the duster cloth 2020. In this embodiment, the cleaning fluid delivery nozzles 2035 are internal to the housing of the bowling lane conditioning machine 2000. This allows the lane to be dusted before cleaning spray is applied. Further, spraying cleaning fluid inside the housing helps avoid interference on the constant spray from external air flow, fans, etc. Each nozzle 2035 preferably contains a filter screen and spring-loaded check valve assembly 2036 (FIG. 87) that opens when more than 10 PSI of cleaning fluid is applied by the cleaning fluid pump 2033. Each of the five cleaning fluid delivery nozzles 2035 can be directed to the desired position with a locking ball joint 2037 (FIG. 87) on the cleaning manifold. The length of the tube 2038 between the locking ball joint and the fluid delivery nozzles 2035 is designed so that the outer nozzles 2035 are closer to the lane surface and aimed toward the center of the lane to prevent overspray into the gutters. Accordingly, a ball joint adjustment of spray orientation provides simple, even coverage across the width of the lane without overspray into the gutters. A flow control needle valve 2039 is located after the nozzles 2035 to control the cleaning fluid pressure and resulting volume applied to the lane. A normally closed solenoid control valve 2040 opens an additional flow path 2041 to reduce the pressure and cleaner volume flowing out of the nozzles 2035 in certain areas of the lane. This additional flow path 2041 contains an additional flow control needle valve 2039 to further control the cleaning fluid pressure and resulting volume applied to the lane when the additional flow path 2041 is opened. The operator can select the desired distance along the lane that the cleaner makes this transition from the initial higher flow to the lower flow. Additionally, because the vacuum/motor assembly 2042 (FIG. 87) may not be 100% effective at removing large volumes of cleaning fluid from the bowling lane, small droplets of cleaning fluid may remain on the backend of the bowling lane. As these small droplets evaporate, salt is left behind, which may adversely affect the application of oil to the bowling lane and may result in undesirable ball reaction. This is one reason that a lower cleaner flow rate may be desirable on the backend of the bowling lane.

In one presently preferred embodiment, the cleaning fluid reservoir 2031 is a 2.5 gallon polymeric reservoir (Equistar, type petrothene LP500200), the cleaning filter 2032 is a line strainer with 200 mesh stainless steel, the cleaning fluid pump 2033 is a diaphragm pump, rated for 115 VAC, 1.5 GPM, 50 PSI with Viton check valves and diaphragm, the cleaning system manifold 2034 is an aluminum extrusion, the cleaning fluid delivery nozzles 2035 are stainless steel producing a flat 110 degree spray angle at 40 psi with a flow of 0.023 gallons per minute at 20 psi, the check valve assembly 2036 has a 200 mesh stainless steal strainer with a 10 psi check valve, the ball joint 2037 is part number #36275-⅛×⅛ from Spraying Systems Corp., the flow control needle valves 2039 are stainless steel with a manual adjustment, the solenoid control valve 2040 is a 2-way electrically activated normally closed stainless steel component, and the vacuum/motor assembly 2042 is typically a 5.7" diameter, 2-stage blower, 97 CFM with a ball bearing (rated for 120 V, 60 Hz.).

Turning now to FIG. 86 the squeegee assembly contains a front absorbent foam wiper 2043, a squeegee channel with a U-shaped cross section cast squeegee housing 2044, and a rear elastomer blade 2045. The absorbent front wiper 2043 agitates the lane while allowing liquid to enter the wiper 2043. (While, in this embodiment, the front wiper 2043 does not have the serration of an elastomer blade, an elastomer material may be used instead of an absorbent wiper 2043.) The squeegee channel with a U-shaped cross section 2044 and rear elasomer blade 2045 are formed in a "V" shape as viewed from the top or bottom of the lane machine FIG. 86. The absorbent wiper 2043, cast squeegee housing 2044, and the elastomer blade 2045 are mounted on a pivot arm 2046 that pivots to a fixed up or down position depending on the operation of a squeegee lift motor assembly 2047 coupled with the pivot arm 2046. The absorbent wiper 2043 (FIG. 90) is mounted to the front of the cast squeegee housing 2044 with an attachment plate 2048 and screws 2049. An absorbent foam pad 2050 may be attached to the front of the attachment plate 2048 to collect any residual cleaner mist which could otherwise accumulate on the attachment plate 2048. The top and bottom of the absorbent wiper 2043 position can be reversed to provide a new surface after the lane has worn the bottom of the absorbent wiper 2043. The front and rear surfaces of the rear elasomer blade 2045 can be flipped to provide a new surface after the lane has worn the lower front edge of the elasomer blade 2045. While the absorbent wiper 2043 and elastomer blade 2045 deflect to conform to slight variations in the bowling lane, the pivot arm 2046 and the various linkages to the squeegee lift motor assembly 2047 are preferably fixed and do not move when the squeegee assembly is in the down position.

The absorbent wiper 2043 agitates the cleaning fluid on the bowling lane to assist in removing oil and dirt from the bowling lane. Because the duster cloth 2020 removes surface dust from the bowling lane before the nozzles 2035 deliver cleaning fluid to the bowling lane, the cleaning fluid that reaches the absorbent wiper 2043 is largely free of dust, which keeps the absorbent wiper 2043 free of mud. The absorbent front wiper 2043 extends above the squeegee assembly and is angled forward by a metal shield 2051. This absorbent area collects any residual cleaner mist as the machine travels forward. Any collected moisture flows down the absorbent wiper 2043 and is removed by the vacuum. The elastomer blade 2045 channels the cleaning fluid to a vacuum hose 2052 (FIG. 87) located between the absorbent wiper 2043 and the elastomer blade 2045, and a vacuum/motor assembly 2042 suctions the cleaning fluid through the vacuum hose 2052 to a removable waste reservoir 2053. The cross sectional area of the U-shaped squeegee channel 2044 is held constant to provide constant air speed from the outer ends of the squeegee to the center opening attaching the vacuum tube 2054. This cross sectional area is tall and narrow at the edges of the lane. The squeegee cross sectional area reduces in height and becomes wider towards the center of the lane. This forces the air flow closer the center of the lane for more effective cleaning action near the more heavily conditioned center of the lane.

The waste reservoir 2053 contains an inlet 2055, which connects to the vacuum hose 2052, and an outlet 2056, which connects to the vacuum/motor assembly 2042. The waste reservoir also contains a plurality of upper baffles 2057 and lower baffles 2058. As an airflow is drawn through the inlet 2055 by the vacuum/motor assembly 2042, the airflow strikes the baffles 2057, 2058, which causes liquid and solid particles carried by the airflow to drop toward the bottom, such that, when the airflow reaches the outlet, the airflow is substantially free of any liquid or solid particles. The system of baffles 2057, 2058 also helps reduce the formation of foam, which can reduce the effective holding capacity of the waste reservoir. The vacuum/motor assembly 2042 preferably either (1) remains on during the entire travel of the lane machine 2000 from the foul line to the pin deck and back, (2) turns off after leaving the pin deck on the return journey to the foul line, or (3) turns off before starting the return journey to the foul line. In the later two situations, once the vacuum/motor assembly 2042 turns off, it preferably remains off and does not turn back on as the lane machine 2000 returns to the foul line. The operator can select an option that will delay the start of the vacuum motor/motor assembly 2042 until the lane machine is about 55 feet from the foul line. In this case, the "V" shaped rear elastomer squeegee blade 2045 pushes or channels the cleaner forward and towards the center of the lane, preventing cleaner flow into the gutters, until the vacuum/motor assembly 2042 is turned on to remove the cleaner. (Preferably, the cross section of the squeegee casting balances constant air speed from edges to the center.) With this design, the vacuum can be turned off until the end of the lane to save power and reduce noise, which may be especially preferred if the lane machine is battery powered (i.e., if the lane machine has a storage battery and a DC electrical system). Since the cleaner is not vacuumed from the front of the lane, it accumulates as the rear squeegee blade 2045 pushes it ahead in the more heavily conditioned center of the lane before it is removed at the end of the lane. This can create a more effective cleaning action while reducing the noise and power consumption of the vacuum/motor assembly 2042. Since the vacuum/motor assembly 2042 consumes a significant amount of electrical energy, this option would be especially desirable to extend the number of lanes that a battery powered lane machine could maintain between recharging the battery. While the current embodiment does not utilize a battery for the primary source of power (it has a current input power cord from an AC wall outlet), it is understood that alternate embodiments can be configured with a storage battery for the primary source of power (and a DC electrical system) to eliminate the need to handle a power cord.

In one presently preferred embodiment, the front wiper 2043 material is from Specialty Industrial Foam, and is a Char Z, 80 pores per inch, firmness 4, reticulated polyurethane. The squeegee channel with a U-shaped cross section 2044 is preferably an aluminum casting, the rear elastomer blade 2045 is preferably a 5/32" thick, urethane, 45 durometer Shore "A" material, the squeegee lift motor assembly 2047 is preferably a 22 rpm gearmotor (12 v DC), the absorbent foam pad 2050 is preferably from Foamex International Inc, Specialty Industrial Foam and is a Char Z, 80 pores per inch, firmness 4, reticulated polyurethane material. Further, the removable waste reservoir 2053 is preferably a type Escorene roto-molded Polyethylene material from Exxon Chemicals.

Turning now to the dressing application system, some of the additional features of this embodiment include updated position and rotation of the buffer brush, dispersion roller, and injectors; a heated injector rail; pressure only between the pump, accumulator, rail, and valve (not the tank); a special buffer brush flagging to balance smooth spread of oil without too much storage, a pentagon-shaped orifice plate for five individual droplets on each injector/board; and an oscillating dispersion roller.

Figure 89:
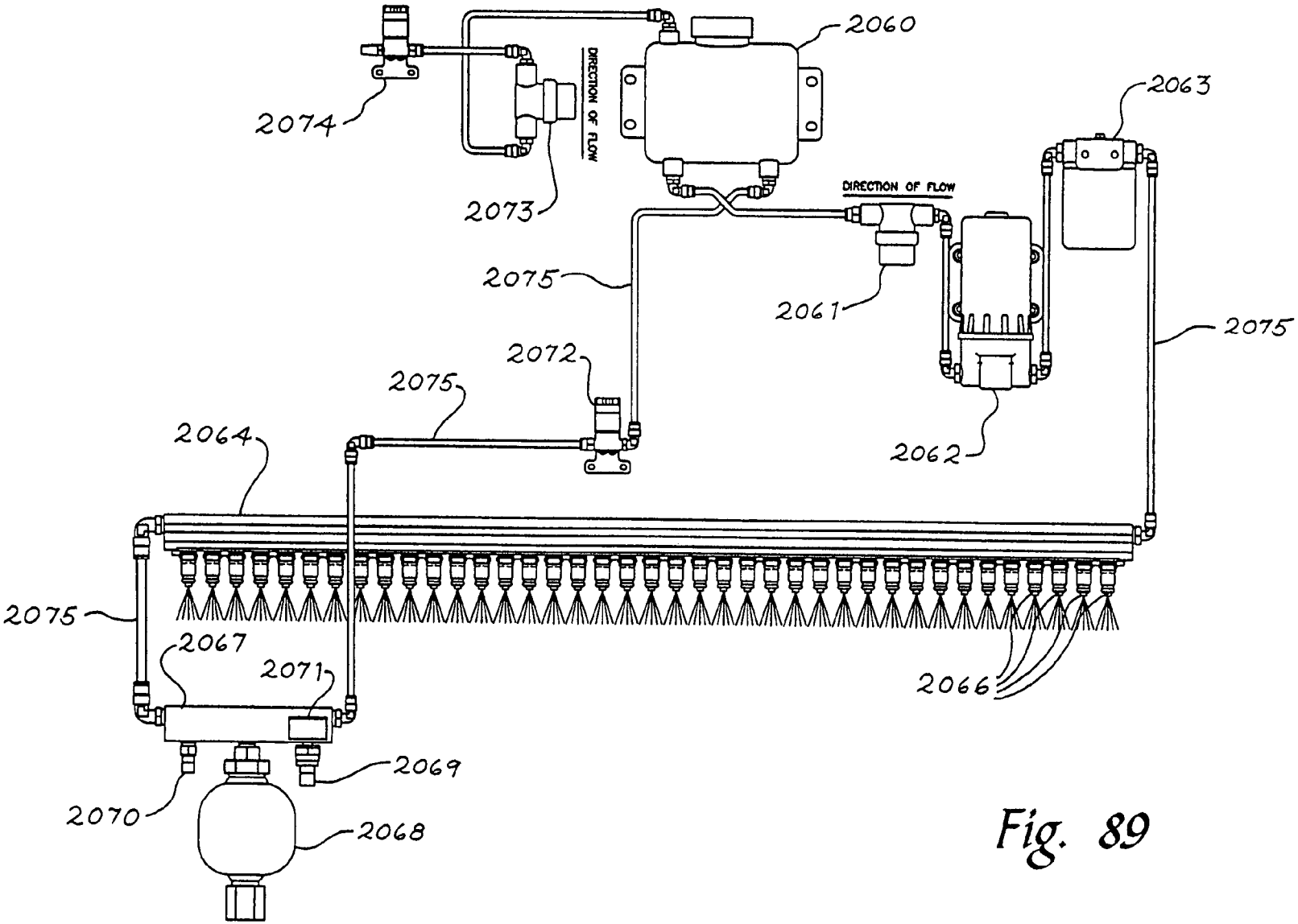
FIG. 89 is a schematic of dressing fluid routing of an embodiment.
Figure 90:
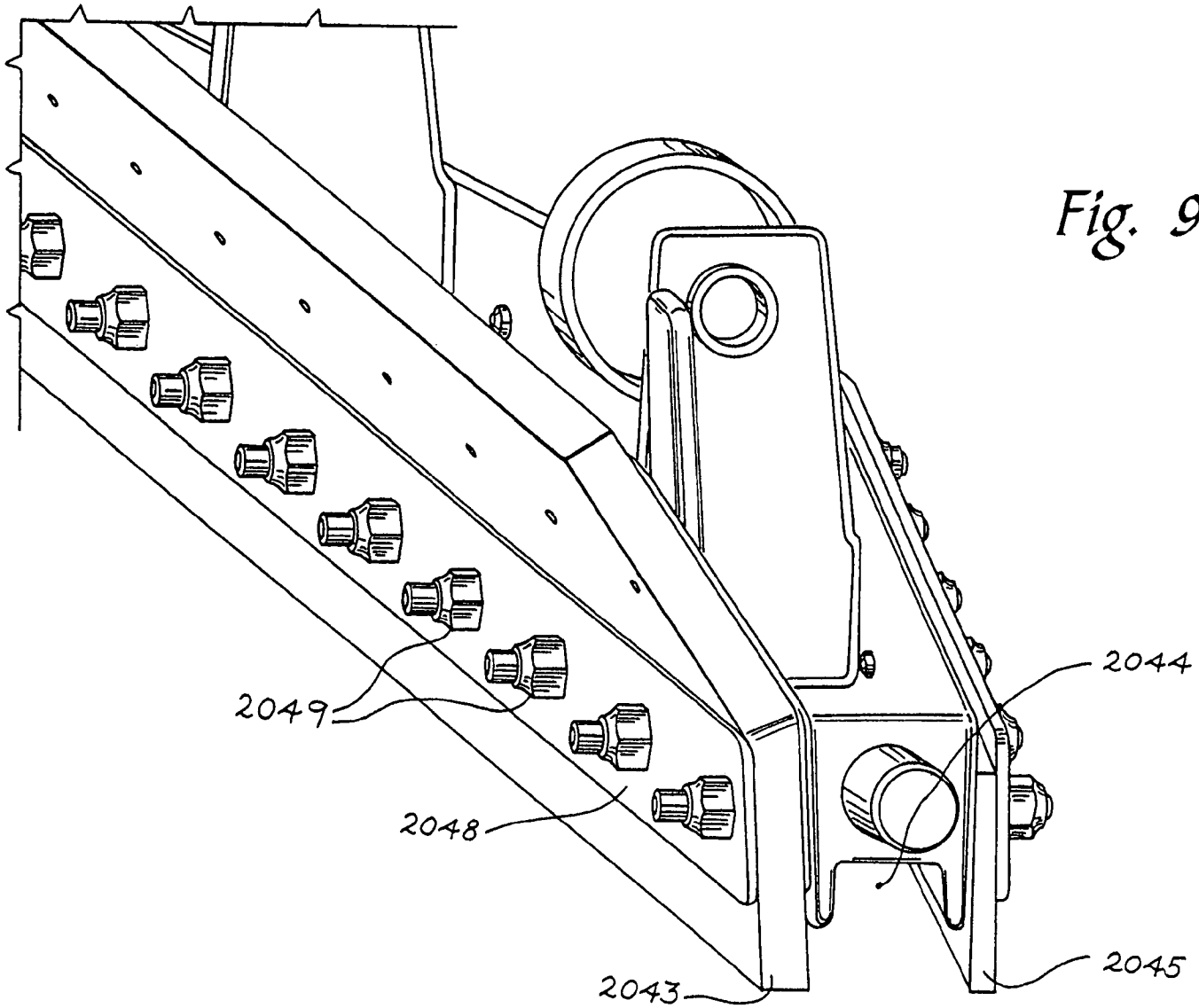
FIG. 90 is an illustration of a squeegee assembly of an embodiment.
Figure 91:
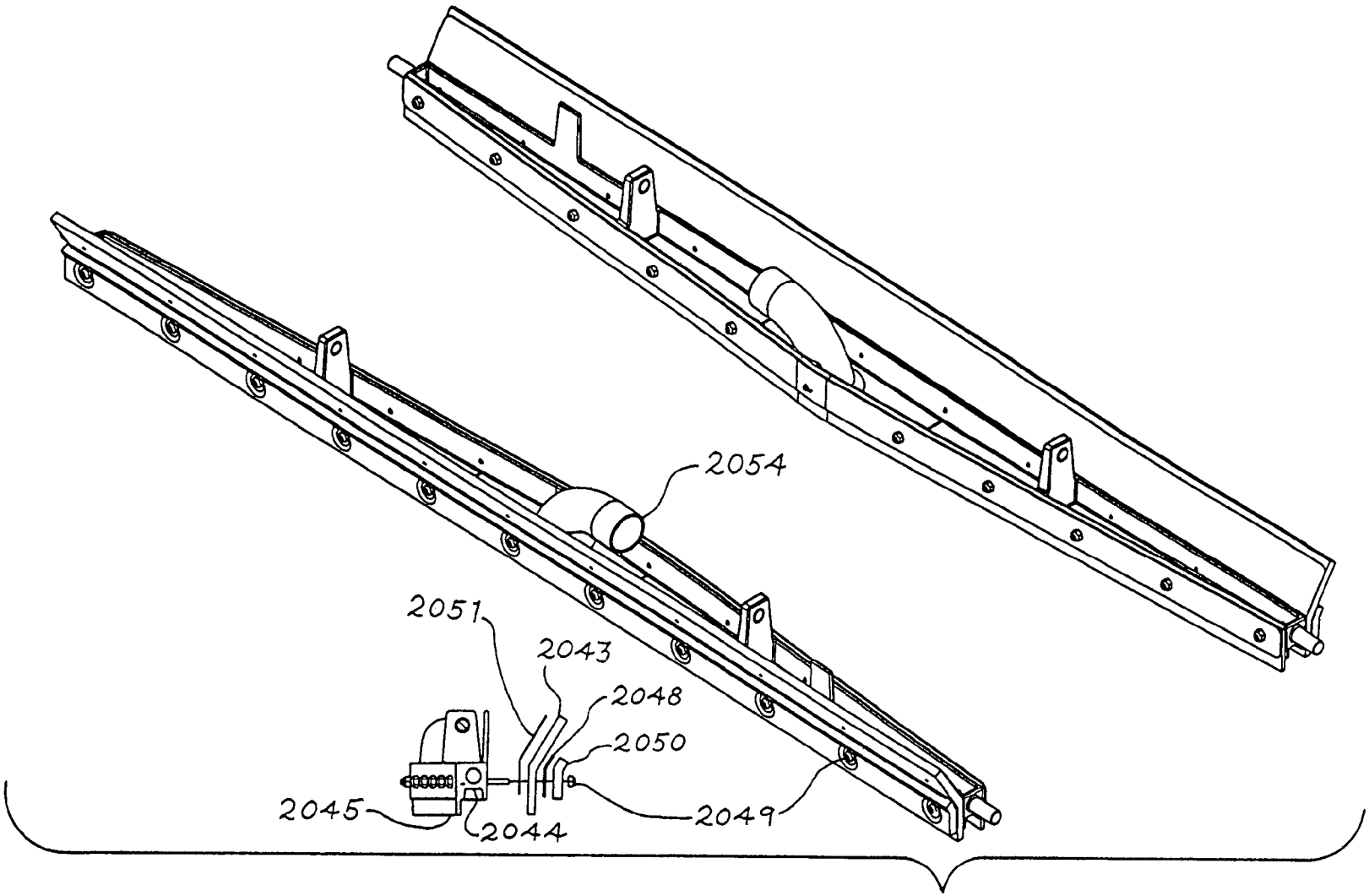
FIG. 91 is another illustration of a squeegee assembly of an embodiment.
Figure 92:
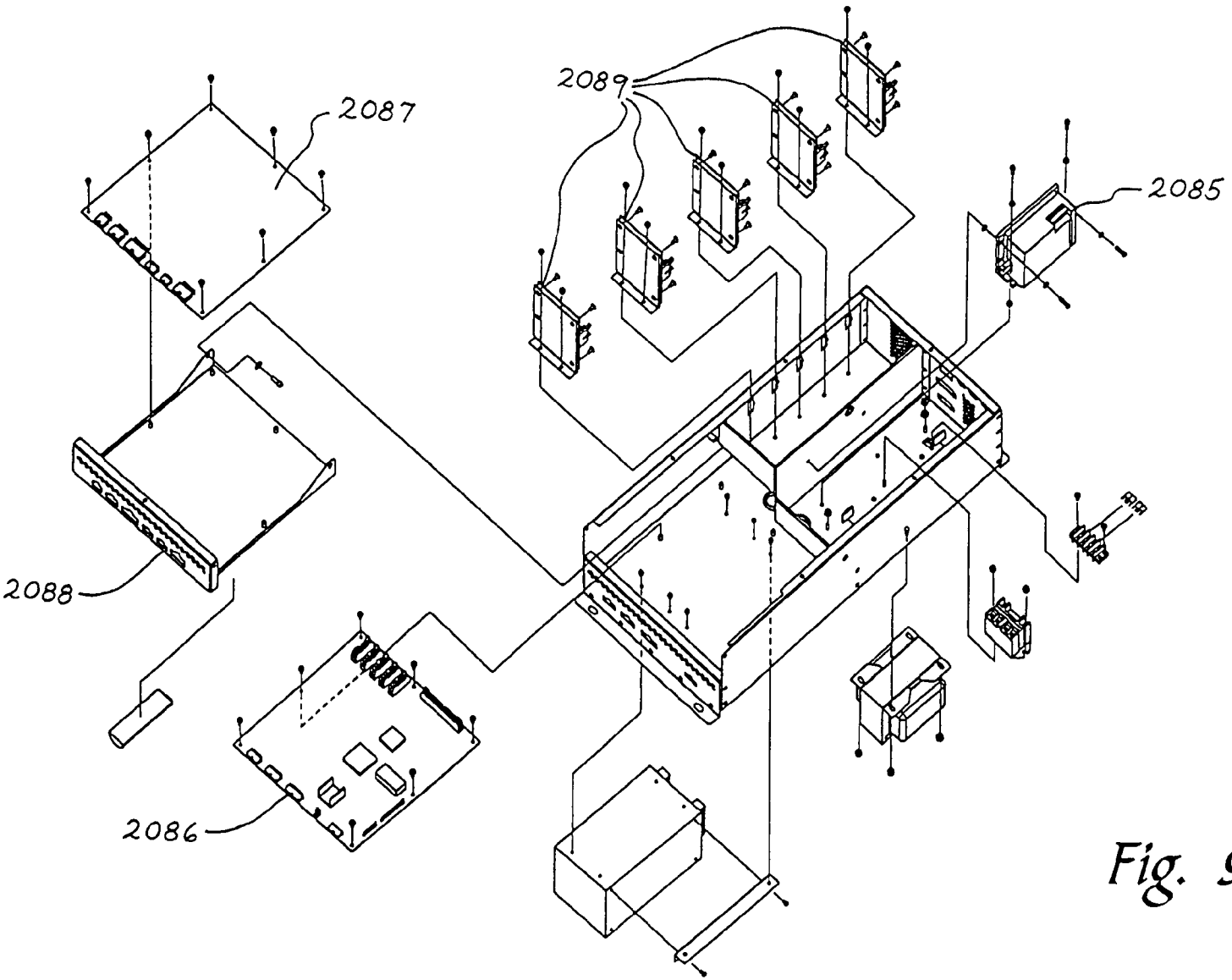
FIG. 92 is an illustration of an electrical enclosure of an embodiment.

Referring back to the drawings, FIG. 89 illustrates a fluid flow diagram of the dressing application system of a preferred embodiment. It includes a dressing fluid tank 2060, a dressing prefilter 2061, a dressing fluid pump 2062, a dressing fluid filter 2063 (preferably a 10 micron automotive type spin-on oil filter), and an injector rail 2064 (containing a dressing fluid heater 2065 and precision delivery injectors 2066), an accumulator rail 2607 (containing a dressing fluid pressure accumulator 2068, a dressing fluid pressure sensor/regulator 2069, a temperature sensor 2070, and a pressure gauge 2071), a dressing fluid flow valve 2072, a dressing vent overflow assembly 2073, and a dressing vent valve 2074. The dressing fluid pump 2062 can circulate the oil in a loop from the tank 2060, through the filters 2061, 2063, connecting tubing 2075, injector rail 2064, accumulator rail 2067 and back into the tank 2060 while the heater 2065 is on to bring the system to a stabilized, controlled temperature. The dressing fluid flow valve 2072 and dressing vent valve 2074 open to allow oil circulation with the least pressure in the connecting tubing 2075 and avoid pressure or vacuum in the dressing fluid tank 2060. When the conditioner reaches operating temperature (in one embodiment, factory-set to 80° F. (21° C.)), the conditioner pump 2062 turns off. The system also allows operation without heating the oil. The dressing system preferably precharges the pressure in the injector rail 2064 before the machine applies the oil pattern onto each lane. It accomplishes this by turning on the dressing fluid pump 2062, closing the dressing fluid flow valve 2072 (which starts accumulating pressure in the injector and accumulator rails 2064, 2067) and monitoring the dressing fluid pressure sensor/regulator 2069 to turn off the pump 2060 when the pressure reaches 30 psi. The dressing vent valve 2074 is open during this operation so no pressure or vacuum builds up in the dressing fluid tank 2060. The dressing fluid flow valve 2072 then opens to allow dressing to bleed off pressure and allow dressing to return to the dressing fluid tank 2060 until the dressing fluid flow valve 2072 closes to hold the normal operating pressure of 20 psi. At that point, the system is ready for the machine to apply dressing as it travels down the lane. In one preferred embodiment, the dressing fluid pressure accumulator 2068 will supply oil and maintain a minimal pressure drop as the injectors 2066 meter dressing in the specified amount every 1.2 inches along the length of the lane.

The conditioning system in this embodiment contains 39 precision injectors 2066 that apply lane conditioning oil directly to the bowling lane, a buffer brush 2076 and a dispersion roller 2077. The 39 injectors 2066 are connected to an injector rail 2064 that is fixed (i.e., the injector rail 2064 and, thus, the injectors 2066, do not reciprocate from side-to-side in a direction perpendicular to the direction of travel). By having the injector rail 2064 and injectors 2066 be fixed, the lane machine 2000 avoids the problem of applying oil in a zigzag pattern on the bowling lane.

Based on a selection of a desired conditioning pattern (e.g., heavier at the center and lighter at the ends), a controller causes selected independent injectors 2066 of the total 39 injectors to apply oil for various durations of time. An injector 2066 includes a seat with an opening, a needle affixed to a stator, coils, and an orifice plate. The orifice plate preferably has five discharge openings disposed in a generally pentagonal orientation for injecting a plurality of jets of dressing fluid across the 1 1/16" width of a bowling lane board. Accordingly, each of the 39 injectors 2066 delivers oil across the 1 1/16" width of a corresponding one of 39 boards of the bowling lane. The diameter of each discharge opening is preferably 0.004-0.008 inches, and the diameter of the orifice plate is preferably 0.25 inches. When an electric field is generated by the coils in response to a command from the control system, the stator moves upwardly, causing the needle to move away from the seat and inject lane conditioning oil through the seat opening and through the discharge openings in the injector's orifice plate. When the electric field is removed, the stator moves downwardly, causing the needle to move to a closed position in the seat, thereby restricting flow of lane conditioning oil.

The buffer brush 2076 is used to provide uniform distribution of the oil that is directly injected onto the bowling lane by the injectors 2066. The tips of the buffer brush 2076 are preferably "flagged" or split to a desired distance from the end of the tip to assist the oil dispersion on the lane. A fixed-speed buffer brush rotation motor 2078 rotates the buffer brush. In the preferred embodiment, the buffer brush 2076 rotates in the same direction as the forward travel of the lane machine. As the buffer brush 2076 contacts the bowling lane, bristles on the buffer brush 2076 pick up oil, and the dispersion roller 2077, which is in contact with and rotating in the opposite direction of the buffer brush 2076, slightly crushes, bends, or otherwise deforms the oil-carrying bristles of the buffer brush 2076 to intermingle the oil amongst the various bristles. The dispersion roller 2077 is of cylindrical cross-section and is made of a metal such as steel or aluminum. The surface of the dispersion roller 2077 is smooth polished or textured. A fixed-speed dispersion motor 2079 rotates the dispersion roller 2077 in a direction opposite the rotational direction of the buffer brush 2076. Also, the dispersion roller 2077 may move from side-to-side (e.g., within a range of ±1") to assist in smoothing dressing fluid on the buffer brush 2076. The dispersion roller 2077 places the oil it catches from the buffer brush 2076 back onto the buffer brush 2076. However, preferably no oil dispensed from the injectors 2066 reaches the buffer brush 2076 or dispersion roller 2077 before first contacting the bowling lane. Upon reaching the end of the desired conditioning pattern, the buffer brush 2076 pivots up and out of contact from the bowling lane as the lane machine 2000 continues to travel to the pin deck. The buffer brush 2076 can pivot down to contact the bowling lane and further smooth the oil over the lane as the machine travels in the reverse direction towards the foul line. The control system can pivot the buffer brush 2076 down over any desired section of the lane while the machine travels in the reverse direction. In the preferred embodiment, the buffer brush 2076 rotates in the opposite direction as the reverse travel of the lane machine. In the preferred embodiment, the injectors 2066 do not deliver oil to the lane while the machine travels in the reverse direction.

In a presently preferred embodiment, the dressing fluid tank 2060 is a 2 quart polymeric reservoir (Equistar, Type Petrothene LP500200), the dressing prefilter 2061 has a 40-mesh strainer, the dressing fluid pump 2062 is a diaphragm pump, rated for 115 VAC, 1.5 GPM, 50 PSI with Buna check valves and diaphragm the dressing fluid filter 2063 is a 10 micron spin-on automotive type. Also, preferably, the injector rail 2064 is an aluminum extrusion, the dressing fluid heater 2065 is a Hotwatt, Inc., AT37-36/200 W/120 V/SF1-9 heater (rated for 120 VAC, 200 W), the precision delivery injectors 2066 are Synerject Deka VII short injectors, the accumulator rail 2067 is an aluminum extrusion, the dressing fluid pressure accumulator 2068 is typically a 0.5 liter diaphragm hydraulic oil component, the dressing fluid pressure sensor/regulator 2069 is a Mercury #881879-6 component, the temperature sensor 2070 is a Delphi Automotive Sys. #15326386 sensor, the pressure gauge 2071 is a 60 psi liquid filled, dial type gauge. Further, preferably, the dressing fluid flow valve 2072 is a 2-way normally closed, electrically activated solenoid brass valve, the dressing vent overflow assembly 2073 is a line strainer with no screen, the dressing vent valve 2074 is a 2-way normally closed, electrically activated solenoid brass valve, and the tubing 2075 is made from a polyethylene material. Also, the buffer brush 2076 is preferably a 4"diameter×41.38 long brush section with 0.014" diameter pex bristles with 0.125" heavily flagged depth, 0.188 inch-wide channel, 0.25" winding lead, and the dispersion roller 2077 is preferably a Lith-o-Roll #30500004 roller-oscillator assembly, 1.5" diameter×41.5" long aluminum shell. Preferably, the bristles of the buffer brush 2076 are specially flagged on the end that contacts the bowling lane to balance the ability of the brush to spread the oil evenly across the width of the lane with minimal storage capacity to move the oil along the length of the bowling lane. The buffer brush rotation motor 2078 is preferably rated for ⅓ HP, 50/60 Hz 110/220/115/230 VAC, 5/2.5/3.8/1.9 A, 1425/1725 RPM, Class F insulation, the dispersion motor 2079 is preferably a 60 rpm gearmotor, rated for 115 VAC, 60 Hz, Class B Insulation, and the traction drive motor 2080 is preferably rated for 90 VDC, ¼ HP, 165 RPM.

The use of injectors 2066 to apply lane conditioning oil to a bowling lane is an improvement over older wick technologies. Wick technology generally involves the use of a wick disposed in a lane-conditioning-oil reservoir. During travel of the machine down the bowling lane, dressing fluid is transferred from the reservoir onto a transfer roller via the wick and then onto an applicator roller for application onto the lane. One of the limitations of wick technology is that once the wick is disengaged from the transfer roller, a residual amount of fluid remaining on the transfer and applicator rollers is applied onto the bowling lane. This makes it difficult to precisely control the amount of dressing fluid applied along the length of the bowling lane. Precisely controlling the amount of applied dressing fluid is also made difficult by the fact that a wick transfers fluid from the reservoir by way of capillary action. The use of injectors to directly apply oil to a bowling lane allows the lane machine 2000 to overcome these limitations.

While the use of injectors has been described in this embodiment, other types of lane dressing fluid application systems can be used. In general, the term "lane dressing fluid application system" broadly refers to any system that can apply lane dressing fluid to a bowling lane. In a presently preferred embodiment, the lane dressing fluid application system comprises at least one injector positioned to output lane dressing fluid directly onto a bowling lane. However, instead of outputting lane dressing fluid directly onto a bowling lane, the lane dressing fluid application system can output lane dressing fluid onto a transfer roller in contact with a buffer, wherein the buffer receives lane dressing fluid from the transfer roller and applies the lane dressing fluid onto the bowling lane as the lane machine moves along the bowling lane. Also, instead of using an injector, the lane dressing fluid application system can use any other technology, including, but not limited to, those that use a pulse valve (see U.S. Pat. Nos. 5,679,162 and 5,641,538), a spray nozzle (see U.S. Pat. Nos. 6,090,203; 3,321,331; and 3,217,347), a wick (see U.S. Pat. No. 4,959,884), or a metering pump (see U.S. Pat. Nos. 6,383,290; 5,729,855; and 4,980,815). Each of those patents is hereby incorporated by reference.

Turning now to another aspect of the lane machine 2000, the lane machine 2000 comprises a drive system that includes a traction drive motor 2080 (FIG. 84) operatively connected to drive wheels 2081 (preferably polyurethane with an aluminum hub) to facilitate the automatic travel of the lane machine 2000 from the foul line to the pin deck and back. In one preferred embodiment, the traction drive motor 2080 is controlled by a KBMG-212D ultracompact regenerative drive control board 2085 from Penta Power/KB Electronics, Inc. This may be included with an auxiliary heatsink, rated input: 115/230V, 50/60 Hz; rated output: 0-90/180 VDC, 8 ADC, 11 ADC with auxiliary heatsink. The traction drive motor 2080 preferably propels the lane machine 2000 from the foul line to the pin deck at one of two user-selectable speeds (in one preferred embodiment, 20.2 inches/second or 26.5 inches/second) and propels the lane machine 2000 from the pin deck to the foul line at the same return speed that was selected for the forward speed. These selectable speeds are "constant" in that the lane machine preferably does not switch between 20.2 inches/second and 26.5 inches/second as the lane machine 2000 is traveling from the foul line to the pin deck. In one preferred embodiment, the chosen speed is controlled by setting jumper J4 on the drive control board 2085 to the 10 V position and controlling the analog input voltage. The drive control board 2085 in this embodiment has a hardware-controlled ramp-up to control how fast the drive motor 2080 reaches the selected speed of 20.2 inches/second or 26.5 inches/second and a hardware-controlled ramp-down to control how fast the drive motor decelerates from the selected speed. Controlled ramp-up/ramp-down helps ensure that the drive wheels do not slip in any oil on the lane.

In one embodiment, the ramp-up and ramp-down features of the drive control board 2085 are selected by setting jumper J5 on the drive control board 2085 to the "speed mode," and the breaking feature is selected by setting jumper J6 on the drive control board 2085 to "regenerate to stop." The rate of acceleration and deceleration is selected using the FWD ACCEL and RVS ACCEL trimpots on the drive control board 2085. The FWD ACCEL trimpot determines the forward acceleration and reverse deceleration, and the RVS ACCEL trimpot determines the forward deceleration and reverse acceleration. These trimpots are set at the factory to a constant resistance setting, and the threads are glued to prevent being changed by the operator. Ramp up/down occurs about 4-12 feet from the start and end of the lane, which is ~66 feet long, and takes about 2.0-5.3 seconds.

The preferred sequential steps for this system are listed below. First, a fixed analog input voltage (correlating to 26.5 inches per second) is supplied to the KBMG-212D ultracompact regenerative drive control board 2085 to start the forward motion. The FWD ACCEL trimpot hardware setting controls the fixed rate of acceleration up to 26.5 inches per second at 4-12 feet from the start of the lane (taking about 2.0-5.3 seconds). The machine 2000 travels forward at a constant speed until it reaches a distance of about 55 feet, where the analog input voltage changes to a lower value (correlating to ~20 inches per second). The RVS ACCEL trimpot hardware setting controls the fixed rate of deceleration, approaching 20 inches per second just beyond the end of the first deceleration zone. Before the machine reaches the speed of 20 inches per second, it starts the second deceleration zone, and the analog input voltage changes to a lower value (correlating to ~15 inches per second). The RVS ACCEL trimpot hardware setting controls the fixed rate of deceleration, approaching 15 inches per second just beyond the end of the second deceleration zone. Before the machine reaches the speed of 15 inches per second, it starts the third deceleration zone, and the analog input voltage changes to a lower value (correlating to ~10 inches per second). The RVS ACCEL trimpot hardware setting controls the fixed rate of deceleration, approaching 10 inches per second just beyond the end of the third deceleration zone. Before the machine reached the speed of 10 inches per second, it starts the fourth deceleration zone, and the analog input voltage changes to a lower value (correlating to ~5 inches per second). The RVS ACCEL trimpot hardware setting controls the fixed rate of deceleration, approaching 5 inches per second just beyond the end of the lane. After the machine reaches the end of the lane (13 ticks of the distance encoder 2083 after the end of lane sensor 2082 is activated), it applies the brakes to stop. (The end of lane sensor 2082 is preferably a proximity switch, rated for 10-40& VDC, 0.2 A.), and the distance encoder 2083 is preferably an inductive sensor.

After the lane machine reaches the end of the lane, a fixed analog input voltage (correlating to 26.5 inches per second in reverse) is supplied to the drive control board 2085 to start the reverse motion. The RVS ACCEL trimpot hardware setting controls the fixed rate of acceleration up to 26.5 inches per second in the reverse direction in 4-12 feet from the pindeck end of the lane (taking about 2.0-5.3 seconds). The machine travels reverse at a constant speed until it reaches a distance of about 5 feet before reaching the foul line, where the analog input voltage would change to zero. The FWD ACCEL trimpot hardware setting controls the fixed rate of deceleration, approaching zero inches per second just beyond the foul line, allowing the machine to coast slowly until the rear wheels contact the foul line transition which stops the machine travel.

Turning to yet another aspect of the lane machine 2000, the electrical system comprises a modular electrical enclosure that is easy to remove and exchange, with wire connectors fitting only one way for ease. Specifically, a rugged machine control system is contained in an electrical enclosure 2084 in the center frame section 2010. The electrical enclosure 2084 is modular so it can be easily removed for maintenance, repair, or replacement. The wire connectors allow for quick disconnection with unique connectors and labeling to provide for correct reconnection. The lower PCB 2086 contains the machine control CPU flash memory. The upper PCB 2087 controls the motors. It is mounted in a pivoting bracket 2088 to allow for easy access for the lower PCB 2086. The injector control PCBs 2089 contain the drivers to control the pulse duration of each individual injector 2066. The lower PCB 2086, the upper PCB 2087, and the injector control PCB 2089 are preferably any approved printed circuit board with minimum rating of 94 V-0, 105° C., and the electrical enclosure 2084 is preferably a bright zinc material and measures 10 inches deep by 20.25 inches wide by 6.25 inch high with thickness of 18 GA 0.048 inches. An emergency stop button 2090 is located on the top of the electrical enclosure 2084 for safe access when the top covers 2004, 2005 are opened or closed. The emergency stop button 2090 is preferably a 10 amp switch with a round red activation button coupled with a relay. The graphic user interface 2091 (FIG. 80) is removeable and contains a powerful CPU 2092, large color display 2093, and keyboard control 2094. The clear window of the keypad protects the top of the GUI from moisture. The CPU 2092 is preferably a Viper PC104 PCB version 2.3 from Arcom Inc., the color display 2093 is preferably an LCD Module, and the keyboard control 2094 (as well as the keypad 2015) is preferably membrane type with polyester top coat. More information about the graphic user interface and other alternatives that can be used with this embodiment can be found in U.S. patent application Ser. No. 11/015,845, which is hereby incorporated by reference.

The following describes an exemplary sequence of operations for the lane machine 2000 described above to further illustrate its features. It should be noted that this sequence is intended merely to illustrate one possible set of operations. This sequence should not be read as a limitation on the following claims.

Preparing for Operation

1. When the operator supplies power, the machine warms the conditioner to operating temperature. The control system:
   a. Opens the dressing fluid flow valve, allowing the conditioner pump to circulate conditioner through the heated injector rail.
   b. When the conditioner reaches operating temperature (in one embodiment, factory-set to 80° F. (21° C.)), the conditioner pump turns off, and the dressing fluid flow valves closes.
   c. The control screen displays "READY" when the conditioner is warmed and has reached operating temperature.
2. When the operator presses "OK" to prepare the machine to operate, the control system:
   a. Rotates the take-up roll to lower the contact roller into operating position and confirms that the duster cloth is in the "down" position via the duster down switch.
   b. Lowers the squeegee into operating position via the squeegee up/down motor and confirms that the squeegee is in the "down" position via the squeegee down switch.
   c. Turns on the conditioner pump to slightly over-pressurize the accumulator and injector rail assembly and then turns off (at the same time, the control system opens the conditioner tank vent valve to prevent a vacuum in the conditioner tank).
   d. Opens the dressing fluid flow valve to allow conditioner to flow back to the conditioner tank until the accumulator and injector rail assembly reach operating pressure (at the same time, the control system opens the conditioner tank vent valve to prevent pressurizing the conditioner tank).
   e. Starts the vacuum.
   f. The control screen displays "PUT THE MACHINE ON THE LANE" when the machine is ready to begin operation.
3. Once the machine is on the lane and the operator presses "OK" for the second time, the control system:
   a. Turns on the traction motor to propel the machine toward the pin deck.
   b. Vacuums the lane.
   c. Lowers the buffer brush into contact with the lane surface via the buffer lifting motor at a distance specified by the operator.

d. Turns on the buffer drive motor to start rotating the buffer brush.

e. Tells the conditioning system to inject conditioner onto the lane surface according to the user's selected pattern.

f. Directs the cleaner spray nozzles to apply a steady spray of cleaning fluid on the lane.

The Cleaning System

1. The duster cloth removes dust and dirt from the lane surface.
   a. The duster cloth dusts the lane surface as the machine travels toward the pin deck.
   b. When the machine reaches the end of the lane, the take-up roll winds up, creating tension in the cloth that lifts the contact roller for a measured time duration until it reaches the duster up switch (a friction clutch attached to the supply roll is adjusted to ensure the contact roller reaches a fixed stop in the "up" position before it unrolls).
   c. The take up roll continues to rotate for a certain additional percentage of the previously measured time duration to advance clean duster cloth for use on the next lane.
2. The cleaner pump applies cleaning solution to the lane.
   a. Five adjustable spray nozzles apply a continuous spray of cleaning fluid to the lane.
   b. A spring-loaded check valve opens when more than 10 psi of cleaning fluid is applied.
   c. Some spray dampens the back of the cloth.
   d. A pressure control valve controls the cleaner volume and pressure, allowing the user to select the distance along the lane at which the cleaner transitions from higher to lower flow. The control system shuts the cleaner pump off and on at the transition distance (between the high and low flow rates).
   e. The control system turns off the cleaning pump near the pin deck end of the lane and then turns the pump back on for a short time and then off before the machine crosses the pin deck, stopping the flow of cleaner through the spray nozzle.
3. The absorbent wiper agitates the cleaning fluid on the lane to help loosen dirt and conditioner while allowing the cleaner and dirty conditioner to enter into the front of the squeegee assembly.
4. The squeegee assembly and vacuum remove cleaner and conditioner from the lane surface and collect it in the waste recovery tank.
   a. The V-shaped rear squeegee blade channels waste fluid to the center of the squeegee assembly, which optimizes the suction of the vacuum.
   b. Waste fluid is suctioned to the waste recovery tank.
   c. A baffle system in the waste recovery tank directs waste liquids and solids to the bottom of the tank. This keeps airflow near the vacuum motor substantially free from liquids or solids and isolates the waste material away from the vacuum motor outlet.
   d. Vacuum exhaust may be redirected toward the area behind the squeegee to help dry the surface of the lane.

The Conditioning System

1. The machine applies conditioner directly to the lane surface in a pattern specified by the user.
   a. 39 injectors mounted on a pressurized rail apply conditioner.
   b. The rail is fixed (i.e., the injectors do not reciprocate from side to side) to avoid creating a zigzag conditioner pattern on the bowling lane.
   c. Each injector disperses fluid across a 1 1/16" width (the width of one board of the lane) and is independently controlled based on the conditioning pattern selected.
   d. Injectors pulse every 0.1 feet (30.5 mm) (pulse pattern is preferably distance based, not dependent on machine's rate of travel).

The Buffing Operation

1. During the buffing operation, the machine disperses and buffs the conditioner on the lane surface, while continuing its return travel to the foul line.
   a. The buffer brush lowers at the start of operation and begins rotating at 720 RPM.
   b. The dispersion roller, rotating in the opposite direction of the buffer brush, contacts the buffer brush and blends the conditioner amongst the bristles through side-to-side oscillation.
   c. When the machine reaches the end of the conditioning pattern, the control system stops the rotation of the buffer brush and dispersion roller. It turns on the buffer lift motor and raises the brush up and out of contact from the lane as the machine continues its travel to the pin deck when in the Clean and Oil mode.

The Drive System

1. The machine travels up and down the lane by means of a traction motor connected through a chain to two drive wheels.
   a. At "normal" speed, the machine travels at a constant 26.5 inches per second in forward and reverse travel.
   b. At the optional "reduced" speed the machine travels at a constant 20 inches per second in forward and reverse to enhance lane cleaning with difficult conditioners.
2. Forward travel.
   a. The machine travels forward at a constant 26.5 inches per second (or 20 inches per second at optional reduced speed).
   b. As the front of the machine travels past the end of the pin deck, the end-of-lane sensor signals the controller to travel an additional 1.2 feet (36.5 cm) before applying the brake.
   c. The squeegee assembly raises.
   d. The duster cloth motor rotates the take-up roll to raise the contact roller away from the lane surface until it contacts the duster up switch.
   e. The take-up roll continues to rotate to advance clean cloth for use on the next lane cloth to prepare for use on the next lane.
   f. The traction motor turns on to accelerate the machine back to the foul line.
3. Return to the foul line.
   a. The machine returns to the foul line in reverse travel at a constant rate of 26.5 inches per second (or 20 inches per second at optional reduced speed).
   b. The buffer brush lowers into contact with the lane surface at the end of the lane pattern to continue buffing conditioner on the return to the foul line (no conditioner is applied on the return).
   c. As a safety precaution, the machine is designed to decelerate as it reaches the foul line.
   d. Once the machine reaches the foul line, the GUI displays the number of the next lane to be maintained.

It should be noted that the various embodiments described herein can be used alone or in combination with one another. Also, although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

GLOSSARY OF TERMS

100 . . . lane conditioning system
102 . . . housing
104 . . . transfer wheels
106 . . . buffer
108 . . . linear actuation system
110 . . . rack
112 . . . pinion
114 . . . telescoping motor
116 . . . nozzle rail
118 . . . hall effect encoder
119 . . . End-of-lane sensor
120 . . . cleaning fluid delivery and removal system (cleaning system)
121 . . . contact wheel
122 . . . cleaning fluid reservoir
124 . . . cleaning fluid delivery nozzles
126 . . . vacuum system
128 . . . front wall
130 . . . rear wall
132 . . . left side wall
134 . . . right side wall
136 . . . top cover
138 . . . support casters
140 . . . dressing fluid delivery and application system (dressing application system)
142 . . . handle
144 . . . support wheels
148 . . . transition wheels
150 . . . drive system
152 . . . drive motor
154 . . . drive wheels
156 . . . drive sprocket
158 . . . motor shaft
160 . . . drive chain
162 . . . drive shaft
164 . . . speed tachometer
170 . . . cleaning fluid pump
172 . . . duster cloth supply roll
174 . . . duster cloth unwind motor
176 . . . duster roller
178 . . . pivot arms
180 . . . waste roller
182 . . . waste roller windup motor
184 . . . duster cloth
186 . . . guide shaft
188 . . . duster down switch
190 . . . duster up switch
192 . . . squeegee system
194 . . . waste reservoir
196 . . . vacuum hose
198 . . . vacuum pump
202 . . . squeegees
204 . . . pivot arms
206 . . . first linkage
208 . . . second linkage
210 . . . squeegee up/down motor
212 . . . squeegee down switch
214 . . . squeegee up switch
216 . . . dryer
218 . . . opening
220 . . . dressing fluid tank
222 . . . dressing fluid heater
224 . . . dressing fluid filter
226 . . . dressing fluid pump
228 . . . dressing fluid pressure sensor/regulator
229 . . . dressing fluid flow valve(s)
230 . . . injector rail
231 . . . dressing fluid pressure accumulator
232 . . . precision delivery injectors
233 . . . rail reciprocation motor
234 . . . driven sheave
236 . . . drive sheave
238 . . . buffer drive motor
240 . . . belt
242 . . . linkage
248 . . . buffer up/down motor
250 . . . control system
252 . . . user interface
254 . . . start switch
256 . . . color monitor
260 . . . upstream end
262 . . . downstream end
264 . . . longitudinal axis
266 . . . member
268 . . . seat
270 . . . guide
272 . . . opening
274 . . . needle
276 . . . stator
278 . . . coils
280 . . . orifice plate
282 . . . orifice plate
284 . . . slot
285 . . . board
286 . . . conical surface
288 . . . orifice plate
290 . . . elongated discharge openings
292 . . . conical surface
294 . . . orifice plate
295 . . . openings
296 . . . discharge openings
297 . . . passage
298 . . . conical surface
299 . . . openings
300 . . . second embodiment of lane conditioning system
301 . . . fourth embodiment of orifice plate
302 . . . precision delivery injectors
303 . . . discharge openings
304 . . . injector rail
305 . . . conical surface
306 . . . motor
400 . . . third embodiment of lane conditioning system
402 . . . dressing fluid transfer system
404 . . . transfer roller
406 . . . buffer
408 . . . transfer roller motor
410 . . . drive sheave
412 . . . driven sheave
500 . . . fourth embodiment of lane conditioning system
502 . . . Pivot mechanism
504 . . . pivot link
506 . . . pivot motor
600 . . . fifth embodiment of lane conditioning system
602 . . . agitation mechanism
604 . . . duster cloth
606 . . . reciprocating head
608 . . . motor
610 . . . cam and follower assembly
612 . . . spring

614 . . . linkage
616 . . . agitation mechanism up/down motor
618 . . . Agitation mechanism up switch
620 . . . Agitation mechanism down switch
700 . . . sixth embodiment of lane conditioning system
702 . . . rotary agitation mechanism
704 . . . paddles
706 . . . rotary head
708 . . . motor
710 . . . driven sheave
712 . . . drive sheave
714 . . . belt
716 . . . linkage
718 . . . agitation mechanism up/down motor
720 . . . Rotary agitation mechanism up switch
722 . . . Rotary agitation mechanism down switch
800 . . . seventh embodiment of lane conditioning system
802 . . . shuttled injectors
804 . . . motor
806 . . . reciprocating buffer
808 . . . injector rail
900 . . . eighth embodiment of lane conditioning system
902 . . . fixed injectors
904 . . . buffer reciprocation motor
906 . . . reciprocating buffer
908 . . . fixed injector rail
1000 . . . ninth embodiment of lane conditioning system
1002 . . . precision delivery injectors
1006 . . . buffer
1008 . . . vertically reciprocate rail axis-X
1100 . . . tenth embodiment of lane conditioning system
1102 . . . precision delivery injectors
1104 . . . reciprocating motor
1108 . . . injector rail
1110 . . . horizontally reciprocable dispersion roller
2000 . . . lane conditioning system (or "machine")
2001 . . . cross brace
2002 . . . transfer rollers
2003 . . . front guide rollers
2004, 2005 . . . top covers
2006, 2007 . . . left and right side walls
2008 . . . gas springs
2009 . . . ball joints
2010 . . . center housing section
2011 . . . ¼-turn latch
2012 . . . front handle/bumper
2013 . . . rear T-handle
2014 . . . rear wall
2015 . . . keypad
2016 . . . magnet
2017 . . . steel plate
2018 . . . rear wheels
2019 . . . front transition wheels
2020 . . . duster cloth
2021 . . . duster cloth supply roll
2022 . . . duster cloth backup roller
2023 . . . duster cloth take-up roll
2024 . . . duster motor
2025 . . . friction clutch
2026 . . . pivot arms
2027 . . . duster up switch
2028 . . . duster down switch
2029 . . . duster up stop
2030 . . . duster down stop
2031 . . . cleaning fluid reservoir
2032 . . . cleaning filter
2033 . . . cleaning fluid pump
2034 . . . cleaning system manifold
2035 . . . cleaning fluid delivery nozzles
2036 . . . check valve assembly
2037 . . . ball joint
2038 . . . tube
2039 . . . flow control needle valves
2040 . . . solenoid control valve
2041 . . . additional flow path
2042 . . . vacuum/motor assembly
2043 . . . front wiper
2044 . . . a squeegee channel
2045 . . . rear elastomer blade
2046 . . . pivot arm
2047 . . . squeegee lift motor assembly
2048 . . . attachment plate
2049 . . . screws
2050 . . . absorbent foam pad
2051 . . . metal shield
2052 . . . vacuum hose
2053 . . . removable waste reservoir
2054 . . . vacuum tube
2055 . . . inlet
2056 . . . outlet
2057 . . . upper baffles
2058 . . . lower baffles
2060 . . . dressing fluid tank
2061 . . . dressing prefilter
2062 . . . dressing fluid pump
2063 . . . dressing fluid filter
2064 . . . injector rail
2065 . . . dressing fluid heater
2066 . . . precision delivery injectors
2067 . . . accumulator rail
2068 . . . dressing fluid pressure accumulator
2069 . . . dressing fluid pressure sensor/regulator
2070 . . . temperature sensor
2071 . . . pressure gauge
2072 . . . dressing fluid flow valve
2073 . . . dressing vent overflow assembly
2074 . . . dressing vent valve
2075 . . . tubing
2076 . . . buffer brush
2077 . . . dispersion roller
2078 . . . buffer brush rotation motor
2079 . . . dispersion motor
2080 . . . traction drive motor
2081 . . . drive wheels
2082 . . . end of lane sensor
2083 . . . distance encoder
2084 . . . electrical enclosure
2085 . . . drive control board
2086 . . . lower PCB
2087 . . . upper PCB
2088 . . . pivoting bracket
2089 . . . injector control PCBs
2090 . . . emergency stop button
2091 . . . graphic user interface
2092 . . . CPU
2093 . . . color display
2094 . . . keyboard control

What is claimed is:

1. A bowling lane conditioning machine comprising:

a housing;

a lane dressing fluid application system carried by the housing;

a cleaning fluid delivery and removal system carried by the housing, wherein the cleaning fluid delivery and removal system comprises:

a cleaning fluid reservoir;

at least one cleaning fluid delivery nozzle in communication with the cleaning fluid reservoir;

a v-shaped squeegee; and a vacuum;

a drive system operative to propel the bowling lane conditioning machine to travel in a forward direction along a bowling lane from a foul line to a pin deck and in a reverse direction from the pin deck to the foul line; and a control system operative to control the vacuum such that:

(i) the vacuum is turned on after the bowling lane conditioning machine has traveled a predetermined distance in the forward direction; and (ii) the vacuum is off for at least some of the travel of the bowling lane conditioning machine in the reverse direction, wherein once the vacuum is off for at least some of the travel in the reverse direction, it remains off as the bowling lane conditioning machine returns to the foul line.

2. The bowling lane conditioning machine of claim 1, wherein the v-shaped squeegee comprises a cross section that balances constant air speed from edges of the squeegee to a center of the squeegee.

3. The bowling lane conditioning machine of claim 1, wherein the v-shaped squeegee directs cleaning fluid and waste oil toward a center of the bowling lane as the bowling lane conditioning machine is traveling the predetermined distance, and wherein, when the bowling lane conditioning machine has traveled the predetermined distance and the vacuum is turned on, the vacuum removes the accumulated cleaning fluid and waste oil.

4. The bowling lane conditioning machine of claim 3 further comprising a battery powering the bowling lane conditioning machine, and wherein the control system is operative to cause the vacuum to remain off when the bowling lane conditioning machine is located at the front section of the bowling lane to conserve power and reduce noise.

5. The bowling lane conditioning machine of claim 1, wherein the control system is operative to turn the vacuum off before the bowling lane conditioning machine reaches an end of a bowling lane.

6. The bowling lane conditioning machine of claim 1 further comprising an absorbent front wiper operative to agitate cleaning fluid on a bowling lane while allowing liquid to enter the absorbent front wiper.

7. The bowling lane conditioning machine of claim 1, wherein the at least one cleaning fluid delivery nozzle is internal to the housing.

8. The bowling lane conditioning machine of claim 7, wherein the at least one cleaning fluid delivery nozzle provides a constant spray of cleaning fluid.

9. The bowling lane conditioning machine of claim 1, wherein the lane dressing fluid application system comprises at least one injector comprising at least one opening and a valve.

10. The bowling lane conditioning machine of claim 1, wherein the lane dressing fluid application system comprises a buffer brush comprising bristles flagged on an end that contacts a bowling lane to balance an ability of the buffer brush to spread lane dressing evenly across a width of the bowling lane with minimal storage capacity to move the lane dressing along a length of the bowling lane.

11. A bowling lane conditioning machine comprising:

a housing;

a storage battery and DC electrical system carried by the housing;

a lane dressing fluid application system carried by the housing;

a cleaning fluid delivery and removal system carried by the housing, wherein the cleaning fluid delivery and removal system comprises:

a cleaning fluid reservoir;

at least one cleaning fluid delivery nozzle in communication with the cleaning fluid reservoir;

a v-shaped squeegee; and a vacuum;

a drive system operative to propel the bowling lane conditioning machine to travel in a forward direction along a bowling lane from a foul line to a pin deck and in a reverse direction from the pin deck to the foul line; and a control system operative to control the vacuum such that:

(i) the vacuum is turned on after the bowling lane conditioning machine has traveled a predetermined distance in the forward direction; and (ii) the vacuum is off for at least some of the travel of the bowling lane conditioning machine in the reverse direction, wherein once the vacuum is off for at least some of the travel in the reverse direction, it remains off as the bowling lane conditioning machine returns to the foul line.

12. The bowling lane conditioning machine of claim 11, wherein the v-shaped squeegee comprises a cross section that balances constant air speed from edges of the squeegee to a center of the squeegee.

13. The bowling lane conditioning machine of claim 11, wherein the v-shaped squeegee directs cleaning fluid and waste oil toward a center of the bowling lane as the bowling lane conditioning machine is traveling the predetermined distance, and wherein, when the bowling lane conditioning machine has traveled the predetermined distance and the vacuum is turned on, the vacuum removes the accumulated cleaning fluid and waste oil.

14. The bowling lane conditioning machine of claim 13, wherein the storage battery is operative to power the bowling lane conditioning machine, and wherein the control system is operative to cause the vacuum to remain off when the bowling lane conditioning machine is located at the front section of the bowling lane to conserve power and reduce noise.

15. The bowling lane conditioning machine of claim 11, wherein the lane dressing fluid application system comprises a buffer brush comprising bristles flagged on an end that contacts a bowling lane to balance an ability of the buffer brush to spread lane dressing evenly across a width of the bowling lane with minimal storage capacity to move the lane dressing along a length of the bowling lane.

16. A bowling lane conditioning machine comprising:

a housing;

a lane dressing fluid application system carried by the housing;

a cleaning fluid delivery and removal system carried by the housing, wherein the cleaning fluid delivery and removal system comprises:

a cleaning fluid reservoir;

at least one cleaning fluid delivery nozzle in communication with the cleaning fluid reservoir; and a vacuum;

a drive system operative to propel the bowling lane conditioning machine to travel in a forward direction along a bowling lane from a foul line to a pin deck and in a reverse direction from the pin deck to the foul line; and a control system operative to control the vacuum such that:

(i) the vacuum is turned on after the bowling lane conditioning machine has traveled a predetermined distance in the forward direction; and (ii) the vacuum is off for at least some of the travel of the bowling lane conditioning machine in the reverse direction, wherein once the vacuum is off for at least some of the travel in the reverse direction, it remains off as the bowling lane conditioning machine returns to the foul line.

17. The bowling lane conditioning machine of claim 16 further comprising a DC electrical system that powers the lane dressing fluid application system, the cleaning fluid delivery and removal system, the drive system, and the control system.

18. The bowling lane conditioning machine of claim 16, wherein the control system is operative to turn off the vacuum after the bowling lane conditioning machine leaves the pin deck.

19. The bowling lane conditioning machine of claim 16, wherein the control system is operative to turn off the vacuum before the bowling lane conditioning machine starts traveling in the reverse direction from the pin deck to the foul line.

20. The bowling lane conditioning machine of claim 16, wherein the predetermined distance is about 55 feet from the foul line.

* * * * *